US008681063B2

(12) United States Patent
Endou et al.

(10) Patent No.: US 8,681,063 B2
(45) Date of Patent: Mar. 25, 2014

(54) ANTENNA DEVICE

(75) Inventors: Kenji Endou, Tokyo (JP); Yasuyuki Hara, Tokyo (JP)

(73) Assignee: TDK Corporation, Tokyo (JP)

( * ) Notice: Subject to any disclaimer, the term of this patent is extended or adjusted under 35 U.S.C. 154(b) by 171 days.

(21) Appl. No.: 13/402,208

(22) Filed: Feb. 22, 2012

(65) Prior Publication Data

US 2012/0218157 A1 Aug. 30, 2012

(30) Foreign Application Priority Data

Feb. 28, 2011 (JP) ..... 2011-043029
Aug. 10, 2011 (JP) ..... 2011-174458

(51) Int. Cl.
*H01Q 11/12* (2006.01)

(52) U.S. Cl.
USPC ..... 343/743; 343/741; 343/866

(58) Field of Classification Search
USPC ..... 343/741, 743, 866
See application file for complete search history.

(56) References Cited

U.S. PATENT DOCUMENTS 6,342,856 B1 * 1/2002 Nakano et al. ..... 343/700 MS
8,314,741 B2 * 11/2012 Nagai et al. ..... 343/743
2010/0245194 A1 * 9/2010 Sawazaki et al. ..... 343/743

FOREIGN PATENT DOCUMENTS

JP A-2005-198245 7/2005
JP A-2008-92491 4/2008

* cited by examiner

*Primary Examiner* — Hoang V Nguyen
(74) *Attorney, Agent, or Firm* — Posz Law Group, PLC

(57) ABSTRACT

An antenna device includes a loop-shaped element radiating a radio wave of at least wavelength λ and having an electrical length of m×λ; a first power feeder exciting the loop-shaped element via voltage or current coupling by using a first electrical signal for radiating the radio wave; and a second power feeder exciting the loop-shaped element via a coupling method that is the same type as the first power feeder by using a second electrical signal for radiating a radio wave of wavelength λ/(2×p−1) at a portion that becomes a node of a standing wave that is formed with the first power feeder as an anti-node and that is based on the first electrical signal, here, "m" and "p" are natural numbers.

15 Claims, 67 Drawing Sheets

ANTENNA DEVICE

CROSS REFERENCE TO RELATED APPLICATION

The present application is related to, claims priorities from and incorporates by references Japanese patent application No. 2011-043029, filed on Feb. 28, 2011 and Japanese patent application No. 2011-174458, filed on Aug. 10, 2011.

TECHNICAL FIELD

The present invention relates to an antenna device capable of supporting a plurality of communication systems by using one antenna element.

BACKGROUND

An antenna device mounted in a wireless communication device, such as a portable telephone or a personal data assistant (PDA) that has a built-in small wireless device has evolved. For example, along with the increase in the number of mounted communication systems, the number of mounted antenna devices also increases, and one antenna element is used to support a plurality of communication systems. In recent years, a wireless communication device also needs to support a plural types of communication systems such as a global positioning system (GPS), Bluetooth (registered trademark), and a long term evolution (LTE). For example, antennas capable of supporting a plurality of communication systems are described in the following Patent Documents 1-2.

RELATED PATENT DOCUMENTS

Patent Document 1: JP Laid-Open Patent Publication No 2005-198245

Patent Document 2: JP Laid-Open Patent Publication No 2008-92491

In recent years, in order to meet the demand for miniaturization of a wireless communication device, it has become difficult to secure sufficient space for accommodating an antenna element inside a wireless communication device. For this reason, when a wireless communication device has a plurality of communication systems, instead of providing one antenna element for each communication system, it is preferable that communication functions of the plurality of communication systems can be realized by using one antenna element. Further, when a wireless communication device has a plurality of communication systems, it is necessary that there is no interference among antenna devices respectively supporting the communication systems.

In particular, when a plurality of antenna devices supporting communication systems operating in the same or close frequency bands are mounted on one wireless communication device, a radio wave radiated from an antenna device of one communication system may be received by an antenna device of another communication system. As a result, in addition to that radiation of the radio wave into space is reduced, the other communication system may be interfered with. Therefore, it is necessary to achieve isolation among the antenna devices, more specifically, among a plurality of power feeders, so that the antenna devices do not interfere with each other.

In the antenna of Patent Document 1, one antenna element is provided for each communication system to suppress mutual interference. However, the antenna of Patent Document 1 uses a plurality of antenna elements, and thus is not applicable to the case where communication functions of a plurality of communication systems are realized by using one antenna element. In the multiple input multiple output (MIMO) antenna of Patent Document 2, a loop-shaped element is used and power feeders are provided at an interval of 0.5 wavelength. However, in the MIMO antenna of Patent Document 2, on a single loop-shaped element, three power feeders are arranged at an interval of 0.5 wavelengths. In this case, the perimeter of the loop is 1.5 wavelengths. A loop-shaped element having a perimeter of 1.5 wavelengths cannot resonate to form a standing wave. As a result, it is difficult for the MIMO antenna of Patent Document 2 to secure both isolation and radiation efficiency.

As a commonly known method, there is a method in which, in a substantially square patch antenna, vertical and horizontal polarizations are independently used. However, with this method, one side is 0.5 wavelengths and the perimeter is 2 wavelengths, which are significantly large.

A purpose of the present invention is to secure radiation efficiency while securing isolation among a plurality of power feeders with respect to one small antenna element in the case of realizing communication functions of different communication systems and different signal systems with a single element.

Further, the present inventors invented an antenna device in which two power feeders are provided for power feeding in a single loop-shaped element; mutual isolation between the power feeders is secured; and the power feeders independently operate. However, this antenna device does not include a frequency adjustment means. When a distance between the loop-shaped element and a substrate is not a constant, or when a deformation is performed such as that a loop-shaped element is folded for miniaturization, difference occurs in resonance frequencies of the two power feeders so that it is difficult for the two power feeders to operate with the same frequency. Therefore, further improvement is necessary.

In view of the above drawback, another purpose of the present invention is to also realize an antenna device in which two power feeders are provided in a single loop-shaped element to operate with the same frequency, and in which mutual isolation is secured between the power feeders.

SUMMARY

A means for solving the above described drawbacks is an antenna device that includes a loop-shaped element, a first power feeder, and a second power feeder. The loop-shaped element radiates at least a radio wave of a wavelength $\lambda$ and has an electrical length of $m\times\lambda$. The first power feeder excites the loop-shaped element by using a first electrical signal for radiating the radio wave. The second power feeder excites the loop-shaped element via a coupling method that is the same type as the first power feeder by using a second electrical signal for radiating a radio wave of a wavelength of $\lambda/(2\times p-1)$ at a portion that becomes a node of a standing wave formed with the first power feeder as an anti-node and based on the first electrical signal. Here, "m" and "p" are natural numbers.

For example, when m=p=1, the loop-shaped element is excited by power-feeding one point of the loop-shaped element from the first power feeder using an electrical signal having a wavelength equal to the entire electrical length of the one go-around loop-shaped element (antenna element). When the loop-shaped element is excited with current at the first power feeder, a standing wave is generated in which current has a maximum (anti-node of a current standing wave) and voltage is zero (node of a voltage standing wave) at the first power feeder and at a location ½ wavelength away from the first power feeder (that is, at the opposite side of the first power feeder). At a location ¼ wavelength away from the first power feeder, voltage has a maximum (anti-node of the voltage standing wave) and current is zero (node of the current standing wave). For this reason, when the second power feeder, which excites the loop-shaped element with current, that is, via a coupling method that is the same type as the first power feeder, is provided at a location ¼ wavelength away from the first power feeder, the second power feeder corresponds to a node of a current standing wave excited from the first power feeder. For this reason, the second power feeder does not couple with a standing wave generated by an electrical signal excited from the first power feeder. There is also no coupling between a standing wave generated by an electrical signal excited from the second power feeder and the first power feeder. For this reason, the first power feeder and the second power feeder do not couple with each other. This is the same when the power feeding methods for both power feeders are voltage excitation.

Further, in this antenna device, standing waves respectively generated by current (or voltage) excitations from the first power feeder and the second power feeder all resonate on the loop-shaped element. Therefore, radiation efficiency can be secured. As a result, in the case where one element is used to realize communication functions of different communication systems and different signal systems, this antenna device can secure isolation among a plurality of power feeders with respect to one antenna element and at the same time secure radiation efficiency. A standing wave is a wave that is generated by overlapping of two waves that have the same wavelength, frequency, amplitude and speed, but move in opposite directions, and that is observed as if not propagating but remaining and oscillating at the same place. In a standing wave, a portion that oscillates with the largest amplitude is called an anti-node and a portion that does not oscillate is called a node.

The above described relation holds as long as a standing wave excited by one power feeder becomes a node at the other power feeder. Therefore, the above relation also holds when the excitation frequency of one power feeder is an odd multiple of the excitation frequency of the other power feeder. That is, the above relation also holds when the wavelength corresponding to the excitation frequency of one power feeder is 1/(odd number) of the wavelength corresponding to the excitation frequency of the other power feeder. For example, a standing wave A whose entire perimeter of the loop-shaped element is one wavelength and a standing wave B whose entire perimeter of the loop-shaped element is three wavelengths are generated by power feeding from the first power feeder via current coupling. In the standing wave A, at a location ¼ wavelength away from the first power feeder (that is, in the standing wave B, at a location ¾ wavelength away from the first power feeder), the standing wave A and the standing wave B both become a node of a current standing wave. At this location, the second power feeder is provided and performs current coupling with the loop-shaped element. The loop-shaped element is excited with current from the second power feeder using the same frequency as the standing wave A and the standing wave B. Neither the standing waves A nor B excited by the first power feeder couples with the second power feeder. Similarly, a standing wave generated from the second power feeder by power feeding via current coupling does not couple with the first power feeder. For this reason, the first power feeder and the second power feeder are independent with respect to any frequency. As described above, in the antenna device according to the present means, even when electrical signals of a plurality of frequencies are power-fed to the loop-shaped element, the power feeders do not interfere with each other and can function as two antenna devices between which isolation is secured.

In the above-described means, the first power feeder and the second power feeder must perform the same type of power feeding. That is, when one power feeder performs current power feeding, the other power feeder also performs current power feeding, and when one power feeder performs voltage power feeding, the other power feeder also performs voltage power feeding.

When the power feeders perform the voltage power feeding, it is preferable that the power feeders each have a capacitive coupling electrode arranged opposing the loop-shaped element and be power-fed from a central part of the capacitive coupling electrode. In this way, a signal excited by a standing wave can be canceled, the standing wave being excited from the other electrode and becoming a current anti-node in a vicinity of the capacitive coupling electrode.

Another means for solving the above-described drawbacks is an antenna device that includes a loop-shaped element, a first power feeder, and a second power feeder. The loop-shaped element radiates a radio wave of at least a wavelength $\lambda$ and has an electrical length of $m\times\lambda$. The first power feeder excites the loop-shaped element by using a first electrical signal for radiating the radio wave. The second power feeder excites the loop-shaped element via a coupling method that is a different type from the first power feeder by using a second electrical signal for radiating a radio wave of a wavelength of $\lambda/q$ at a portion that becomes an anti-node of a standing wave formed with the first power feeder as an anti-node and based on the first electrical signal. Here, "m" and "q" are natural numbers.

For example, when m=q=1, the loop-shape element is excited by power-feeding one point of the loop-shaped element from the first power feeder using an electrical signal whose entire electrical length of the one go-around loop-shaped element (antenna element) is one wavelength. When the loop-shaped element is excited with current, a standing wave is generated in which current has a maximum (anti-node of a current standing wave) and voltage is zero (node of a voltage standing wave) at the first power feeder and at a location ½ wavelength away from the first power feeder (that is, at the opposite side of the first power feeder). When the second power feeder, which excites the loop-shaped element via voltage excitation, that is, via a coupling method that is a different type from the first power feeder, is provided at a location zero or ½ wavelength away from the first power feeder, the second power feeder corresponds to a node of a voltage standing wave generated by the current excitation from the first power feeder. For this reason, the second power feeder does not couple with a signal excited with current from the first power feeder. Further, there is also no coupling between a standing wave generated by voltage excitation from the second power feeder and the first power feeder. For this reason, the first power feeder and the second power feeder do not couple with each other. The same conclusion also holds when the power feeding method of the first power feeder and the power feeding method of the second power feeder are opposite as described above, that is, when the first power feeder performs voltage excitation and the second power feeder performs current excitation.

Further, in this antenna device, a standing wave generated by current (or voltage) excitation from the first power feeder and a standing wave generated by voltage (or current) excitation from the second power feeder both resonate on the loop-shaped element. Therefore, radiation efficiency can be secured. As a result, in the case where one element is used to realize communication functions of different communication systems, this antenna device can secure isolation among a plurality of power feeders with respect to one antenna element and at the same time secure radiation efficiency as an antenna device.

The above-described relation holds as long as a current (voltage) standing wave generated by current (voltage) excitation by one power feeder becomes a node of a voltage (current) standing wave at the other power feeder. For this reason, the above relation also holds when the excitation frequency of one power feeder is a natural number multiple of the excitation frequency of the other power feeder. That is, the above relation also holds when the wavelength corresponding to the excitation frequency of one power feeder is 1/(natural number) of the wavelength corresponding to the excitation frequency of the other power feeder.

For example, a standing wave A whose entire perimeter of the loop-shaped element is one wavelength and a standing wave B whose the entire perimeter of the loop-shaped element as three wavelengths are generated from the first power feeder by power feeding via current coupling. At the location where the first power feeder is provided, or, in the standing wave A, at a location ½ wavelength away from the first power feeder (that is, in the standing wave B, at a location 3/2 wavelengths away from the first power feeder), the standing wave A and the standing wave B both become an anti-node of a current standing wave (that is, a node of a voltage standing wave). At this location, the second power feeder is provided and performs voltage coupling with the loop-shaped element. The loop-shaped element is excited via voltage excitation from the second power feeder using the same frequency as the standing wave A and the standing wave B. Neither the two standing waves A nor B excited by the first power feeder couples with the second power feeder. Similarly, a standing wave generated by power-feeding an electrical signal of the same frequency as the standing wave A or standing wave B from the second power feeder via voltage coupling does not couple with the first power feeder. For this reason, the first power feeder and the second power feeder are independent with respect to any frequency. As described above, in the antenna device according to the present means, even when an electrical signal of a plurality of frequencies is power-fed to the loop-shaped element, the power feeders do not interfere with each other and can function as two antenna devices for which isolation is secured.

In the above means, when the first power feeder and the second power feeder performing power feeding via different coupling methods are arranged at the same location, it is preferable that the two power feeders be arranged on opposite sides of each other sandwiching the loop-shaped element. In this way, the two power feeders are mutually separated and isolation can be surely secured.

In the above means, it is preferable that the power feeder that performs voltage power feeding have a capacitive coupling electrode arranged opposing the loop-shaped element and be power-fed from a central part of the capacitive coupling electrode. In this way, a signal excited by a standing wave can be canceled, the standing wave being excited from the other electrode and becoming a current anti-node in the vicinity of the capacitive coupling electrode.

The present invention can secure radiation efficiency while securing isolation among a plurality of power feeders with respect to one small antenna element in the case of realizing communication functions of different communication systems with a single element.

As another perspective, the present invention provides an antenna device that includes a substrate having a ground area; a first power feeder and a second power feeder arranged on the ground area; a loop-shaped element; and a first transmission wire and a second transmission wire. The loop-shaped element has a power receiving section arranged close to the first transmission wire and the second transmission wire, has characteristic impedance adjustment sections, and has a shape including the power receiving section that is plane-symmetrical with respect to a first plane that is perpendicular to the loop-shaped element at the power receiving section. The first transmission wire extends from the first power feeder, passes through a vicinity of the power receiving section, and has a front end grounded to the ground area. The second transmission wire extends from the second power feeder, and has a front end that becomes an open end at a vicinity of the power receiving section.

By configuring this way, an antenna device can be realized in which an antenna is operated with two power feeders using the same resonance frequency and superior isolation characteristics between the power feeders is maintained.

In addition to the above feature, when the loop-shaped element has a folded shape, the area occupied by the loop-shaped element on the substrate can be reduced, and thereby an antenna device supporting miniaturization can be realized.

In the present invention, by forming at least a portion of the first transmission wire, and/or the second transmission wire, and/or the loop-shaped element by a conductor pattern on the substrate surface, a loop-shaped element and a transmission wire for performing power feeding to the loop-shaped element are formed by a substrate pattern. Therefore, the number of parts can be reduced and thus production can be simplified.

Further, in addition to the above feature, the conductor pattern of the substrate surface has an electrode structure of at least two layers. At least a portion of the first transmission wire is formed on one of the two layers of the substrate. At least a portion of the second transmission wire is formed on the other layer of the substrate, which is different from the layer on which the portion of the first transmission wire is formed. By doing so, the first and second transmission wires can sterically intersect each other, thereby, a more compact wiring is possible. Therefore, the area occupied by the transmission wires on the substrate can be reduced.

In the present invention, a base body formed from a dielectric material or a magnetic material having a substantially rectangular cuboid shapes provided on the substrate, and the loop-shaped element is formed on a surface of the base body. By doing so, in addition to that the antenna can be miniaturized using a wavelength shortening effect of the dielectric material or the magnetic material, since the loop-shaped element is formed on the surface of the base body and can be mounted together with the base body on the substrate, production becomes easy.

Further, in addition to the above feature, the substrate has a non-ground area that is provided along at least one side of the substrate, and the base body is arranged in the non-ground area of the substrate. By doing so, the loop-shaped element and the ground area can be formed with a certain distance therebetween. Therefore, improvement in antenna characteristics can be realized.

Further, in addition to the above feature, the base body is arranged parallel to a border line between the ground area and the non-ground area, and includes a first surface containing a side parallel to the border line; a second surface opposing the first surface; and a third surface containing a side parallel to the border line and connecting the first surface and the second surface. The first surface and the third surface are connected at a first side. The second surface and the third surface are connected at a second side. The loop-shaped element includes a substantially C-shaped first conductor pattern formed along an edge line of the first surface and having a first spacing at substantially a center of the first side; and a substantially C-shaped second conductor pattern formed along an edge line of the second surface and having a second spacing substantially at a center of the second side. Ends of the first conductor pattern and ends of the second conductor pattern are connected by a first connecting conductor and a second connecting conductor that are formed on the third surface, and a gap is provided between the first connecting conductor and the second connecting conductor. By doing so, the loop-shaped element is formed along edge lines of the base body formed from a dielectric material or a magnetic material having a substantially rectangular cuboid shape. Therefore, a folded structure an efficient element that effectively utilizes the volume of the base body can be realized.

Further, in addition to the above feature, the first conductor pattern is formed only on the first surface, and the second conductor pattern is formed only on the second surface. By doing so, the loop-shaped element can be formed on only three of the six faces of the base body formed from a dielectric material or a magnetic material having a substantially rectangular cuboid shape. Therefore, simplification of production can be realized.

Further, in addition to the above feature, a capacity adjustment section is provided in an opposing area of the loop-shaped element, the opposing area being formed from the gap, the first spacing, and the second spacing. By doing so, capacitive coupling occurring in the opposing area can be increased and finely adjusted, resonance frequency adjustable range can be broadened, and fine adjustment of the resonance frequency can be easily performed.

In the present invention, at least a portion of the first transmission wire and/or the second transmission wire is formed on the surface of the base body. By doing so, a transmission wire and the loop-shaped element formed on the surface of the base body can be integrally formed, and production becomes easy.

The present invention can realize an antenna device in which two power feeders are provided to a single loop-shaped element and operate with the same frequency, and mutual isolation is secured between the power feeders.

BRIEF DESCRIPTION OF THE DRAWINGS

FIG. 1-2 illustrates a perspective view of an antenna device according to a second embodiment.

FIG. 2-1 illustrates an external view of an antenna device according to an example A1.

FIG. 2-2 illustrates details of the antenna device according to the example A1.

FIG. 2-3 illustrates electrical characteristics of the antenna device according to the example A1.

FIG. 3 illustrates electrical characteristics of an antenna device according to an example A2.

FIG. 4-1 illustrates an external view of an antenna device according to an example A3.

FIG. 4-2 illustrates details of the antenna device according to the example A3.

FIG. 4-3 illustrates details of the antenna device according to the example A3.

FIG. 6-1 illustrates an external view of an antenna device according to an example A4.

FIG. 6-2 illustrates details of the antenna device according to the example A4.

FIG. 8-1 illustrates an external view of an antenna device according to an example A5.

FIG. 8-2 illustrates details of the antenna device according to the example A5.

FIG. 10-1 illustrates electrical characteristics of the antenna device according to the present embodiment and of an antenna according to a conventional example.

FIG. 10-2 illustrates electrical characteristics of the antenna device according to the present embodiment and of the antenna according to the conventional example.

FIG. 11-1 illustrates an outline shape of a minimum configuration of the antenna according to the conventional example.

FIG. 11-2 illustrates an outline shape of a minimum configuration when the antenna device according to the present example is modeled after the conventional example.

FIG. 12-1 illustrates a perspective view of an arrangement example of a loop-shaped element according to the conventional example.

FIG. 12-2 illustrates an outline shape of an angle displacement examination model of a power feeder according to the conventional example.

FIG. 12-3 illustrates an outline shape of the angle displacement examination model of the power feeder according to the conventional example.

FIG. 12-4 illustrates an outline shape of the angle displacement examination model of the power feeder according to the conventional example.

FIG. 13-1 illustrates a perspective view of an arrangement example of a loop-shaped element according to the present example.

FIG. 13-2 illustrates an outline shape of an angle displacement examination model of a power feeder according to the present example.

FIG. 13-3 illustrates an outline shape of the angle displacement examination model of the power feeder according to the present example.

FIG. 13-4 illustrates an outline shape of the angle displacement examination model of the power feeder according to the present example.

FIG. 14-1 graphically compares electrical characteristics (isolation) when an angle of the power feeder according the conventional example is displaced.

FIG. 14-2 graphically compares electrical characteristics (isolation) when an angle of the power feeder according the present example is displaced.

FIG. 14-3 graphically compares electrical characteristics (radiation efficiency) when the angles of the power feeders according the conventional example and according to the present example are displaced.

DETAILED DESCRIPTION OF EMBODIMENTS

Modes (embodiments) for carrying out the present invention are explained in detail with reference to the drawings. The present invention is not limited by the content described in the following embodiments. Configuration elements described in the following include those easily envisioned by a person skilled in the art and those substantially identical. Further, the configuration elements described in the following can appropriately be combined.

First Embodiment

Figure 1:
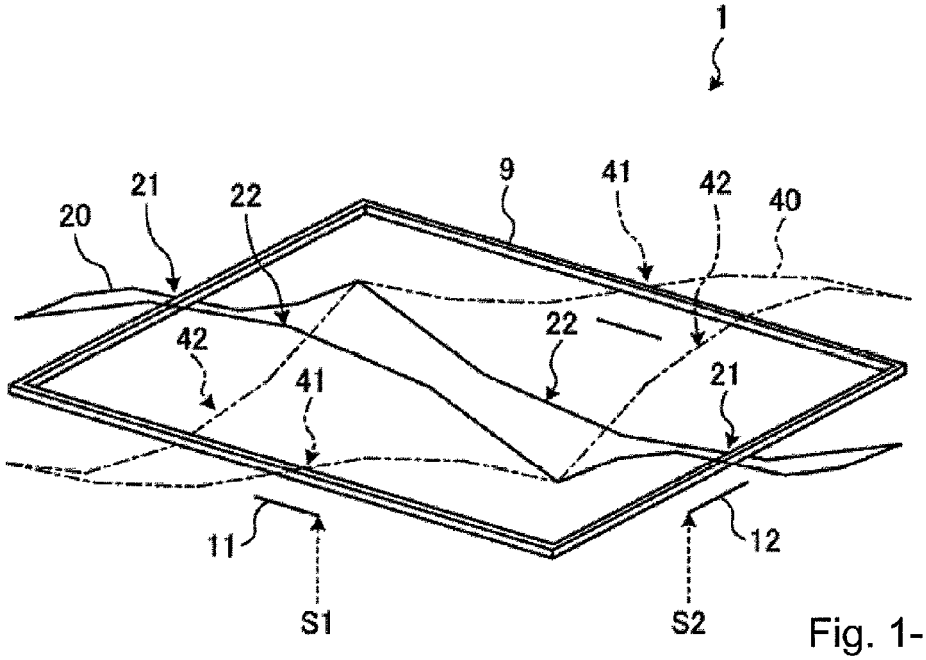
FIG. 1-1 illustrates a perspective view of an antenna device according to a first embodiment.

FIG. 1-1 illustrates a perspective view of an antenna device according to a first embodiment. An antenna device 1 has, for example, an element (antenna element) built-in in a wireless communication portable terminal such as a portable telephone or mounted on a surface of a casing of the wireless communication portable terminal. The antenna device 1 has a go-around loop-shaped element 9 as an antenna element. Further, the antenna device 1 has a first power feeder 11 and a second power feeder 12 for power-feeding the loop-shaped element 9. In the present embodiment, the loop-shaped element 9 has a rectangular shape in a plan view. However, the shape of the loop-shaped element 9 is not limited to this. For example, the loop-shaped element 9 may also have, in a plan view, a circular shape, an elliptical shape, a polygonal shape, and the like. Further, when the loop-shaped element 9 has a polygonal shape in a plan view, corners may have a curvature.

The antenna device 1 radiates a radio wave of at least a wavelength λ. The loop-shaped element 9 has an electrical length that is m multiple of the wavelength λ (where m is a natural number). When the electrical length of the loop-shaped element 9 is L, the wavelength λ becomes L/m. The first power feeder 11 is provided at a place of the loop-shaped element 9 and performs current coupling or voltage coupling. The first power feeder 11 excites the loop-shaped element 9 by using a first electrical signal S1 for radiating a radio wave of the wavelength λ. In this case, when m=1, standing waves 20 and 40 are generated in the loop-shaped element 9. The standing waves have a wavelength of λ. In the case where current coupling is performed from the first power feeder 11, the standing wave 20 is a distribution of current variation in the loop-shaped element 9 and the standing wave 40 is a distribution of voltage variation in the loop-shaped element 9. In the following, as needed, the standing waves 20 and 40 may be respectively referred to as current standing wave 20 and voltage standing wave 40. In order to indicate polarity, only one side of the standing wave 20 and one side of the standing wave 40, relative to the loop-shaped element 9, are illustrated.

The current standing wave 20 has nodes 21 at locations λ/4 away from the first power feeder 11 of the loop-shaped element 9. The current standing wave 20 has anti-nodes 22 at the first power feeder 11 of the loop-shaped element 9 and a location λ/2 away from the first power feeder 11 (that is, when m=1, an opposite side of the first power feeder 11). The voltage standing wave 40 has anti-nodes 42 at locations λ/4 away from the first power feeder 11 of the loop-shaped element 9. The voltage standing wave 40 has nodes 41 at the first power feeder 11 of the loop-shaped element 9 and a location λ/2 away from the first power feeder 11 (that is, when m=1, the opposite side of the first power feeder 11).

The second power feeder 12 excites the loop-shaped element 9 via a coupling method that is the same type as the first power feeder 11 by using a second electrical signal S2 for radiating a radio wave of a wavelength λ/(2×p−1) (where p is a natural number) at a portion that becomes a node of the standing wave 20 that is formed with the first power feeder 11 as an anti-node and that is based on the first electrical signal S1. That is, when the standing wave based on the first electrical signal S1 is the current standing wave 20, the second power feeder 12 is provided at a location λ/4 away from the first power feeder 11. The second power feeder 12 excites the loop-shaped element 9 via a coupling method that is the same type as the first power feeder 11 by using the second electrical signal S2. That is, the coupling method of the second power feeder 12 is current coupling when the coupling method of the first power feeder 11 is current coupling and is voltage coupling when the coupling method of the first power feeder 11 is voltage coupling.

In this way, the second power feeder 12 that performs current coupling with the loop-shaped element 9 is arranged at the portion that becomes the node 21 of the current standing wave 20 generated by the excitation from the first power feeder 11. For this reason, the second power feeder 12 does not couple with the current standing wave 20 generated by the first power feeder 11. Further, the first power feeder 11 and the second power feeder 12, which perform current coupling or voltage coupling with the loop-shaped element 9, excite the loop-shaped element 9 so that standing waves are generated. Each of the standing waves resonates on the loop-shaped element 9. Therefore, radiation efficiency is secured. By these operation effects, when the one loop-shaped element 9 is used to realize communication functions of different communication systems and different signal systems, the antenna device 1 can secure radiation efficiency, while securing isolation among a plurality of power feeders (between the first power feeder 11 and the second power feeder 12 in the present embodiment) with respect to the one loop-shaped element 9.

The electrical length L of the loop-shaped element 9 is preferably within a range of m×λ±0.1×λ, and more preferably within a range of m×λ±0.05×λ. When the electrical length L is within this range, the isolation among the plurality of power feeders and the radiation efficiency can surely be secured. Further, when the distance between the first power feeder 11 and the second power feeder 12 is X, X need only be within a range of (2×n−1)×λ/4±α (where n is a natural number). "α" preferably is 0.1×λ, and more preferably 0.05×λ. When the distance X is within this range, the isolation among the plurality of power feeders and the radiation efficiency can surely be secured. In the present embodiment, the number of the power feeders for exciting the loop-shaped element 9 is not limited to two. However, when the number of the power feeders is two, the isolation between the two power feeders can be surely secured.

When the first power feeder 11 and the second power feeder 12 perform voltage coupling with the loop-shaped element 9 via capacitance therebetween, it is preferable that the first power feeder 11 and/or the second power feeder 12 power-feed(s) a central part of a capacitive coupling electrode provided opposing the loop-shaped element 9. In this way, a signal of the other power feeder excited by a standing wave can be canceled, the standing wave being excited by an electrode of the other power feeder and being a current anti-node.

The second power feeder 12 excites the loop-shaped element 9 by using a second electrical signal S2 for radiating a radio wave of a wavelength λ/(2×p−1) (where p is a natural number). That is, the frequency of the second electrical signal S2 is a multiple of (2×p−1) of the radio wave of a wavelength λ (or the radio wave generated by exciting the loop-shaped element 9 by the first power feeder 11). When p=1, the antenna device 1 radiates a plurality (two in the present embodiment) of radio waves of the same frequency (band). When p≥2, the antenna device 1 radiates a plurality (two in the present embodiment) of radio waves of different frequencies (bands). In any of these cases, the antenna device 1 can secure isolation among the plurality of power feeders (between two power feeders in the present embodiment) and at the same time secure radiation efficiency. As described above, even when dealing with a plurality of the same or different frequency bands by using the one loop-shaped element 9, the antenna device 1 can avoid mutual interference.

Second Embodiment

Figures 1, 2:
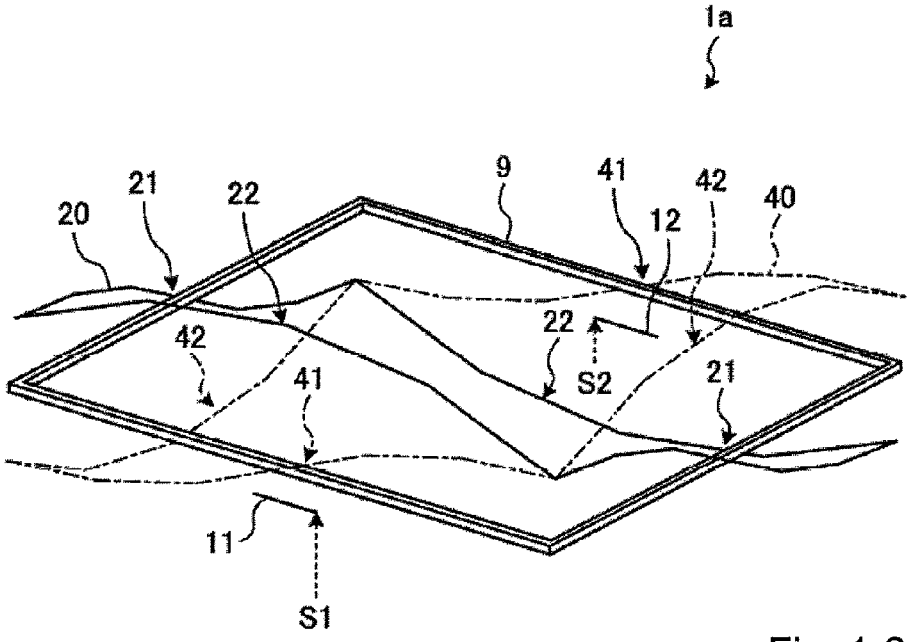

FIG. 1-2 illustrates a perspective view of an antenna device according to a second embodiment. The second embodiment is similar to the first embodiment, but is different in that, the second power feeder excites the loop-shaped element via a coupling method that is a different type from the first power feeder by using a second electrical signal for radiating a radio wave of a wavelength λ/q (where q is a natural number) at a portion that becomes an anti-node of the standing wave that is formed with the first power feeder as an anti-node and that is based on the first electrical signal. Other configurations of the second embodiment are the same as the first embodiment.

An antenna device 1*a* radiates a radio wave of at least a wavelength λ. The loop-shaped element 9 has an electrical length of m multiple of the wavelength λ (where m is a natural number). When the electrical length of the loop-shaped element 9 is L, the wavelength λ becomes L/m. The first power feeder 11 is provided at a place of the loop-shaped element 9 and performs current coupling or voltage coupling. The first power feeder 11 excites the loop-shaped element 9 by using a first electrical signal 51 for radiating a radio wave of the wavelength λ. In this case, when m=1, standing waves 20 and 40 are generated in the loop-shaped element 9. The standing waves have a wavelength of λ. In the case where current coupling is performed from the first power feeder 11, the standing wave 20 is a distribution of current variation in the loop-shaped element 9 and the standing wave 40 is a distribution of voltage variation in the loop-shaped element 9. In order to indicate polarity, only one side of the standing wave 20 and one side of the standing wave 40, relative to the loop-shaped element 9, are illustrated.

The current standing wave 20 has nodes 21 at locations λ/4 away from the first power feeder 11 of the loop-shaped element 9. The current standing wave 20 has anti-nodes 22 at the first power feeder 11 of the loop-shaped element 9 and a location λ/2 away from the first power feeder 11 (that is, when m=1, an opposite side of the first power feeder 11). The voltage standing wave 40 has anti-nodes 42 at locations λ/4 away from the first power feeder 11 of the loop-shaped element 9. The voltage standing wave 40 has nodes 41 at the first power feeder 11 of the loop-shaped element 9 and a location λ/2 away from the first power feeder 11 (that is, when m=1, the opposite side of the first power feeder 11).

The second power feeder 12 excites the loop-shaped element 9 via a coupling method that is a different type from the first power feeder 11 by using a second electrical signal S2 for radiating a radio wave of a wavelength λ/q (where q is a natural number) at a portion that becomes an anti-node of the standing wave 20 that is formed with the first power feeder 11 as an anti-node and that is based on the first electrical signal S1. That is, when the standing wave based on the first electrical signal S1 is the current standing wave 20, the second power feeder 12 is provided at the first power feeder 11, or at a location λ/2 away from the first power feeder 11 (that is, when m=1, at the opposite side of the first power feeder 11). The second power feeder 12 excites the loop-shaped element 9 via a coupling method that is a different type from the first power feeder 11 by using the second electrical signal S2. That is, the coupling method of the second power feeder 12 is voltage coupling when the coupling method of the first power feeder 11 is current coupling and is current coupling when the coupling method of the first power feeder 11 is voltage coupling.

In this way, the second power feeder 12 that performs voltage coupling with the loop-shaped element 9 is arranged at the portion that becomes the anti-node 22 of the current standing wave 20, that is, at the node 41 of the voltage standing wave 40, the current standing wave 20 being generated by the excitation from the first power feeder 11. For this reason, the second power feeder 12 does not couple with the current standing wave 20 generated by the first power feeder 11. That is, also when the second power feeder 12 that performs voltage coupling with the loop-shaped element 9 is arranged at the portion that becomes the node 41 of the voltage standing wave 40 generated by the excitation from the first power feeder 11, the second power feeder 12 does not couple with the voltage standing wave 40 generated by the first power feeder 11. Further, the first power feeder 11 and the second power feeder 12, which perform current coupling or voltage coupling with the loop-shaped element 9, excite the loop-shaped element 9 so that the standing waves are generated. Each for the standing waves resonates on the loop-shaped element 9. Therefore, radiation efficiency is secured. By these operation effects, when the one loop-shaped element 9 is used to realize communication functions of different communication systems and different signal systems, the antenna device 1*a* can secure radiation efficiency while securing isolation among a plurality of power feeders (between the first power feeder 11 and the second power feeder 12 in the present embodiment) with respect to the one loop-shaped element 9.

The electrical length L of the loop-shaped element 9 is preferably within a range of m×λ±0.1×λ, and more preferably within a range of m×λ±0.05×λ. When the electrical length L is within this range, the isolation among the plurality of power feeders and the radiation efficiency can surely be secured. Further, when the distance between the first power feeder 11 and the second power feeder 12 is X, X needs only be within a range of (n−1)×λ/2±α (where n is a natural number). "α" preferably is 0.1×λ, and more preferably 0.05×λ. When the distance X is within this range, the isolation among the plurality of power feeders and the radiation efficiency can surely be secured. In the present embodiment, the number of the power feeders for exciting the loop-shaped element 9 is not limited to two. However, when the number of the power feeders is two, isolation between the two power feeders can be surely secured.

When the first power feeder performing current coupling or voltage coupling and the second power feeder performing voltage coupling or current coupling are arranged at the same location, it is desirable that the two power feeders be arranged on opposite sides of each other sandwiching the loop-shaped element 9. By doing so, the two power feeders are more separated and isolation becomes easily secured.

When the first power feeder 11 or the second power feeder 12 performs voltage coupling with the loop-shaped element 9 via capacitance therebetween, it is preferable that the first power feeder 11 or the second power feeder 12 power-feeds a central part of a capacitive coupling electrode provided opposing the loop-shaped element 9. In this way, a signal of the other power feeder excited by a standing wave can be canceled, the standing wave being excited by an electrode of the other power feeder and being a current anti-node.

The second power feeder 12 excites the loop-shaped element 9 by using the second electrical signal S2 for radiating a radio wave of a wavelength λ/q (where q is a natural number). That is, the frequency of the second electrical signal S2 is q multiple of the radio wave of a wavelength λ, that is, the radio wave generated by exciting the loop-shaped element 9 by the first power feeder 11. When q=1, the antenna device 1*a* radiates a plurality (two in the present embodiment) of radio waves of the same frequency (band). When q≥2, the antenna device 1*a* radiates a plurality (two in the present embodiment) of radio waves of different frequencies (bands). In any of these cases, the antenna device 1*a* can secure isolation among the plurality of power feeders (between two power feeders in the present embodiment) and at the same time secure radiation efficiency. As described above, even when dealing with a plurality of same or different frequency bands by using the one loop-shaped element 9, the antenna device 1*a* can avoid mutual interference.

In the antenna device 1*a*, the first power feeder 11 and the second power feeder 12 power-feed the loop-shaped element 9 by using different types of power feeding methods.

Example A1

Examples A of the above-described antenna devices 1 and 1*a* are explained. In an example A1, the antenna device 1 was evaluated by computer simulation. Specifically, a simulation model of an antenna device 100 that can be dealt with on a computer was prepared, and the simulation model was analyzed using a computer to evaluate electrical characteristics. In the simulation model, for simplicity, the loop-shaped element 9 had a shape of a square in plan view. However, in an actual portable wireless communication terminal and the like, the loop-shaped element 9 may have a shape of substantially a rectangle, further a square and rectangle, or the like with rounded corner portions. Further, the loop-shaped element 9 is provided at very close vicinity of a casing of a portable wireless communication terminal or tightly attached to the casing. Therefore, depending on the structure and permittivity of the casing, an electrical length is usually longer than an actual physical length. In the following Examples A, the electrical length, not the physical length, was used in evaluation. The entire perimeter of the loop-shaped element 9 was λ or m×λ (where λ was the wavelength of the at least one radio wave radiated by the antenna device 100, and m was a natural number). The power feeders are located at locations of nodes of a current standing wave or at locations of nodes of a voltage standing wave where the power feeders do not couple with each other.

FIG. 2-1 illustrates an external view of an antenna device according to the example A1. FIG. 2-2 illustrates details of the antenna device according to the example A1. The example A1 corresponds to the above-described first embodiment. In the example A1, a simulation model of the antenna device 100 of the specifications described below was prepared, and the prepared simulation model was analyzed by using a computer. In order to simplify the evaluation, the antenna device 100 had a loop-shaped element 9 having a width of 0.5 mm prepared surrounding an evaluation substrate (80 mm×80 mm) 110 modeled after a mounted substrate of a portable communication terminal that had a shape of a square in plan view. The loop-shaped element 9 had an entire perimeter of about 320 mm in physical length. The loop-shaped element 9 was provided at a location 5 mm above the surface (substrate surface) of the evaluation substrate 110.

At a central part of one side of the evaluation substrate 110, a portion of 10 mm×3 mm of a conductor of the evaluation substrate 110 was removed, and an inductive coupling electrode 15 for performing current coupling with the loop-shaped element 9 was provided at this portion as the first power feeder 11. Further, the second power feeder 12 was provided as a power feeder for performing current coupling with the loop-shaped element 9 at a location ¼ entire perimeter of the loop-shaped element 9 (about 80 mm in physical length) away from the first power feeder 11. When measured from outside of the antenna device 100, the first power feeder 11 and the second power feeder 12 did not match to 50Ω. For this reason, as FIG. 2-2 illustrates, a capacitor 61 of 1.7 pF was used to connect the inductive coupling electrode 15 of the first and second power feeders 11, 12 to a GND 13, and further, a capacitor 62 of 0.9 pF was provided between the inductive coupling electrode 15 of the first and second power feeders 11, 12 and a signal source, and via the capacitor, the two are coupled and matched.

Evaluation conditions of the example A1 are described below. A sweep signal of a wavelength from 0.6 to 0.2 m (frequency from 0.5 to 1.5 GHz) was applied from the first power feeder and the second power feeder to the loop-shaped element 9, reflection and transmission responses from each of the power feeders were measured. The physical length of the loop-shaped element 9 was about 320 mm. The electrical length was also envisioned to be close to this. When "physical length=electrical length," a signal whose the electrical length L of the loop-shaped element 9 was one wavelength λ was of about 0.94 GHz.

Figures 1, 2:
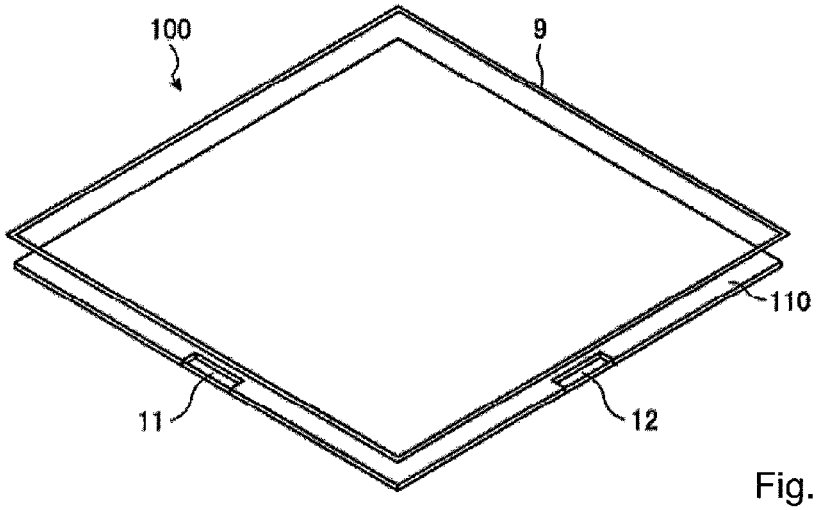
Figure 2:
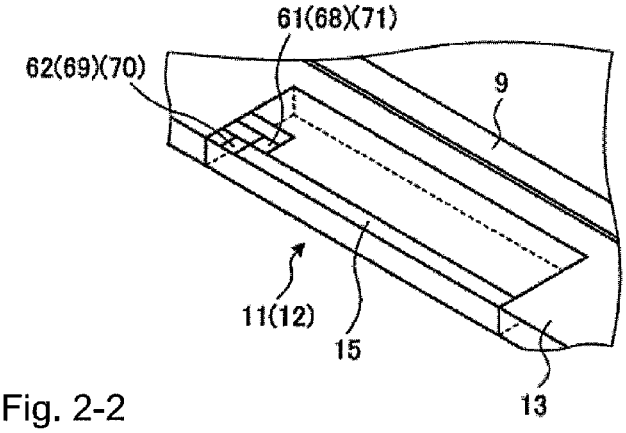
Figures 2, 3:
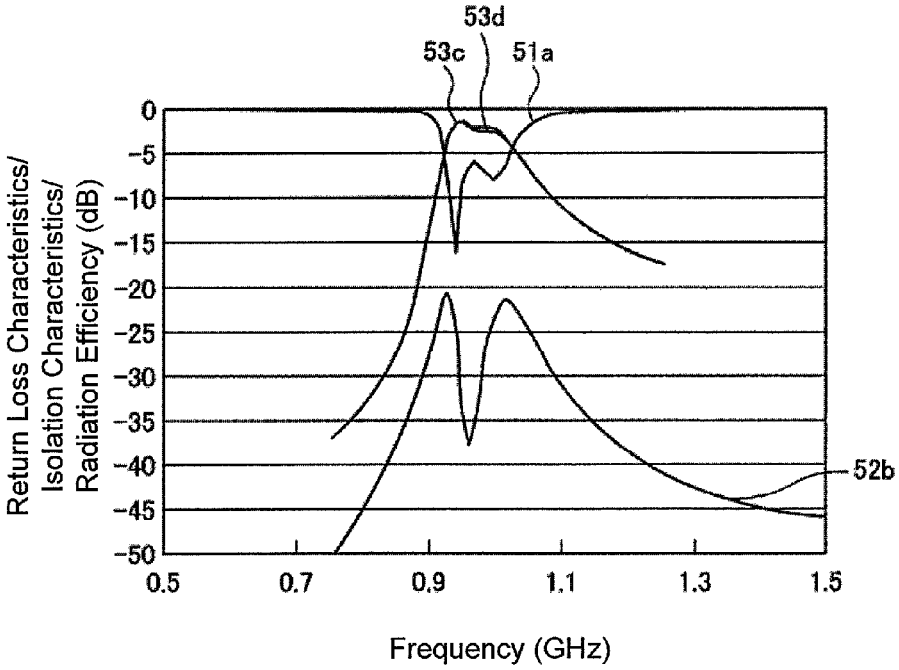
Figure 3:
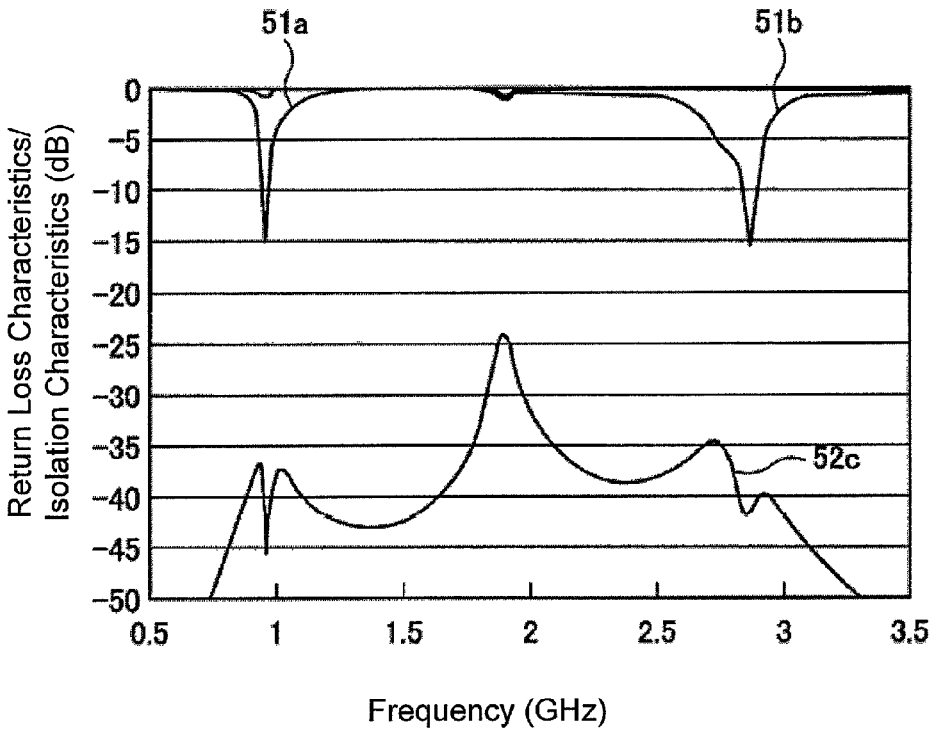

FIG. 2-3 illustrates electrical characteristics of the antenna device according to the example A1. FIG. 2-3 illustrates reflection (return loss) characteristics (solid line 51*a*) obtained by the above-described method and viewed from the first power feeder 11, transmission (isolation) characteristics (solid line 52*b*), and further radiation efficiency (solid line 53*c*) of the radio wave power-fed from the power feeder 11 and, for comparison, radiation efficiency (solid line 53*d*) of the case where one power feeder is provided. Frequencies at which an antenna operates include a bandwidth of about 10% with a peak located at the above-mentioned 0.94 GHz, from which it is clear that, in the case of the present example, "electrical length z physical length." It is clear from the transmission (isolation) characteristics (solid line 52*b*) that an isolation of about −20 dB were secured between the two power feeders, that is, between the first power feeder 11 and the second power feeder 12. Further, it is clear that there was also no significant change in the radiation efficiency (solid line 53*c*) from the first power feeder 11 as compared to the case where an antenna with a single power feeder (solid line 53*d*) was provided. Isolation characteristics curves in the example A1 and each of the later-described examples A are different from a simulation model used for comparison with a later-described conventional example. The shape of the evaluation substrate 110 was only about the same as the outer periphery of the loop-shaped element 9. For this reason, out-of-band characteristics of the example A1 and each of the later-described examples A are different from the simulation model used for comparison with the later-described conventional example.

Example A2

FIG. 2-1 and FIG. 2-2 also illustrate an antenna device according to an example A2. The example A2 is an example of radiating radio waves of different frequencies in the above-described first embodiment. The antenna device 100 according to the example A2 (see FIG. 2-1) had the same configuration as in the example A1. However, the second power feeder 12 illustrated in FIG. 2-1 was matched in a higher-order mode. The higher-order mode is a state in which a standing wave is generated over the entire perimeter of the loop-shaped element 9, a wavelength of the standing wave being, for example, ⅓ of the wavelength of a radio wave excited and radiated by an electrical signal power-fed from the first power feeder 11. For this reason, the constants of the matching elements with respect to the antenna device 100 according to the example A1 were changed. Specifically, as FIG. 2-2 illustrates, at the first power feeder 11, a capacitor 68 of 1.5 pF was used to connect the inductive coupling electrode 15 of the first power feeder to the GND 13, and further, a capacitor 69 of 1.2 pF was provided between the inductive coupling electrode 15 and the signal source to perform coupling and matching. At the second power feeder 12, as FIG. 2-2 illustrates, a capacitor 71 of 0.44 pF between the inductive coupling electrode 15 of the second power feeder 12 and the GND and further an inductor 70 of 12 nH for the signal source were provided to perform coupling and matching.

Evaluation conditions of the example A2 are described below. A sweep signal of a wavelength from 0.6 to 0.0857 m (frequency from 0.5 to 3.5 GHz) was applied from the first power feeder and the second power feeder to the loop-shaped element 9, reflection and transmission responses from each of the power feeders were measured. The physical length of the loop-shaped element 9 is about 320 mm. The electrical length was also envisioned to be close to this. A signal whose the electrical length L of the loop-shaped element 9 was one wavelength λ was of about 0.94 GHz, and a signal whose the electrical length L of the loop-shaped element 9 was three wavelengths 3λ was of about 2.81 GHz.

FIG. 3 illustrates electrical characteristics of the antenna device according to the example A2. In FIG. 3, the reflection (return loss) characteristics (solid line 51*a*) obtained as described above and viewed from the first power feeder 11, reflection (return loss) characteristics (solid line 51*b*) viewed from the second power feeder 12, and transmission (isolation) characteristics (solid line 52*c*) are illustrated. The first power feeder 11 corresponded to a frequency that was slightly less than 1 GHz and the second power feeder 12 corresponded to a frequency that was slightly less than 3 GHz. As the solid line 52*c* of FIG. 3 illustrates, it is clear that an isolation of at least about −25 dB or more was secured between the first power feeder 11 and the second power feeder 12.

Example A3

Figures 1, 4:
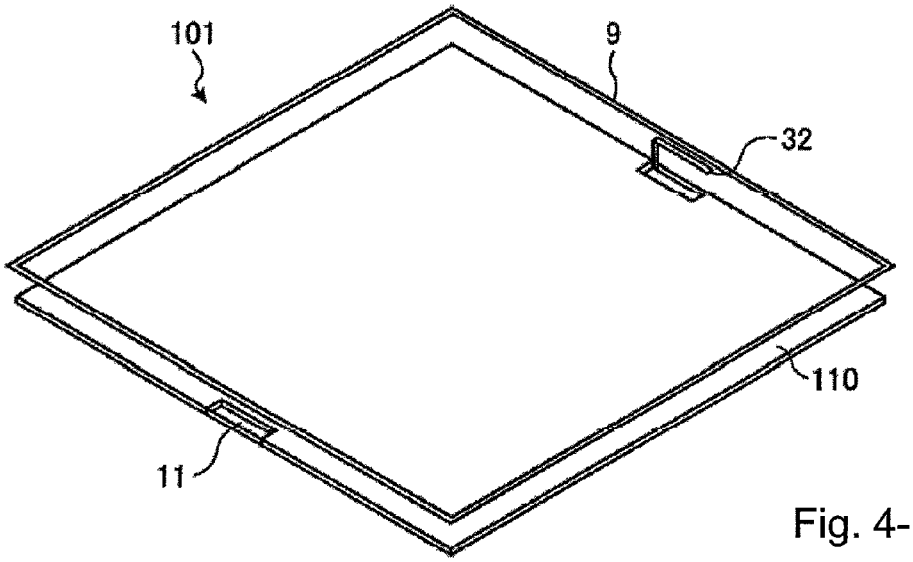
Figures 2, 4:
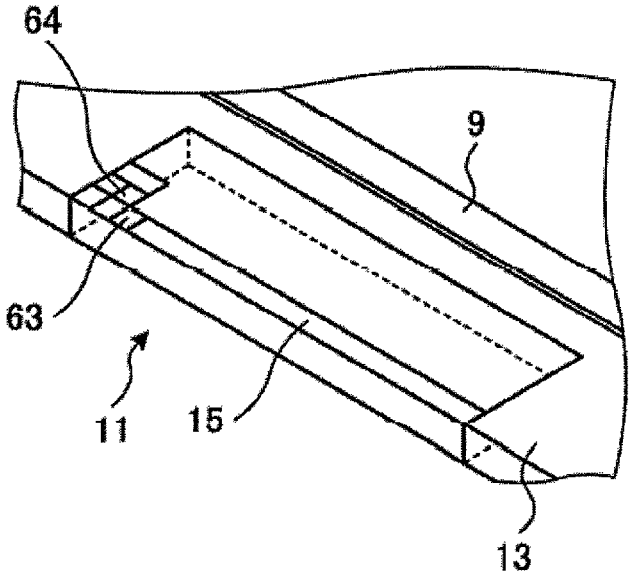
Figures 3, 4:
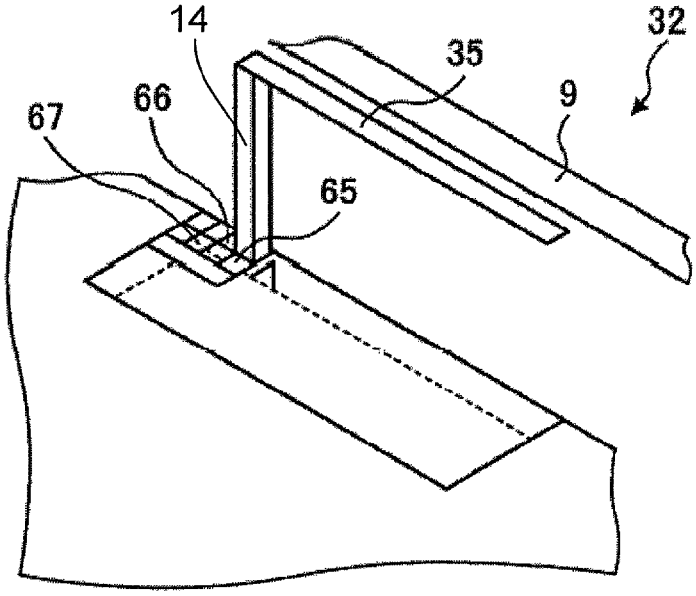

FIG. 4-1 illustrates an external view of an antenna device according to an example A3. FIG. 4-2 and FIG. 4-3 illustrate details of the antenna device according to the example A3. The example A3 corresponds to the above-described second embodiment. An antenna device 101 according to the example A3 had, for simplicity, a loop-shaped element 9 (having an entire perimeter of about 320 mm in physical length) having a width of 0.5 mm prepared surrounding an evaluation substrate (80 mm×80 mm) 110 modeled after a mounted substrate of a square-shaped portable telephone. The loop-shaped element 9 was provided at a location 5 mm above the substrate surface. As FIG. 4-2 illustrates, at a central part of one side, a portion of 10 mm×3 mm of a conductor of the evaluation substrate 110 was removed, and an inductive coupling electrode 15 for performing current coupling was provided at this portion as the first power feeder 11.

As FIG. 4-3 illustrate, likewise, a second power feeder 32 was provided at a location ½ wavelength of the entire perimeter of the loop-shaped element 9 away from the first power feeder 11. The second power feeder 32 was a power feeder that performed voltage coupling. When measured from the outside of the antenna device 100, the first power feeder 11 and the second power feeder 12 did not match to 50Ω. For this reason, a capacitor 63 of 3.5 pF was used to connect the inductive coupling electrode 15 of the first power feeder 11 to a signal source, and further, a capacitor 64 of 9 pF was provided between the signal source and a GND. Further, as FIG. 4-3 illustrate, an inductor 65 of 8 nH was connected from a capacitive coupling electrode 35 of the second power feeder 32 to the GND via a transmission wire 14, a capacitor 66 of 5 pF was connected to a signal source, and further a capacitor 67 of 8.4 pF was connected between the signal source and the GND to perform matching.

Evaluation conditions of the example A3 are described below. A sweep signal of a wavelength from 0.6 to 0.2 m (frequency from 0.5 to 1.5 GHz) was applied from the first power feeder and the second power feeder to the loop-shaped element 9, and reflection and transmission responses from each of the power feeders were measured. The physical length of the loop-shaped element 9 was about 320 mm. The electrical length is also envisioned to be close to this. A signal whose the electrical length L of the loop-shaped element 9 is one wavelength λ was of about 0.94 GHz.

Figure 5:
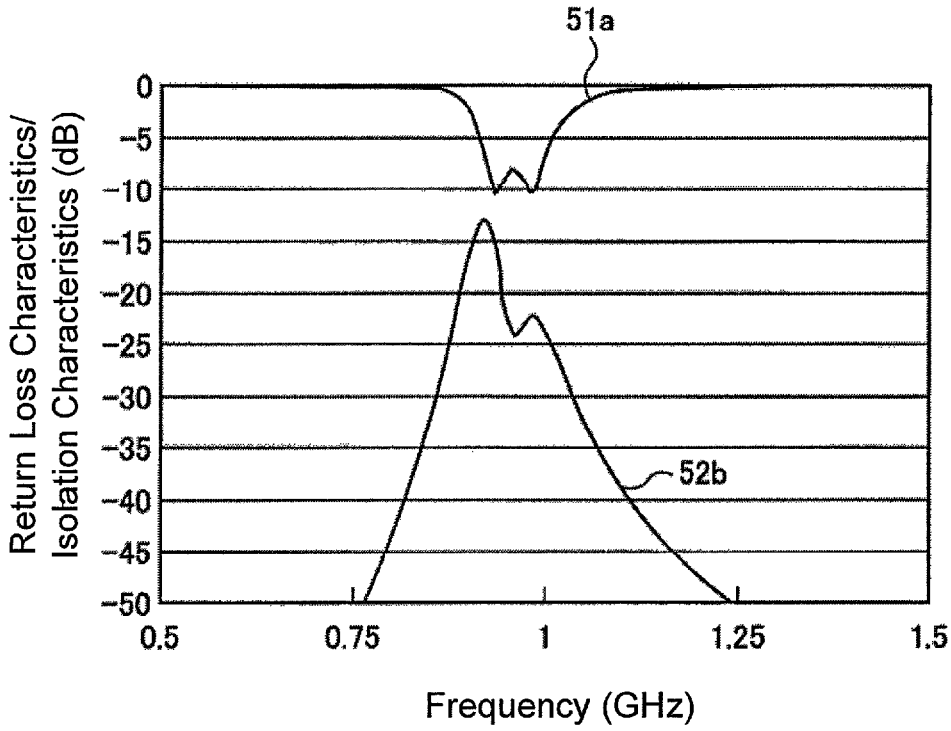
FIG. 5 illustrates electrical characteristics of the antenna device according to the example A3.

FIG. 5 illustrates electrical characteristics of the antenna device according to the example A3 In FIG. 5, the reflection (return loss) characteristics (solid line 51*a*) obtained as described above and viewed from the first power feeder 11 and transmission (isolation) characteristics (solid line 52*b*) are illustrated. As the solid line 52*b* of FIG. 5 illustrates, it is clear that an isolation of at least about −15 dB or slightly less was secured between the first power feeder 11 and the second power feeder 32.

Example A4

Figures 1, 6:
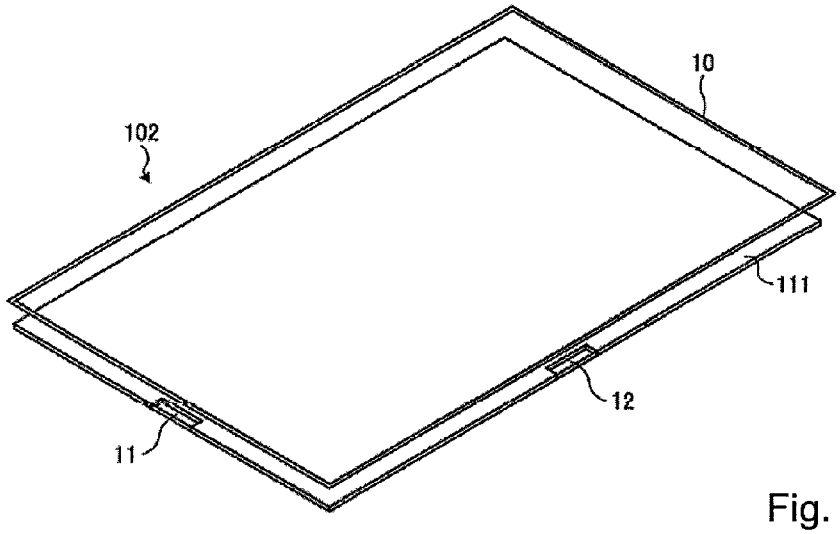
Figures 2, 6:
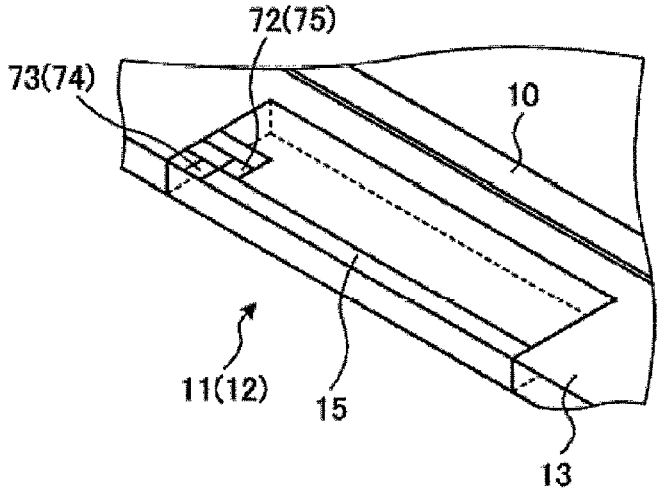

FIG. 6-1 illustrates an external view of an antenna device according to an example A4. FIG. 6-2 illustrates details of the antenna device according to the example A4. In all of the examples A1-A3, for simplicity, the simulation models had a shape of a square. In the example A4, a case closer to an actual portable terminal such as an antenna device 102 illustrated in FIG. 6-1 is envisioned, and a rectangular simulation model was used to perform confirmation. A loop-shaped element 10 (having an entire perimeter of about 320 mm in physical length) having a width of 0.5 mm was prepared surrounding a rectangular evaluation substrate 111 (100 mm×60 mm) in a plan view modeled after a substrate of portable terminal. The loop-shaped element 10 was provided at a location 5 mm above the substrate surface. The first power feeder 11 performing current coupling was provided at a central part of a short side of the rectangle, and likewise the second power feeder 12 performing current coupling was provided at a central part of a long side of the rectangle. Similar to the above-described example A2, in order to correspond to two frequencies, as FIG. 6-2 illustrates, a capacitor 72 of 1.2 pF was used to connect between the inductive coupling electrode 15 of the first power feeder 11 and the GND 13, and further, a capacitor 73 of 1.5 pF was provided between the inductive coupling electrode 15 and the signal source to perform coupling and matching. As FIG. 6-2 illustrates, a capacitor 75 of 0.45 pF was used to connect between the inductive coupling electrode 15 of the second power feeder 12 and the GND 13, and further, an inductor 74 of 11 nH was provided between the inductive coupling electrode 15 and the signal source to perform matching.

Evaluation conditions of the example A4 are described below. A sweep signal of a wavelength from 0.6 to 0.0857 m (frequency from 0.5 to 3.5 GHz) was applied from the first power feeder and the second power feeder to the loop-shaped element 9, and reflection and transmission responses from each of the power feeders were measured. The physical length of the loop-shaped element 9 is about 320 mm. The electrical length is also envisioned to be close to this. A signal whose the electrical length L of the loop-shaped element 9 was one wavelength λ was of about 0.94 GHz, and a signal whose the electrical length L of the loop-shaped element 9 was three wavelengths 3λ was of about 2.81 GHz.

Figure 7:
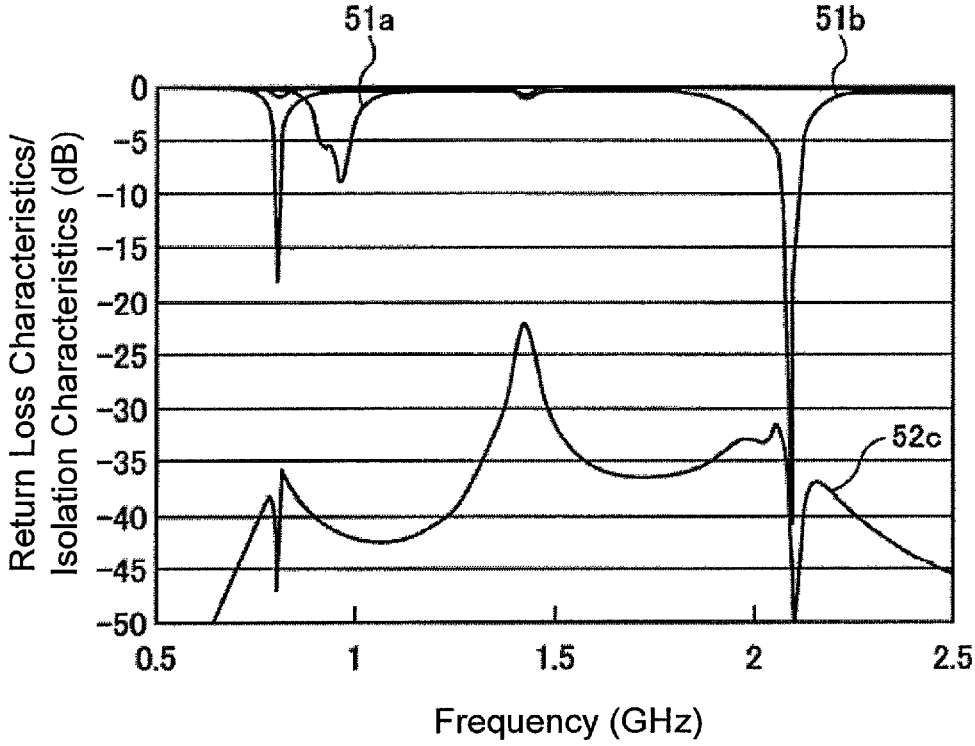
FIG. 7 illustrates electrical characteristics of the antenna device according to the example A4.

FIG. 7 illustrates electrical characteristics of the antenna device according to the example A4. In FIG. 7, the reflection (return loss) characteristics (solid line 51*a*) obtained as described above and viewed from the first power feeder 11, reflection (return loss) characteristics (solid line 51*b*) viewed from the second power feeder 12, and transmission (isolation) characteristics (solid line 52*c*) are illustrated. In the example A4, which is nearly equal to the example A2, the first power feeder 11 corresponded to a frequency that was slightly less than 1 GHz and the second power feeder 12 corresponded to a frequency that was slightly less than 3 GHz. As the solid line 52*c* of FIG. 7 illustrates, it is clear that an isolation of −20 dB or more was secured between the first power feeder 11 and the second power feeder 12.

Example A5

Figures 1, 8:
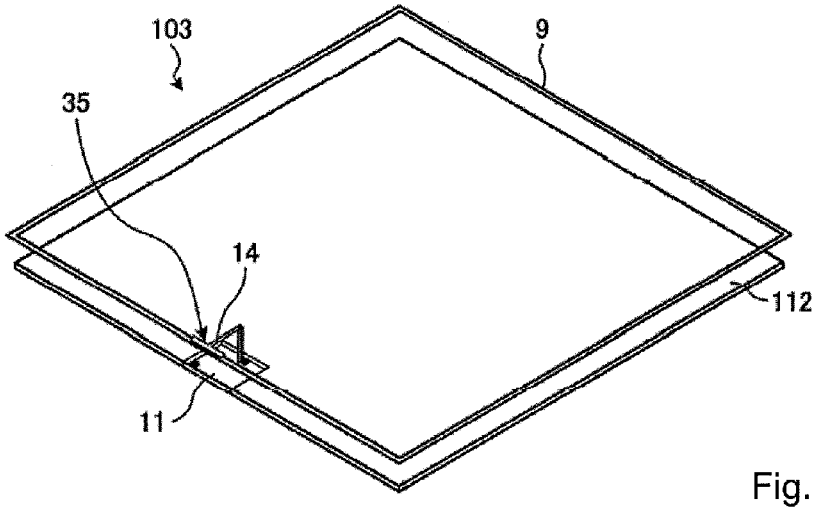
Figures 2, 8:
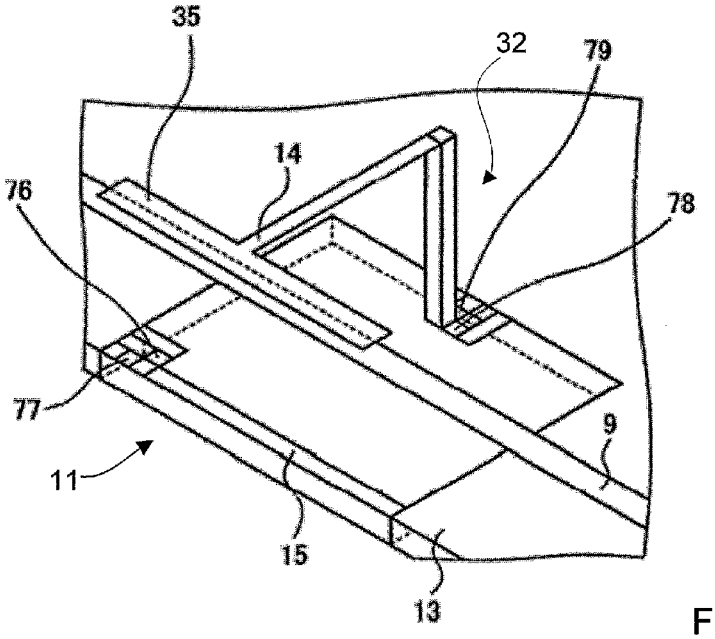

FIG. 8-1 illustrates an external view of an antenna device according to an example A5. FIG. 8-2 illustrates details of the antenna device according to the example A5. In the examples A1-A4, the first power feeder 11 and the second power feeder 12 were arranged at different locations. In the example A5, the first power feeder 11 and a second power feeder 32 were arranged at the same location. As FIG. 8-1 illustrates, in an antenna device 103, a loop-shaped element 9 (having an entire perimeter of about 320 mm) having a width of 0.5 mm was prepared surrounding an evaluation substrate 112 (80 mm×80 mm) modeled after a substrate of a portable terminal. The loop-shaped element 9 was provided at a location 5 mm above the substrate surface. As FIG. 8-2 illustrates, at a central part of one side, a portion of 10 mm×6 mm of a conductor of the evaluation substrate 112 was removed, and an inductive coupling electrode 15 for performing current coupling was provided at this place as the first power feeder 11. The first power feeder 11 performs current coupling with the loop-shaped element 9. Further, a capacitive coupling electrode 35 performing capacitive coupling was arranged at a side opposite to the first power feeder 11 with respect to the loop-shaped element 9, and a transmission wire 14 power feeding a signal was connected to the capacitive coupling electrode 35 to form the second power feeder 32. The second power feeder 32 performs voltage coupling with the loop-shaped element 9.

In the example A5, the transmission wire performing voltage coupling (capacitive coupling) had the following features (1) and (2).

(1) The capacitive coupling electrode 35 of the power feeder 32 performing voltage coupling (capacitive coupling) and the inductive coupling electrode 15 performing current coupling are arranged at opposite sides across the loop-shaped element 9.

(2) The transmission wire 14 performing voltage coupling (capacitive coupling) is power-fed at a substantially central part of the capacitive coupling electrode 35.

The reason for the feature (1) is to make electrical field generated by the second power feeder 32 performing voltage coupling hardly reach the first power feeder 11 performing current coupling. The reason for the feature (2) is to cancel out an electrical current in the capacitive coupling electrode 35, thereby preventing the electrical current from flowing into the transmission wire 14 of the second power feeder 32 performing voltage coupling, the electrical current being excited by a magnetic field generated by the first power feeder 11 performing current coupling. In this way, the antenna device 103 has the capacitive coupling electrode 35 in which the second power feeder 32 is arranged opposing the loop-shaped element 9 and performs capacitive coupling, the second power feeder 32 being one of the power feeders (or) performing coupling via a capacitance. The second power feeder 32 is power-fed from the central part of the capacitive coupling electrode 35.

As FIG. 8-2 illustrates, in order to achieve matching, a capacitor 76 of 3.2 pF was used to connect the inductive coupling electrode 15 of the first power feeder 11 to the GND, and further an inductor 77 of 14 nH was provided between the inductive coupling electrode 15 and a signal source to perform coupling and matching. Further, from the transmission wire 14 of the second power feeder 32, a capacitor 78 of 0.5 pF was connected to the GND and further an inductor 79 of 35 nH was connected to a signal source to perform matching.

Evaluation conditions of the example A5 are described below. A sweep signal of a wavelength from 0.6 to 0.2 m (frequency from 0.5 to 1.5 GHz) was applied from the first power feeder and the second power feeder to the loop-shaped element 9, reflection and transmission responses and radiation efficiency of each of the power feeders were measured. The physical length of the loop-shaped element 9 was about 320 mm. The electrical length was also envisioned to be close to this. A signal whose the electrical length L of the loop-shaped element 9 was one wavelength λ was of about 0.94 GHz.

Figure 9:
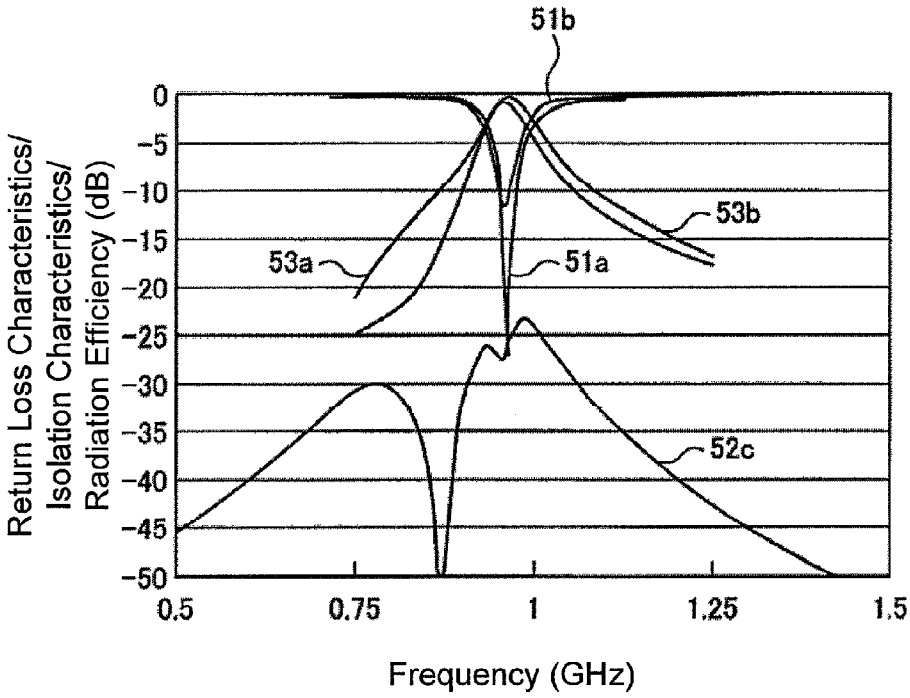
FIG. 9 illustrates electrical characteristics of the antenna device according to the example A5.

FIG. 9 illustrates electrical characteristics of the antenna device according to the example A5. In FIG. 9, the reflection (return loss) characteristics (solid line 51*a*) obtained as described above and viewed from the first power feeder 11, reflection (return loss) characteristics (solid line 51*b*) viewed from the second power feeder 32, transmission (isolation) characteristics (solid line 52*c*), and radiation efficiencies (solid line 53*a* and solid line 53*b*) of radio waves respectively power-fed by the first power feeder 11 and the second power feeder 32 are illustrated. As the solid line 52*c* of FIG. 9 illustrates, it is clear that an isolation of about −23 dB was secured between the first power feeder 11 and the second power feeder 32, and, with respect to the radiation efficiencies, values were equivalent to that in the example A1 of a same shape, indicating there was no degradation.

In the above, the antenna devices 100-103 are explained based on the examples A1-A5. In all of the cases, there are two power feeders (the first power feeder 11 and the second power feeder 12 or 32) provided with respect to a single loop-shaped element 9 or 10, and standing waves can be separately formed on the same loop-shaped element 9 or 10 that is power-fed from the two power feeders. The first power feeder 11 and the second power feeder 12 or 32 are mutually located at portions that become nodes of a current standing wave or a voltage standing wave. Therefore, a standing wave excited by one power feeder does not couple with the other power feeder. Among the examples A1-A5, any two or more examples A can be combined. Further, it is clear to a person skilled in the art that the configurations according to the examples A1-A5 can be established with same or different frequencies; that is, for example, when the example A4 is modified, two power feeders can be provided on a long side of the substrate.

(Comparison with Prior Art)

The antenna device according to the present embodiments and the antenna disclosed in the above-described Patent Document 2 were modeled to operate under same condition and same frequency, and were evaluated by simulation. The antenna device according to the present embodiments had a loop-shaped element having a width of 3 mm provided on an FR4 substrate (having a conductor as the GND on a bottom surface) of 100 mm×50 mm×8 mm. The diameter of the loop-shaped element was 27 mm for the antenna device according to the present embodiments and 40 mm for the conventional example.

Figures 1, 10:
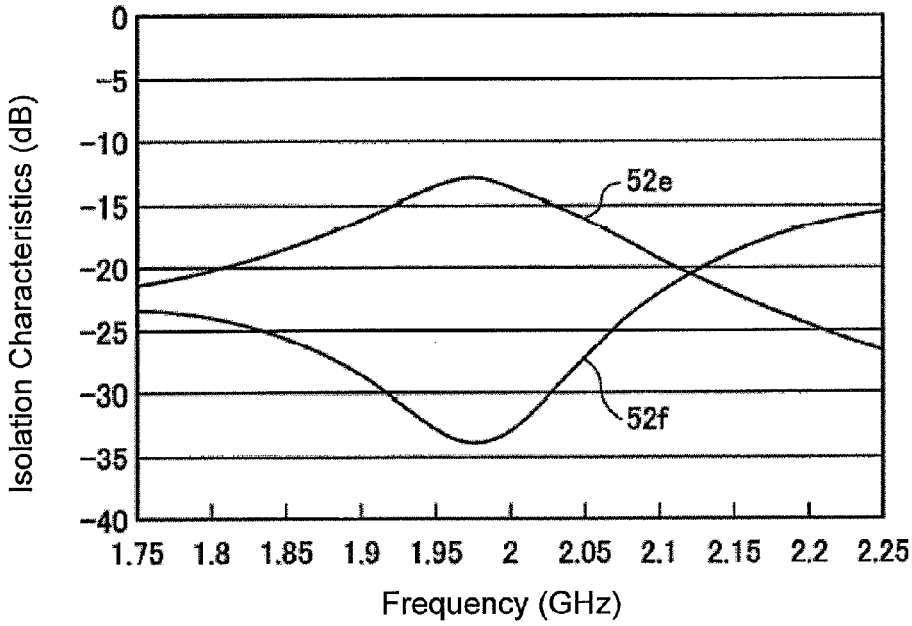
Figures 2, 10:
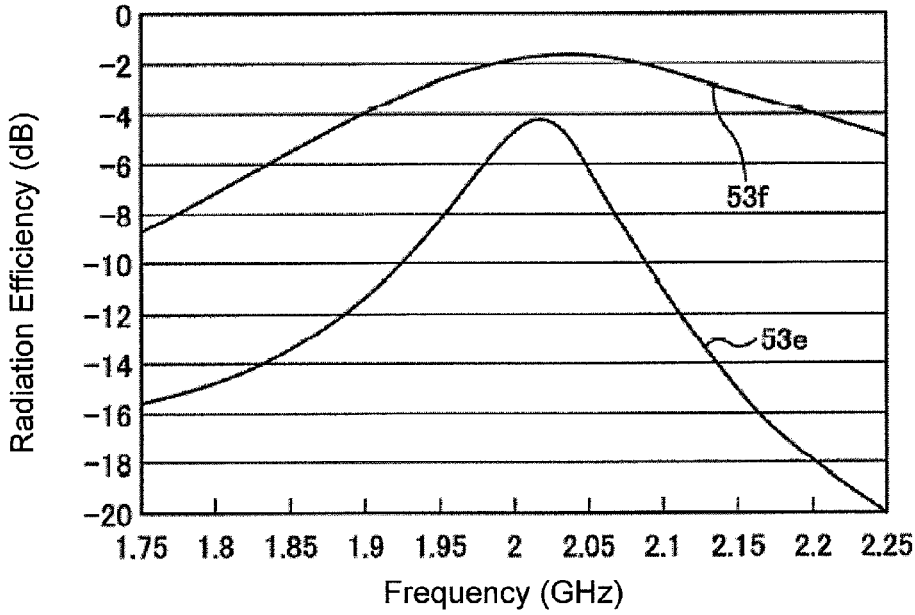

FIG. 10-1 and FIG. 10-2 illustrate electrical characteristics of the antenna device according to the present embodiments and the antenna according to the conventional example. The solid line 52*e* of FIG. 10-1 is the evaluation result of the antenna according to the conventional example (referred to as "the conventional example" in the following), and the solid line 52*f* is the evaluation result of the antenna device according to the present embodiments (referred to as "the present example" in the following). As FIG. 10-1 illustrates, the conventional example can secure isolation, but is inferior to the present example. Further, it is clear that the radiation efficiency of the antenna of the conventional example, as the solid line 53*e* of FIG. 10-2 illustrates, is inferior as compared to the result of the present example (solid line 53*f*).

Figures 1, 11:
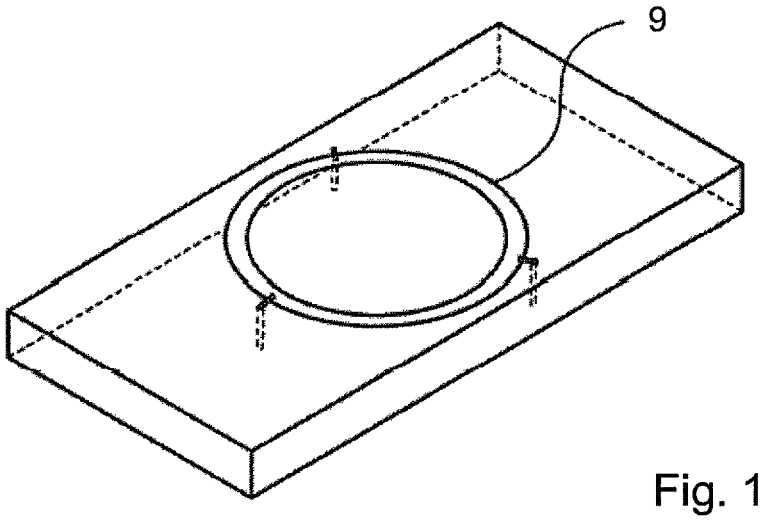
Figures 2, 11:
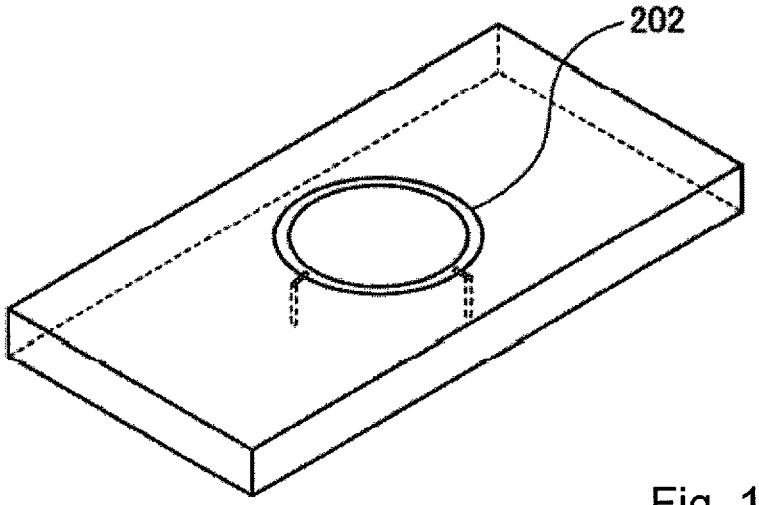

FIG. 11-1 illustrates an outline shape of a minimum configuration of the antenna according to the conventional example. FIG. 11-2 illustrates an outline shape of a minimum configuration when the antenna device according to the present example is modeled after the conventional example. As FIG. 11-1 illustrates, the shape of the antenna according to the conventional example requires that, even for the minimum configuration, the perimeter of a loop-shaped element 202 is at least 1.5λ. As FIG. 11-2 illustrates, when the antenna device according to the present example is modeled after the conventional example, the perimeter of the loop-shaped element 9 is shorter than the conventional example. Next, a comparison is made with respect to a case where an angle of a power feeder is displaced.

Figures 1, 12:
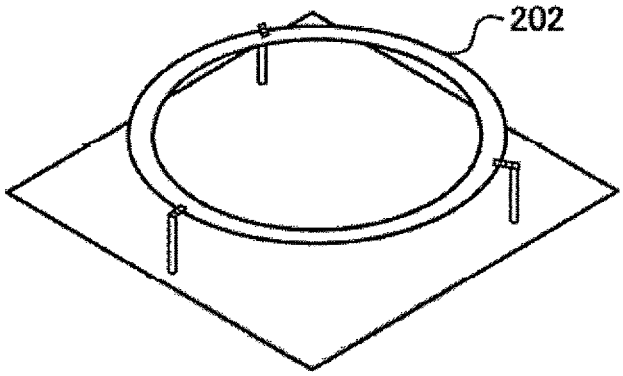
Figures 2, 12:
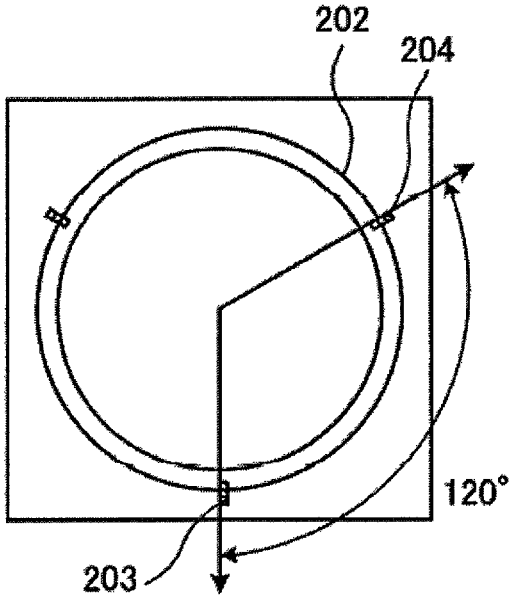
Figures 3, 12:
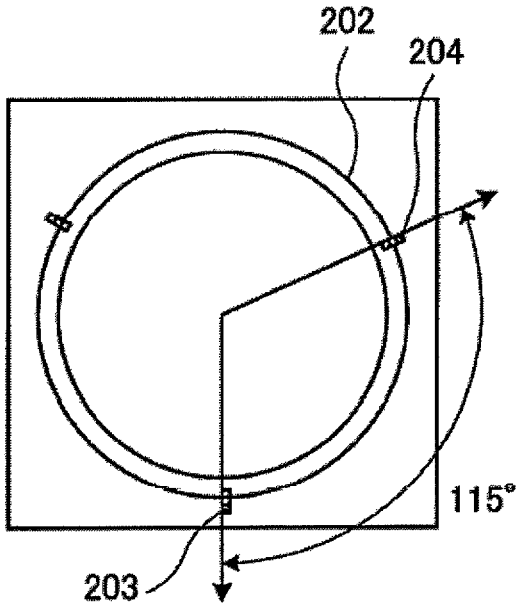
Figures 4, 12:
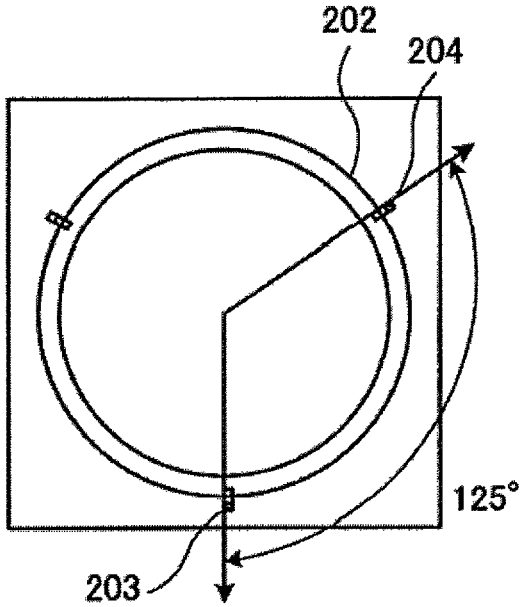
Figures 1, 13:
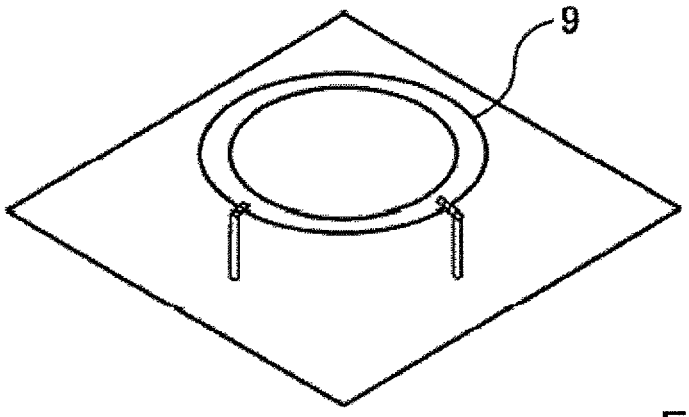
Figures 2, 13:
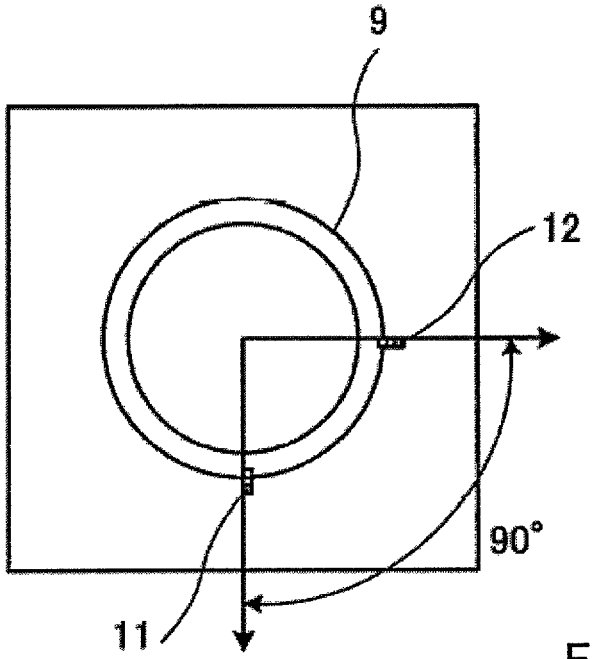
Figures 3, 13:
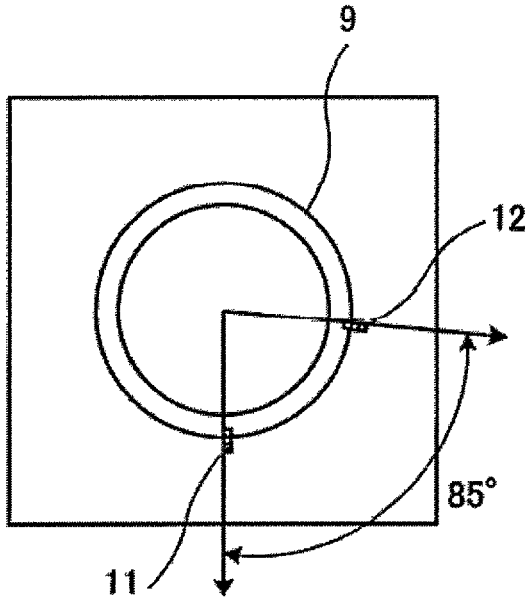
Figures 4, 13:
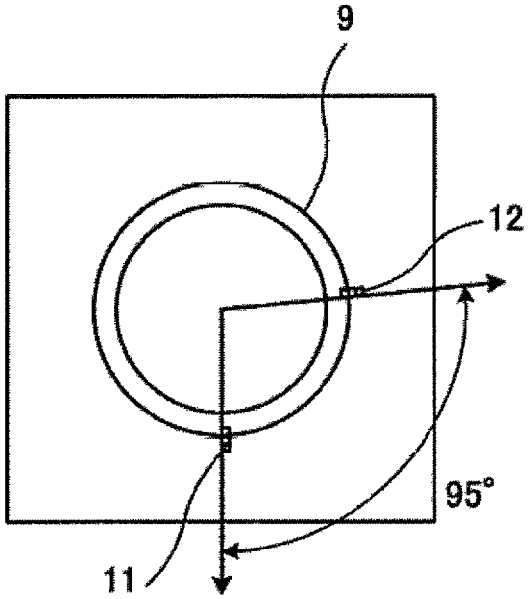

FIG. 12-1 illustrates a perspective view of an arrangement example of the loop-shaped element according to the conventional example. FIG. 12-2 to FIG. 12-4 illustrate outline shapes of a power feeder angle displacement examination model according to the conventional example. FIG. 13-1 illustrates a perspective view of an arrangement example of the loop-shaped element according to the present example. FIG. 13-2 to FIG. 13-4 illustrate outline shapes of a power feeder angle displacement examination model according to the present example. Inside a portable terminal, arranging only the loop-shaped element on a resin substrate requires a large space and thus is not practical. For this reason, as illustrated in FIG. 12-1 and FIG. 13-1, the loop-shaped elements 202 and 9 were provided in the air. In practice, the loop-shaped elements 202 and 9 are partially supported by resin parts.

The antenna devices illustrated in FIG. 12-1 and FIG. 13-1 had the loop-shaped elements 202 and 9 having a width of 1 mm provided on GND substrates of 50 mm×50 mm×0.035 mm at locations 8 mm above the substrates. The sizes of the loop-shaped elements 202 and 9 were adjusted so that usable frequencies in both the present examples and the conventional example were within a range of 3.55 GHz-3.6 GHz. The diameters of the loop-shaped elements 202 and 9 were 40 mm for the conventional example and 27 mm for the present examples.

As FIG. 12-2 illustrates, in the model of the antenna of the conventional example, an 120-degree spacing between the power feeders 203 and 204 with respect to the loop-shaped element 202 is standard. For this reason, as FIG. 12-3 and FIG. 12-4 illustrate, ±5-degree modified models were prepared based on the 120-degree model as the standard. As FIG. 13-2 illustrates, in the model of the antenna device of the present example, a 90-degree spacing between the first power feeder 11 and the second power feeder 12 with respect to the loop-shaped element 9 is standard. For this reason, as FIG. 13-3 and FIG. 13-4 illustrate, ±5-degree modified models were prepared based on the 90-degree model as the standard.

Figures 1, 14:
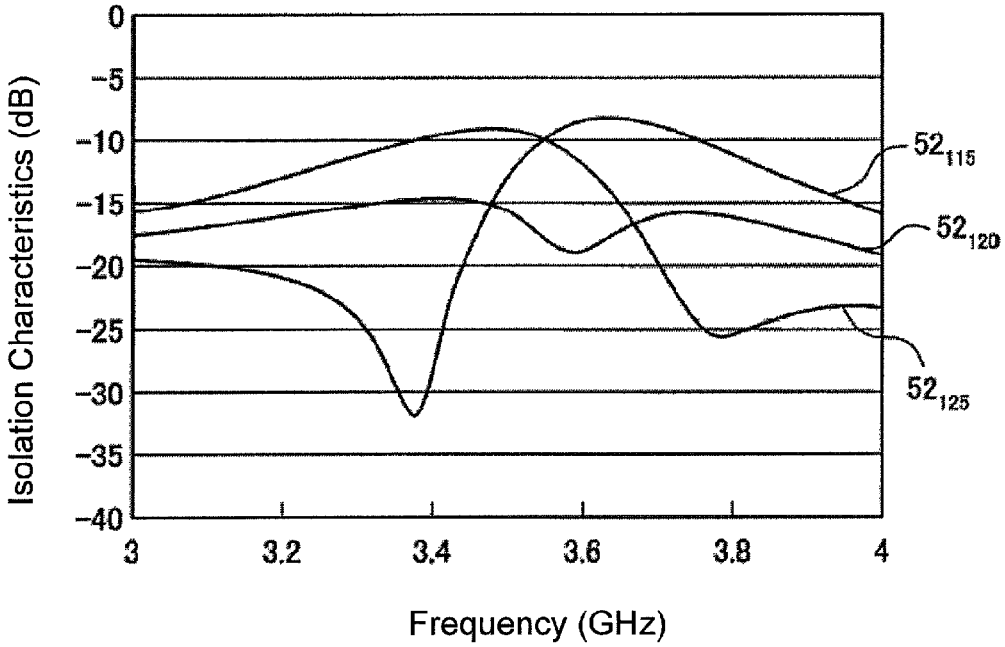
Figures 2, 14:
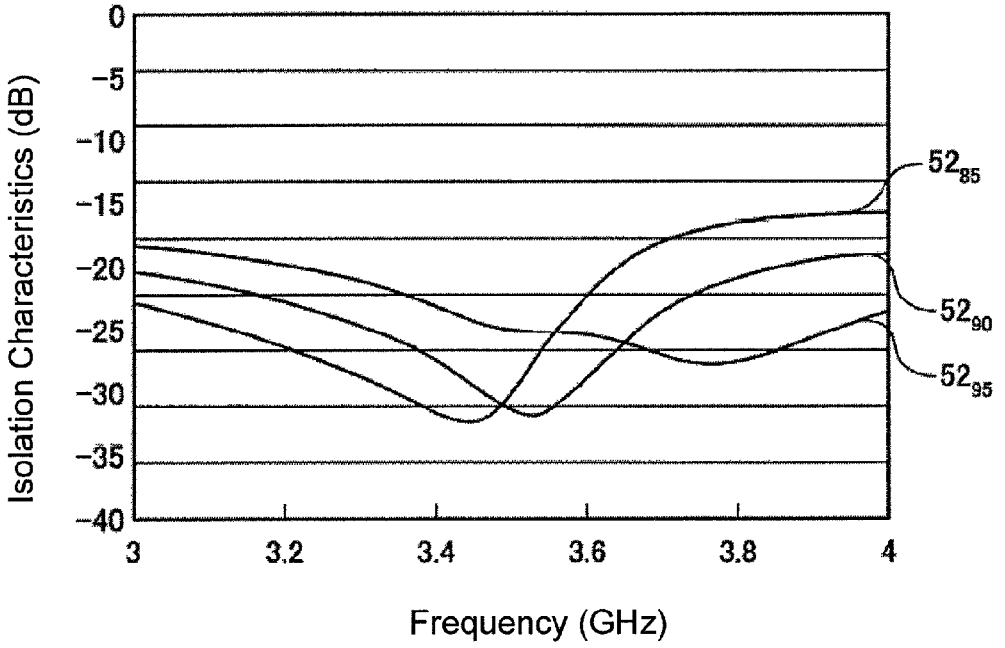
Figures 3, 14:
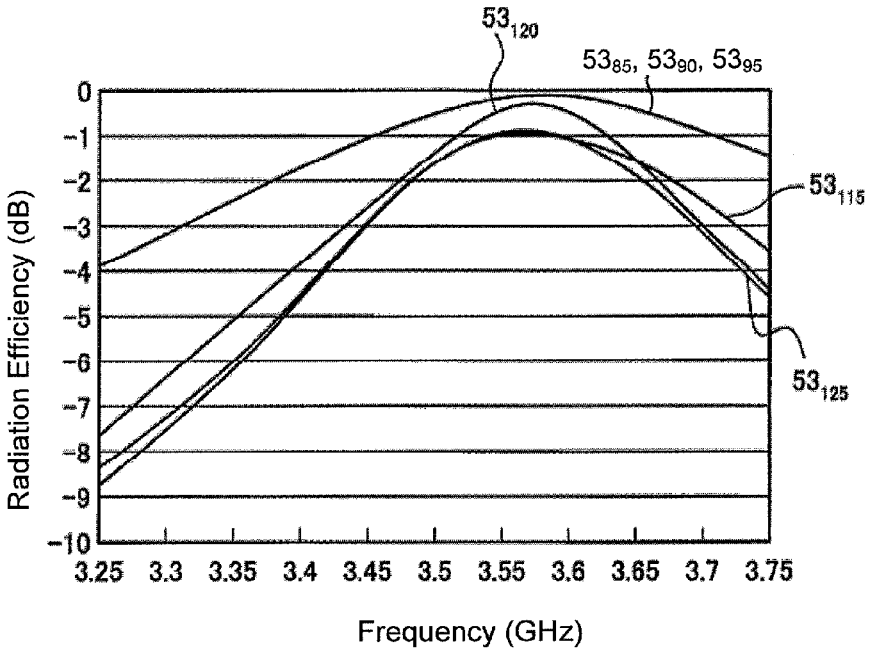

FIG. 14-1 graphically compares electrical characteristics (isolation) when the angle of a power feeder according the conventional example is displaced. FIG. 14-2 graphically compares electrical characteristics (isolation) when the angle of a power feeder according the present example is displaced. FIG. 14-3 graphically compares electrical characteristics (radiation efficiency) when the angles of power feeders according the conventional example and according to the present example are displaced. As FIG. 14-1 illustrates, when the angle is 120 degree, as the solid line $\mathbf{52}_{120}$ indicates, the isolation is stable and is about −15 dB. However, when the angle is changed by 5 degree to be 115 degree, as the line $\mathbf{52}_{115}$ indicates, the isolation significantly deteriorated to be less than −10 dB in a band on the high frequency side. When the angle is changed by 5 degree to be 125 degree, as the line $\mathbf{52}_{125}$ indicates the isolation significantly deteriorated to be less than −10 dB in a band on the low frequency side. In contrast, as FIG. 14-2 illustrates, for the present example, an isolation of −15 dB or more is secured in all of the case of 85 degree (solid line $\mathbf{52}_{85}$), 90 degree (solid line $\mathbf{52}_{90}$) and 95 degree (solid line $\mathbf{52}_{95}$).

With respect to the radiation characteristics of the present example, as the solid lines $\mathbf{53}_{85}$, $\mathbf{53}_{90}$ and $\mathbf{53}_{95}$ of FIG. 14-3 indicate, even when the angle of the power feeder is displaced by 5 degree from 90 degree, difference is hardly observed in the characteristics. In contrast, with respect to the conventional example, as the solid lines $\mathbf{53}_{115}$, $\mathbf{53}_{120}$ and $\mathbf{53}_{125}$ of FIG. 14-3 indicate, in the case of 120 degree as the standard, the peak radiation efficiency is close to the results of 90 degree, 95 degree and 85 degree of the present example, but is less than the present example. In the conventional example, when the angle between the power feeders is displaced by 5 degree, the radiation efficiency deteriorates by about 1 dB. Further, for all values of the angle, the bandwidth is narrow as compared to the radiation efficiency of the present example. As described above, the present example has higher isolation and higher radiation efficiency as compared to the conventional example. Further, in the present example, when the angle between the power feeders is displaced, deterioration in isolation and radiation efficiency due to the displacement is small as compared to the conventional example.

Third Embodiment

Figure 15:
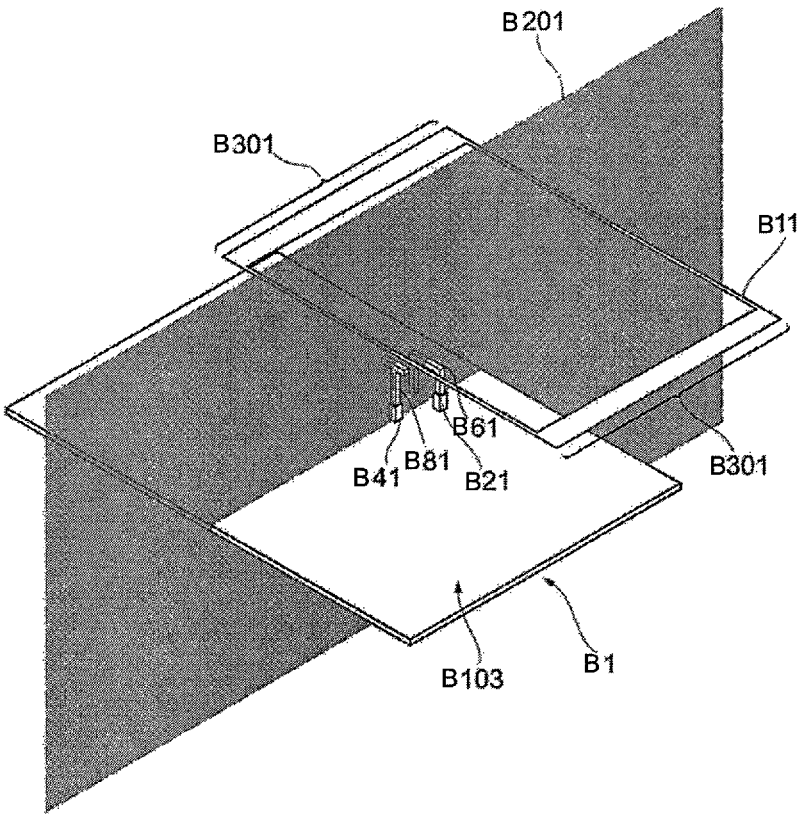
FIG. 15 illustrates a perspective view of an antenna device according to a third embodiment.
Figure 16:
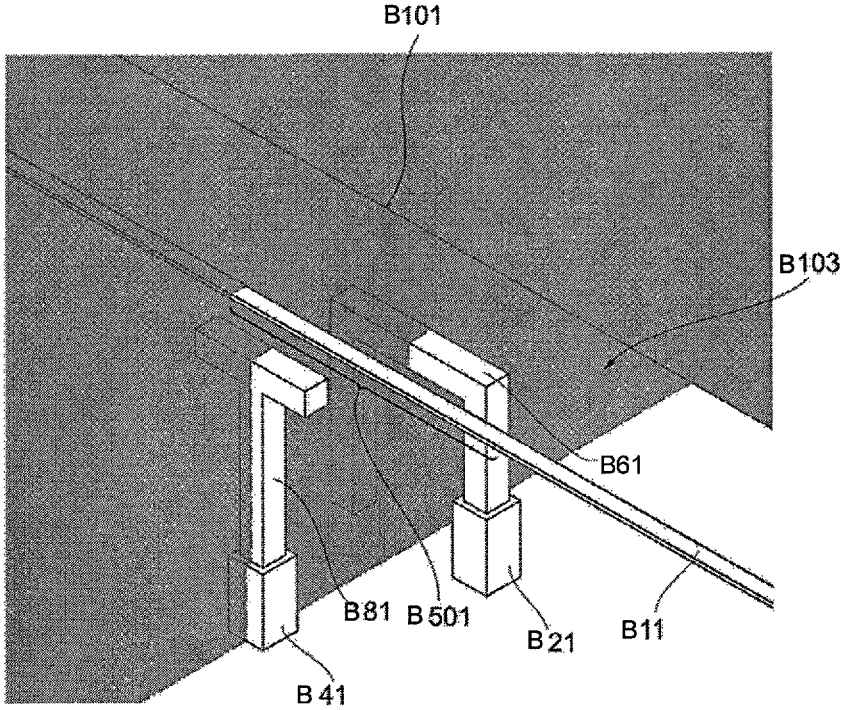
FIG. 16 illustrates details of the antenna device according to the third embodiment.
Figure 17:
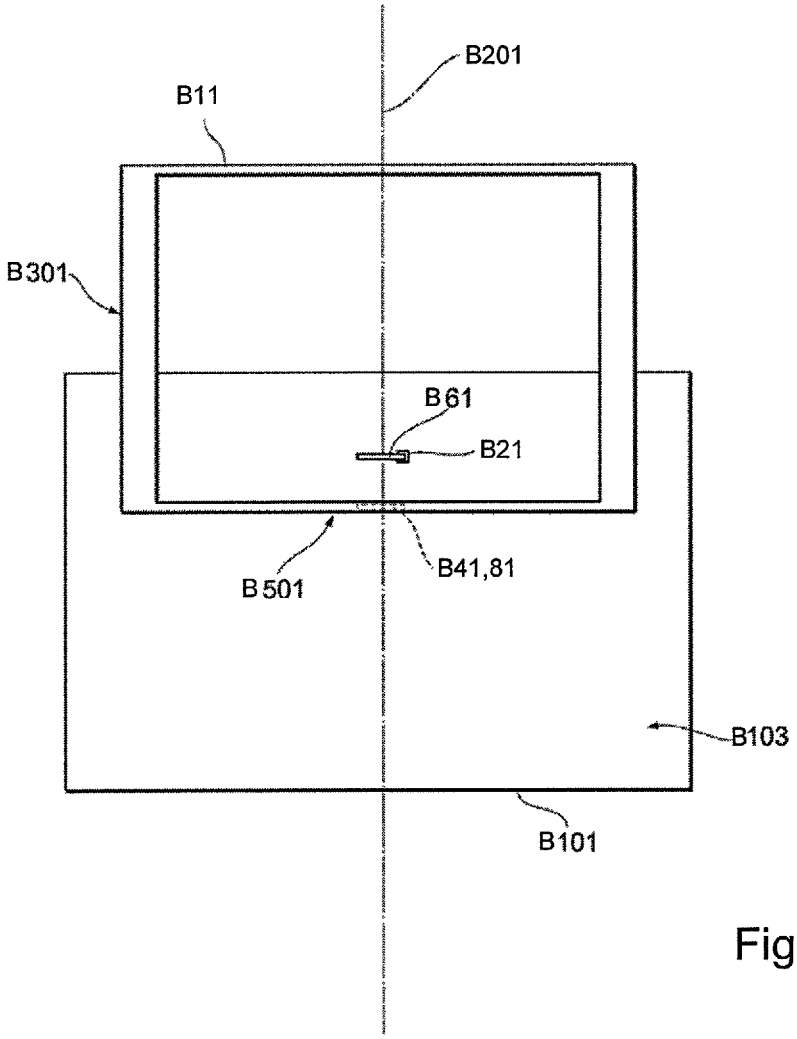
FIG. 17 illustrates a top view of the antenna device according to the third embodiment.

FIG. 15 illustrates a perspective view of an antenna device according to a third embodiment. FIG. 16 illustrates a perspective view of details of the antenna device according to the third embodiment. FIG. 17 illustrates a top view of the antenna device according to the third embodiment. An antenna device B1 has, for example, a loop-shaped element (antenna element) built-in in a wireless communication portable terminal such as a portable telephone or mounted on a surface of a casing of the wireless communication portable terminal. The antenna device B1 has a go-around loop-shaped element B11 as an antenna element.

The antenna device B1 has a first power feeder B21 and a second power feeder B41 for power-feeding the loop-shaped element B11. In the present embodiment, the loop-shaped element B11 has a rectangular shape in a plan view. However, the shape of the loop-shaped element B11 is not limited to this. For example, the loop-shaped element B11 may also have, in a plan view, a circular shape, an elliptical shape, a polygonal shape, and the like. Further, when the loop-shaped element B11 has a polygonal shape in a plan view, corners may have a curvature.

The antenna device B1 power-feeds the loop-shaped element B11 by using the two power feeders B21 and B41 respectively via transmission wires B61 and B81, and operates as two independent antennas, the power feeders B21 and B41 being formed in a ground area B103 on a substrate B101.

The first transmission wire B61 extending from the first power feeder B21 is a path having a front end grounded to the ground area B103. A portion of the path is arranged parallel to a portion of the loop-shaped element B11. The loop-shaped element located at this parallel arrangement becomes a power receiving section B501, and the both are close to each other at a distance sufficient to maintain coupling. The first transmission wire B61 has its front end grounded to the ground area B103. Therefore, a strong current is generated in the first transmission wire B61. A magnetic field due to the generated current induces a current in the power receiving section B501 of the loop-shaped element B11. Thereby, the first transmission wire B61 magnetically couples with the loop-shaped element B11.

The second transmission wire B81 extending from the second power feeder B41 has a front end that is an open end. The front end is arranged to be close to the power receiving section B501 that is a part of the loop-shaped element B11 to a distance sufficient to maintain coupling. The second transmission wire B81 has the open front end. Therefore, a strong voltage is generated in the front end. An electric field due to this voltage induces a voltage in the power receiving section B501. Thereby, the second transmission wire B81 performs electric field coupling with the loop-shaped element B11.

In this case, the loop-shaped element B11 including the power receiving section B501 must be plane-symmetrical with respect to a first plane B201 that is perpendicular to the loop-shaped element at the power receiving section. A signal transmitted by the first transmission wire B61 generates a standing wave in the loop-shaped element B11. Distribution of the standing wave is formed such that the power receiving section B501 becomes an anti-node of a current standing wave.

A signal transmitted by the second transmission wire B81 generates a standing wave in the loop-shaped element B11. Distribution of the standing wave is formed such that the power receiving section B501 becomes an anti-node of a voltage standing wave. When the loop-shaped element B11 is not plane-symmetrical with respect to the first plane B201, a difference, which is distributed in one path and in another path as viewed from the power receiving section B501, is generated in characteristic impedances. Disturbance occurs in the standing wave due to a reflected wave that occurs when the characteristic impedance changes. Therefore, an occurrence location of an anti-node or a node cannot be accurately settled to the power receiving section B501. For the same reason, it is desirable that the substrate B101 also be plane-symmetrical with respect to the first plane B201. The loop-shaped element B11 and/or the substrate B101 are not necessary to have a strictly plane-symmetrical shape as far as an electrical symmetry is maintained to the extent that the occurrence locations of anti-nodes and nodes of a standing wave do not crumble.

A signal excited from the first power feeder forms a current distribution in the loop-shaped element B11 with the power receiving section as an anti-node. Therefore, the voltage distribution at the power receiving section corresponds to a node. For this reason, the electric field intensity at the power receiving section is significantly low, and electric field coupling with the second transmission wire B81 is weak. Further, the second transmission wire B81 is configured to have an open front end. Therefore, no current is generated and thus magnetic coupling does not occur. Therefore, a signal propagated to the loop-shaped element from the first power feeder B21 via the first transmission wire B61 does not leak or propagate to the second power feeder B41.

A signal excited by the second power feeder B41 forms a voltage distribution with the power receiving section as an anti-node. Therefore, the current distribution at the power receiving section corresponds to a node. For this reason, the magnetic field intensity at the power receiving section is significantly low, and thus magnetic coupling with the first transmission wire B61 is weak. Further, the first transmission wire B61 is configured to have a short-circuiting front end. Therefore, electric field coupling is also weak. As the result, a signal propagated to the loop-shaped element from the second power feeder B41 via the second transmission wire B81 does not leak or propagate to the first power feeder B21. This allows isolation characteristics between the two power feeders to be kept in a good state.

In the loop-shaped element B11, characteristic impedance adjustment sections B301 are provided and functions to adjust two resonance frequencies so that the two resonance frequencies become the same. When the characteristic impedance distributed in the loop-shaped element B11 is constant, the physical lengths are equal because the same loop-shaped element is excited. Thereby, the resonance frequencies are the same frequency when the loop-shaped element B11 is excited from the first and second power feeders B21 and B41. However, in practice, due to influence of the power feeders, influence of the shape of the loop-shaped element B11, and influence of the substrate B101, the characteristic impedance distributed in the loop-shaped element B11 is not constant. Therefore, a difference in the standing wave distributions respectively excited from the power feeders causes an unignorable difference in the two resonance frequencies.

Therefore, in order to have the two power feeders operated with the same frequency, it is necessary to provide the characteristic impedance adjustment sections at appropriate locations of the loop-shaped element to adjust the characteristic impedance at the location and thereby align the electrical lengths respectively viewed from the power feeders. The characteristic impedance adjustment sections are also necessary to be configured to be plane-symmetrical with respect to the first plane B201 in order to secure isolation characteristics.

In the third embodiment, characteristic impedance adjustment is performed by making the line width of the loop-shaped element B11 at the characteristic impedance adjustment sections B301 different from other portions. In general, when the line width of a path is widened, a capacitance component of the characteristic impedance increases and an inductance component of the characteristic impedance decreases. On the other hand, when the line width of a path is narrowed, the capacitance component of the characteristic impedance decreases and the inductance component increases.

For example, in a case where, in a state in which the characteristic impedance adjustment sections are not provided, a first resonance frequency excited by the first power feeder is higher than a second resonance frequency excited by the second power feeder, it is preferred that one characteristic impedance adjustment section is provided at an area containing a point advanced by $\lambda/4$ from the power receiving section on one side, and further, the other characteristic impedance adjustment section is provided at an area that is plane-symmetrical with respect to the former area when using the first plane B201 as a plane of symmetry. The line width of the loop-shaped element at the characteristic impedance adjustment sections is configured to be wider than other portions.

By changing the width of a path to be wider, an decrease in the inductance component and an increase in the capacitance component occur. In the case of being excited from the first power feeder B21, the current standing wave becomes a node and the voltage standing wave becomes an anti-node at the characteristic impedance adjustment sections. Therefore, only the increase in the capacitance component contributes to a change in the resonance frequency. This serves to lower the first resonance frequency.

On the other hand, in the case of being excited from the second power feeder B41, the current standing wave becomes an anti-node and the voltage standing wave becomes a node at the characteristic impedance adjustment sections. Therefore, the characteristic impedance adjustment sections contribute to a change in the resonance frequency only with respect to the decrease in the inductance component of the path, and function to raise the second resonance frequency. For this reason, by widening the line width up to an appropriate portion, the two resonance frequencies can be adjusted to become the same.

As described above, since the relationships of the anti-node and node of the standing wave distributions respectively excited from the power feeders are reversed, the action on the resonance frequency by providing the characteristic impedance adjustment sections acts only on one power feeder, or acts in opposite directions on the two power feeders. Therefore, by adjusting the resonance frequencies in a direction that the two frequencies are approaching each other, the resonance frequencies can be adjusted to be the same.

When the characteristic impedance adjustment sections are provided in the loop-shaped element, locations where the actions with respect to the two resonance frequencies are the most different are locations where a standing wave distribution becomes an anti-node or a node. When the entire length of the path is $\lambda$, such locations are at points 0, $\lambda/4$, $\lambda/2$, and $3\lambda/4$ away relative to the power receiving section. On the other hand, locations where the actions with respect to the two resonance frequencies are the most similar are points located in the middle of an anti-nodes and a node. Such points are at locations λ/8, 3λ/8, 5λ/8 and 7λ/8 advanced from the power receiving section.

Around each of such points, the voltage and current of the standing waves switch places in strength, and the direction of the action with respect to the resonance frequencies reverses. For this reason, when the characteristic impedance adjustment sections are provided within a range of ±λ/8 or less around a point where the standing wave has an anti-node or a node, the adjustment of the resonance frequency is most effective.

In the present embodiment, as an adjustment method of the characteristic impedance adjustment section, a method is used in which the line width of the loop-shaped element B11 is partially changed. However, other methods may also be used. As the other methods, possible methods include adjusting a distance between the loop-shaped element B11 and the substrate B101; and partially arranging a dielectric material on the loop-shaped element B11. As the characteristic impedance adjustment method, an adjustment method may be suitably selected according to the shapes of and a positional relationship between the loop-shaped element B11 and the substrate B101.

For the above reasons, with the above-described configuration, a two-input antenna that operates with the same frequency and has superior isolation characteristics can be realized.

Fourth Embodiment

Figure 18:
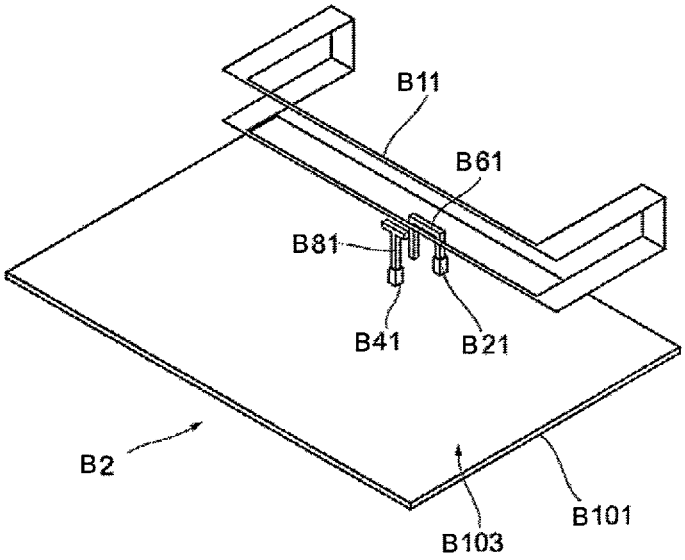
FIG. 18 illustrates a perspective view of an antenna device according to a fourth embodiment.

FIG. 18 illustrates a perspective view of an antenna device according to a fourth embodiment.

An antenna device B2 is characterized in that, in addition to the structure of the antenna device B1 of the third embodiment, the loop-shaped element B11 has a folded shape. By doing so, the area occupied by the loop-shaped element B11 is reduced and miniaturization can be supported. Further, with respect to the case of exciting from the first power feeder 21, when the loop-shaped element B11 is folded in a manner that the point λ/2 away from the power receiving section approaches the power receiving section, the current standing wave distributions at the power receiving section and at the point λ/2 away from the power receiving section are equal. Therefore, power-feeding from the first transmission wire B61 can also be performed with respect to the point λ/2 away from the power receiving section. Favorable characteristics are likely to be secured.

Fifth Embodiment

Figure 19:
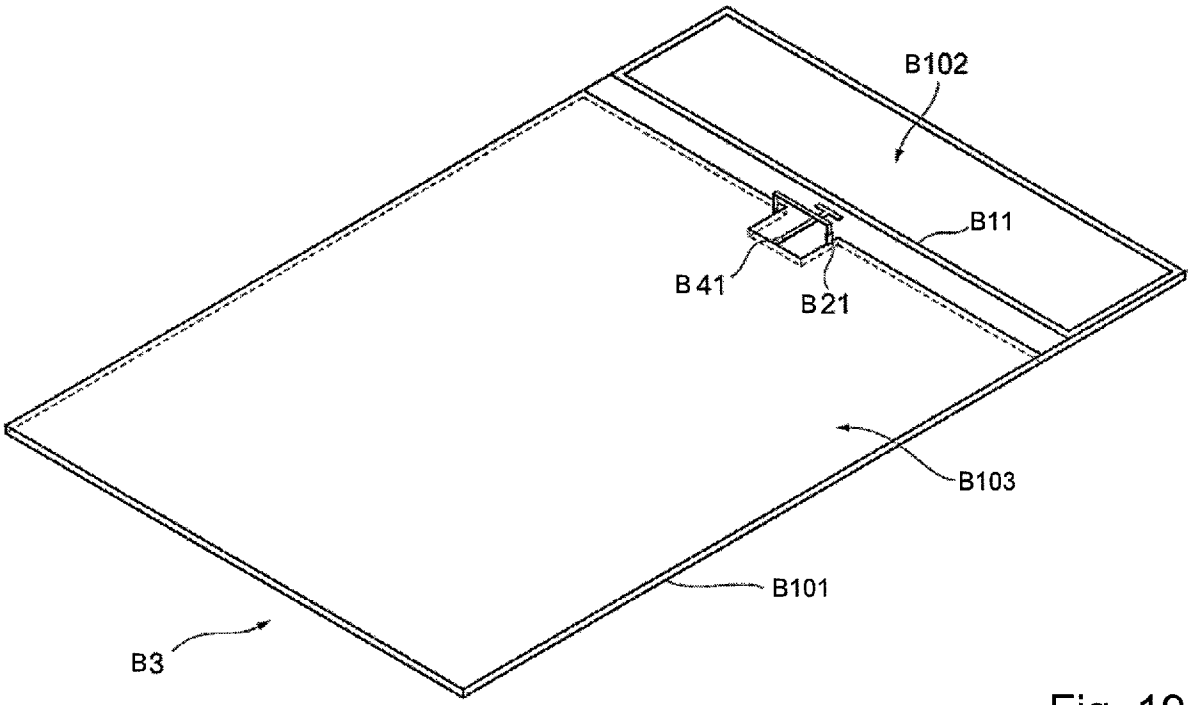
FIG. 19 illustrates a perspective view of an antenna device according to a fifth embodiment.
Figure 20:
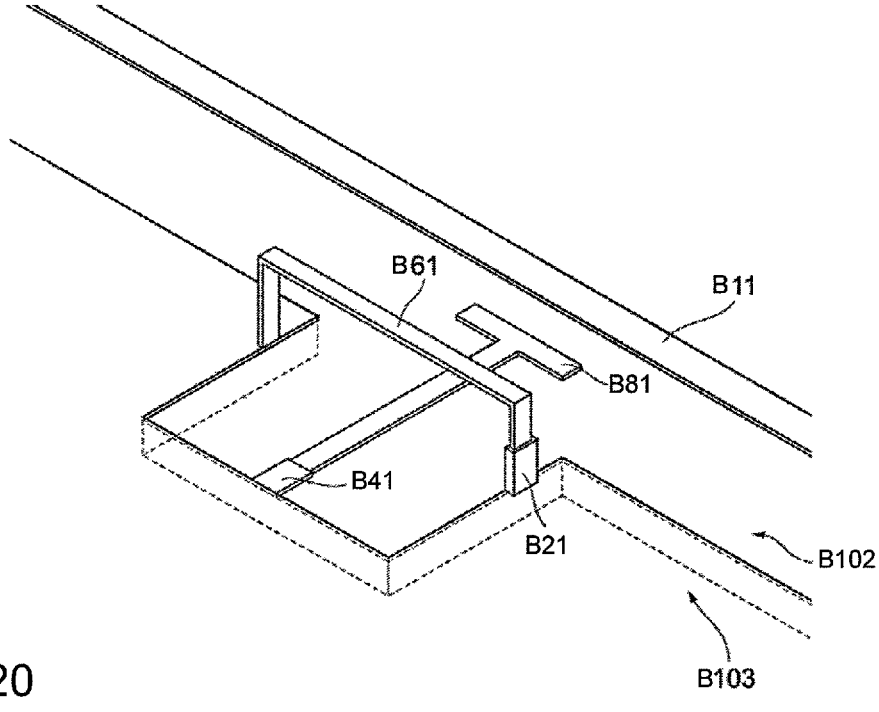
FIG. 20 illustrates details of the antenna device according to the fifth embodiment.

FIG. 19 illustrates a perspective view of an antenna device according to a fifth embodiment. FIG. 20 illustrates a perspective view of details of the antenna device according to the fifth embodiment.

An antenna device B3 is characterized in that, in addition to the structure of the antenna device B1 of the third embodiment, the second transmission wire B81 and the loop-shaped element B11 are formed by a substrate pattern. By doing so, the loop-shaped element B11 and the second transmission wire B81 can be formed by the substrate pattern. Therefore, the number of parts mounted on the substrate B101 decreases, and production become easy.

In the antenna device B3, a portion of the ground area B103 that is directly under the first transmission wire B61 is cut out. By providing this cut-out, the signal path of the transmission wire B61 becomes longer, and its magnetic field coupling with the power receiving section of the loop-shaped element B11 becomes stronger. By adjusting the depth of the cut-out, the strength of the coupling with the power receiving section can be adjusted.

Sixth Embodiment

Figure 21:
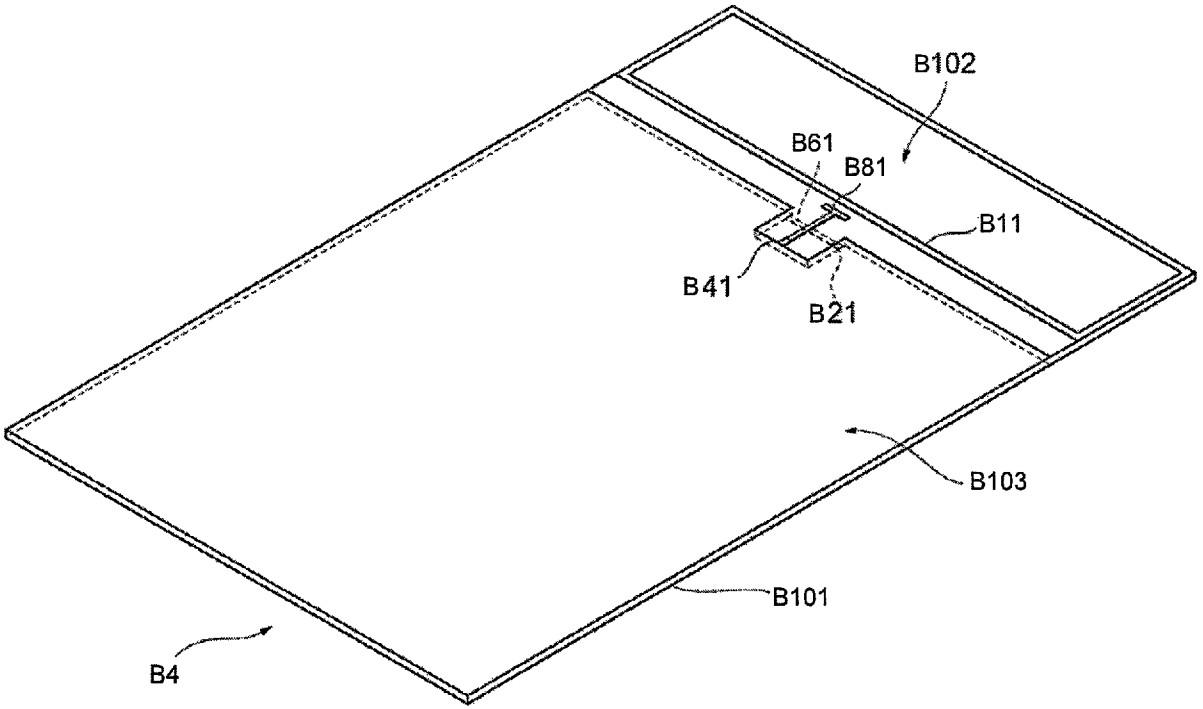
FIG. 21 illustrates a perspective view of an antenna device according to a sixth embodiment.
Figure 22:
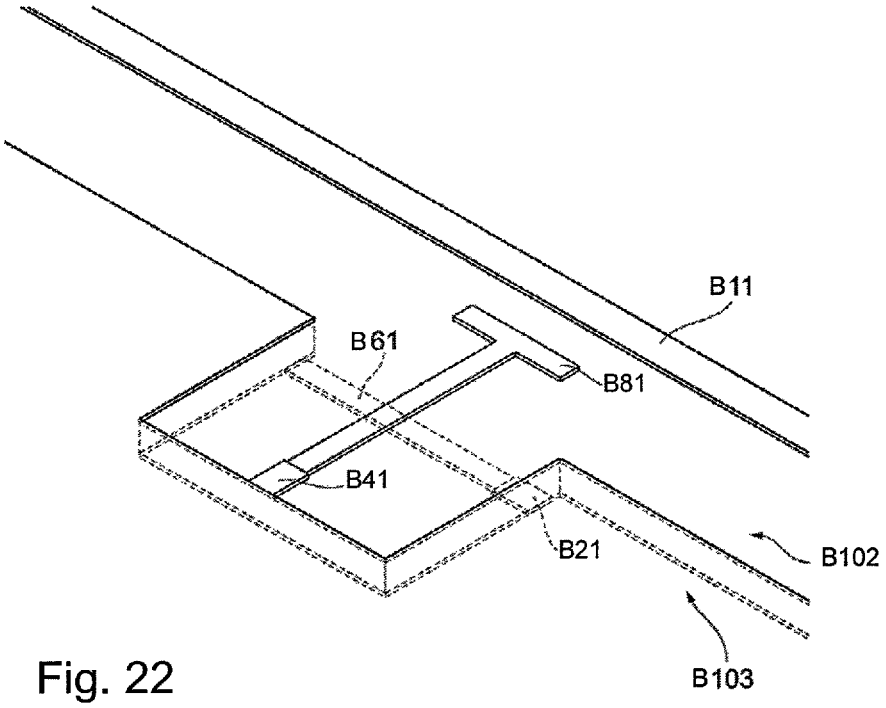
FIG. 22 illustrates details of the antenna device according to the sixth embodiment.

FIG. 21 illustrates a perspective view of an antenna device according to a sixth embodiment. FIG. 22 illustrates a perspective view of details of the antenna device according to the sixth embodiment. An antenna device B4 is characterized in that, in addition to the structure of the antenna device B3 of the fifth embodiment, the first transmission wire B61 is formed by a pattern on a back surface of the substrate and sterically intersects the second transmission wire B81.

By forming the first transmission wire B61 and the second transmission wire B81 on separate layers from the substrate B101, the two can be formed by substrate patterns and sterically intersect each other, and thus can be more compactly arranged. Further, similar to the case of the fifth embodiment, by adjusting the depth of the cut-out of the ground area B103 at the portion where the transmission wires B61 and B81 are formed, the strength of the coupling between the first transmission wire B61 and the power receiving section can be adjusted.

Seventh Embodiment

Figure 23:
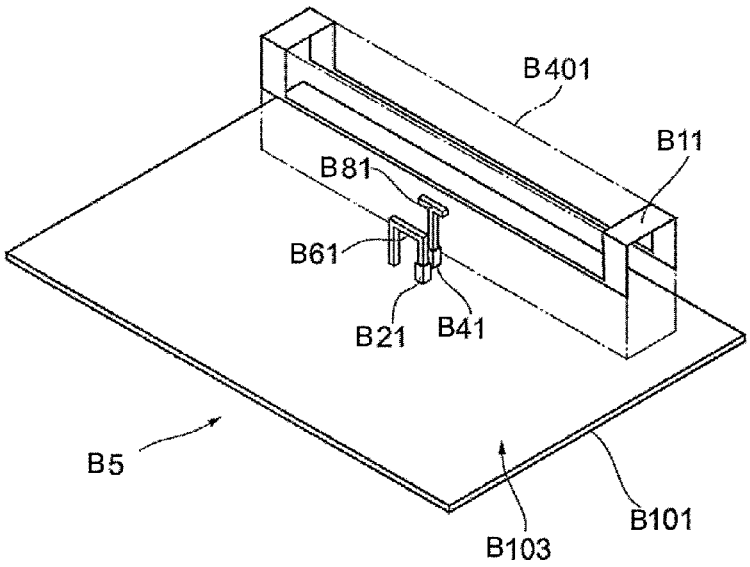
FIG. 23 illustrates a perspective view of an antenna device according to a seventh embodiment.

FIG. 23 illustrates a perspective view of an antenna device according to a seventh embodiment. An antenna device B5 is characterized in that, in addition to the structure of the antenna device B1 of the third embodiment, the loop-shaped element B11 is formed on a surface of a base body B401 configured by a dielectric material or a magnetic material arranged on the substrate B101. By doing so, further miniaturization is possible utilizing a wavelength shortening effect due to the permittivity or permeability of the base body B401. Since the loop-shaped element B11 can be formed on the surface of the base body 401, production also becomes easy.

Eighth Embodiment

Figure 24:
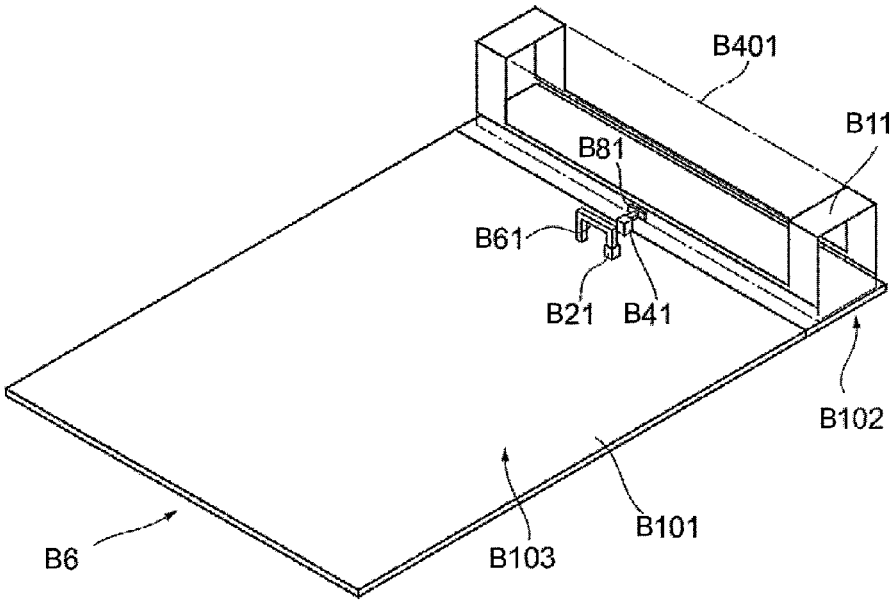
FIG. 24 illustrates a perspective view of an antenna device according to an eighth embodiment.
Figure 25:
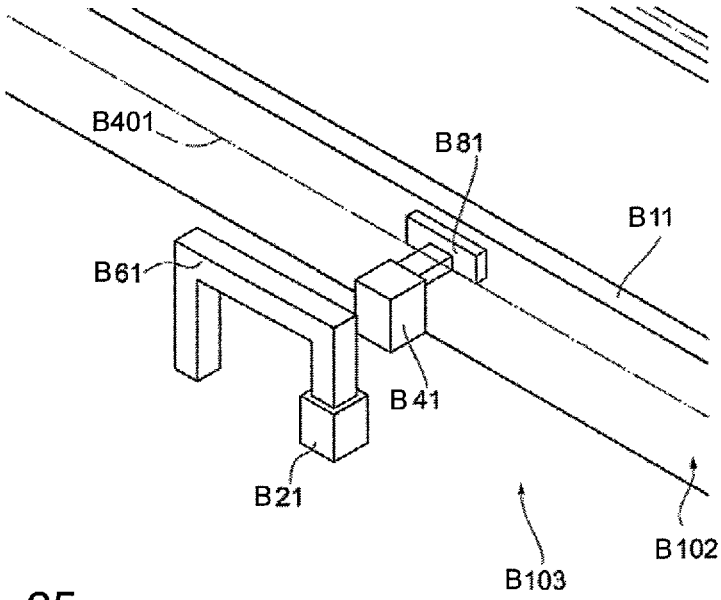
FIG. 25 illustrates details of the antenna device according to the eighth embodiment.

FIG. 24 illustrates a perspective view of an antenna device according to an eighth embodiment. FIG. 25 illustrates a perspective view of details of the antenna device according to the eighth embodiment. An antenna device B6 is characterized in that, in addition to the structure of the antenna device B5 of the seventh embodiment, a non-ground area B102 on which grounding is not formed is formed along one side of the substrate B101, and the base body B401 is formed on the non-ground area B102. By doing so, shielding of radiation from the antenna by grounding is reduced. Therefore, radiation characteristics of the antenna can be improved. As will be described later, the loop-shaped element B11 can be formed on the entire surface including the bottom surface of the base body B401, and thus the loop-shaped element B11 effectively utilizing the volume of the base body B401 can be formed.

Ninth Embodiment

Figure 26:
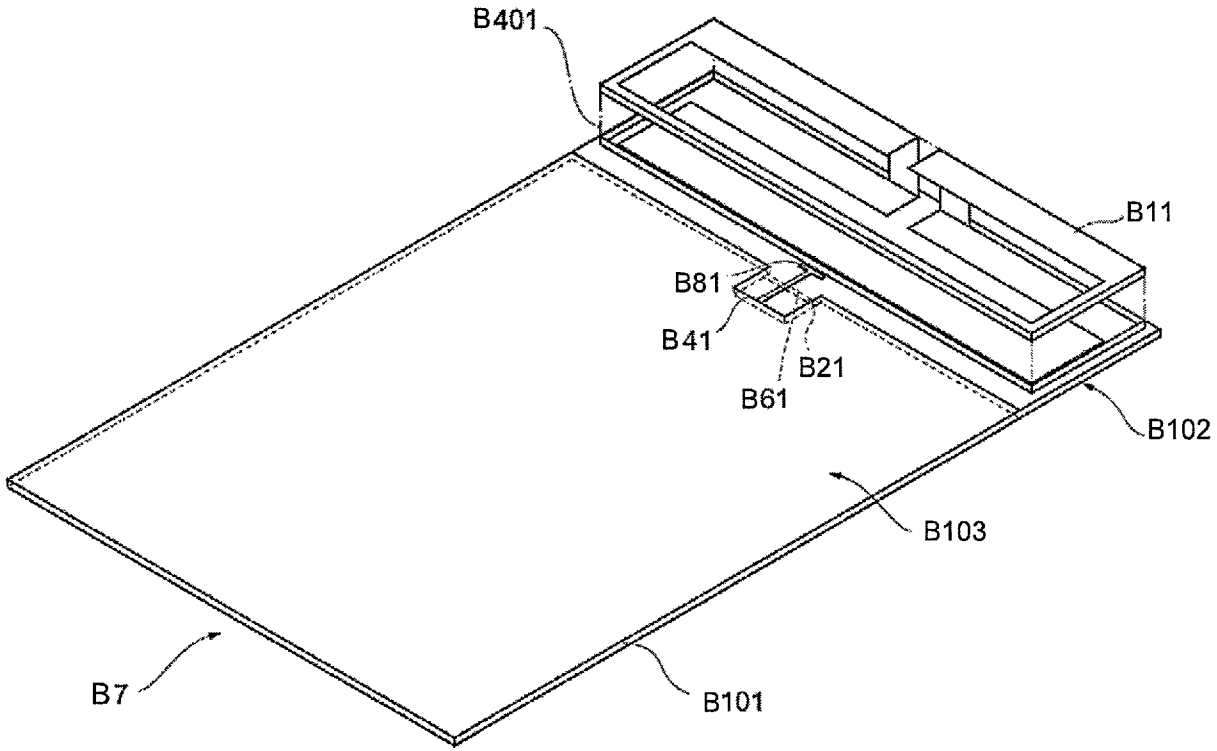
FIG. 26 illustrates a perspective view of an antenna device according to a ninth embodiment.
Figure 27:
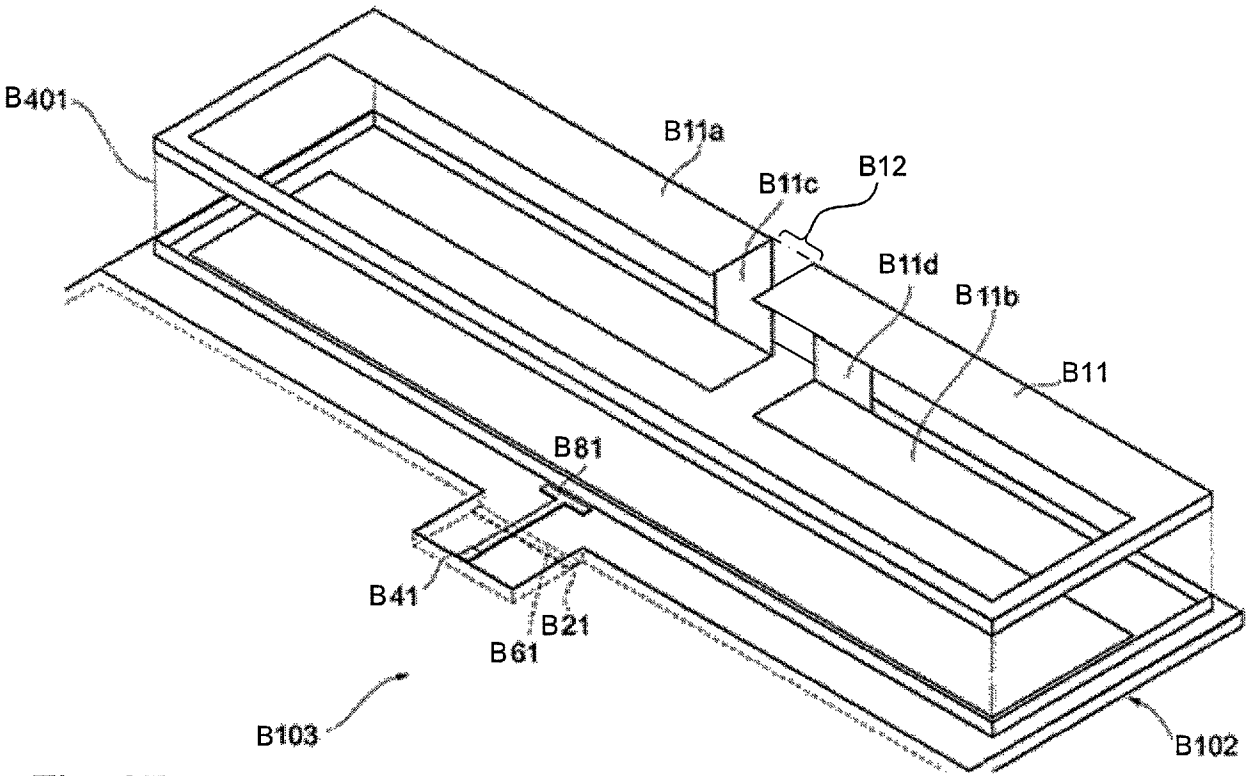
FIG. 27 illustrates details of the antenna device according to the ninth embodiment.

FIG. 26 illustrates a perspective view of an antenna device according to a ninth embodiment. FIG. 27 illustrates a perspective view of details of the antenna device according to the ninth embodiment. An antenna device B7 has, in addition to the structure of the antenna device B6 of the eighth embodiment, the following characteristics. The base body B401 is arranged parallel to a border line between the ground area B103 and the non-ground area B102. When, in the base body B401, the upper surface is a first surface, the bottom surface is a second surface, a side surface including a side parallel to the border line and located on the outer side of the substrate B101 is a third surface, a side connecting the first surface and the third surface of the base body B401 is a first side, and a side connecting the second surface and the third surface is a second side, the loop-shaped element B11 includes a substantially C-shaped first conductor pattern B11*a* formed along an edge line of the first surface of the base body B401 and having a first spacing at substantially a center of the first side; a substantially C-shaped second conductor pattern B11*b* formed along an edge line of the second surface and having a second spacing at substantially a center of the second side; and a first connecting conductor B11*c* and a second connecting conductor B11*d* that are formed on the third surface and respectively connect ends of the first conductor pattern B11*a* and ends of the second conductor pattern B11*b*. A gap is formed between the first connecting conductor B11*c* and the second connecting conductor B11*d*.

The loop-shaped element B11 is mainly formed along the edge lines of the base body B401. A shape effectively utilizing the volume of the base body is realized. Therefore, miniaturization can be effectively performed. By adopting such a structure, the first connecting conductor B11*c* and the second connecting conductor B11*d* that are provided on the side surface for connecting the first conductor pattern B11*a* formed on the first surface of the base body B401 and the second conductor pattern B11*b* formed on the second surface of the base body B401 are positioned by $\pm\lambda/4$ away from the power receiving section, when the entire length of the loop-shaped element B11 is $\lambda$.

When an excitation occurs from the first power feeder B21, this location corresponds to an anti-node of a voltage standing wave. Therefore, when a portion formed by the gap between the first and second connecting conductors B11*c* and B11*d* and the first and second spacings is an opposing area B12, the coupling capacitance occurring at this place has a strong effect on lowering the resonance frequency. On the other hand, when another excitation occurs from the second power feeder B41, this place corresponds to a node of the voltage standing wave. Therefore, the resonance frequency lowering effect is weak. Consequently, by adjusting the spacing between the opposing first and second connecting conductors that are formed on the third surface, the resonance frequency of the first power feeder can be independently adjusted. In a case where the first and second surfaces are disposed at the side surfaces of the base body B401 including sides parallel to the border line and the third surface is disposed at the upper surface or the bottom surface of the base body B401, and where the loop-shaped element is formed in the way as described above, the same behavior also holds. Therefore, such a configuration is also possible.

Tenth Embodiment

Figure 28:
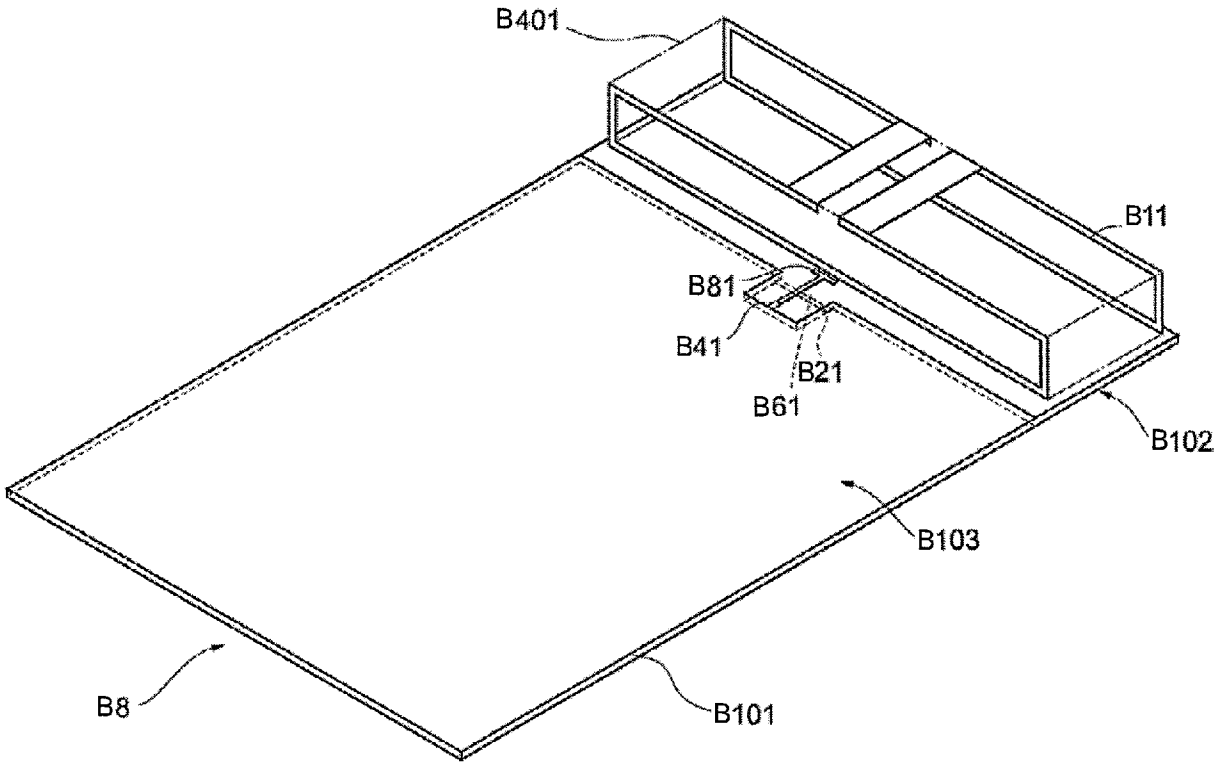
FIG. 28 illustrates a perspective view of an antenna device according to a tenth embodiment.
Figure 29:
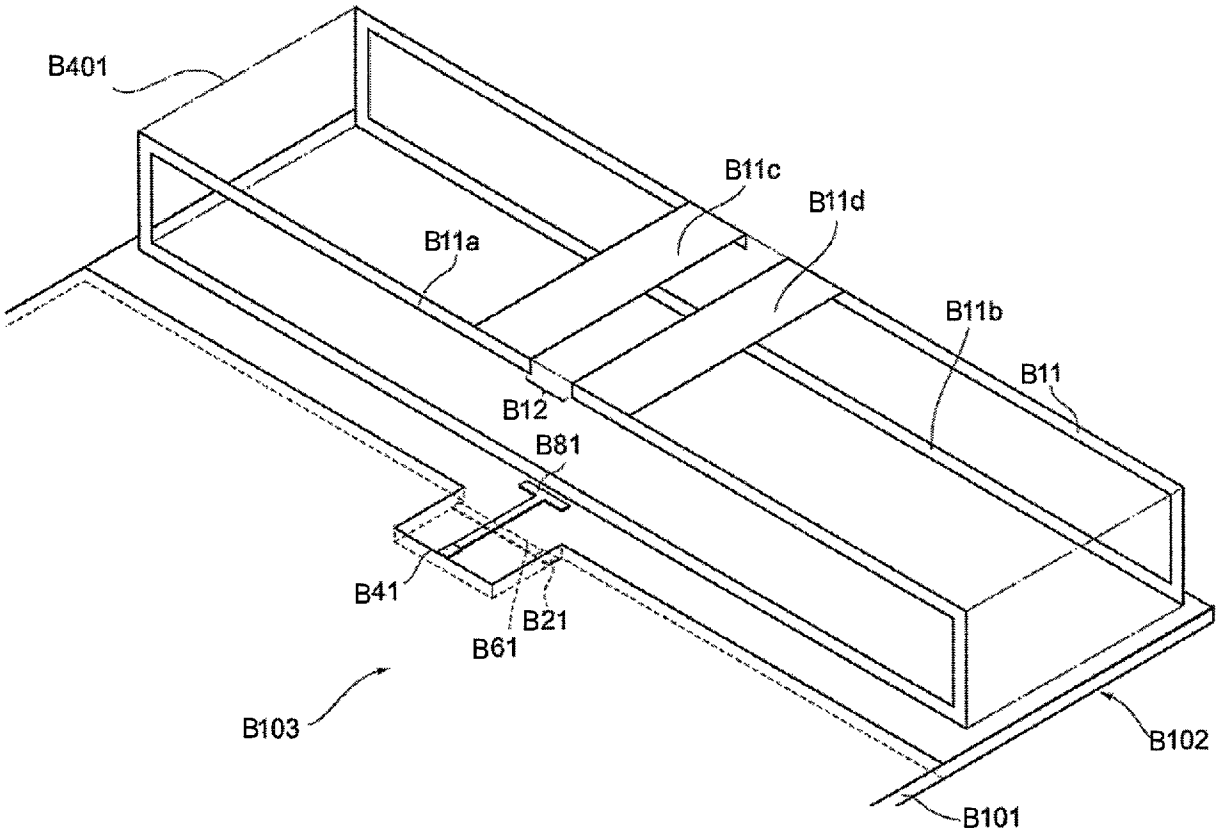
FIG. 29 illustrates details of the antenna device according to the tenth embodiment.

FIG. 28 illustrates a perspective view of an antenna device according to a tenth embodiment. FIG. 29 illustrates a perspective view of details of the antenna device according to the tenth embodiment. An antenna device B8 is characterized in that, in addition to the configuration in which the first and second surfaces in the configuration of the ninth embodiment are the side surfaces of the base body B401 including the sides parallel to the border line and the third surface is the upper surface of the base body B401, the first conductor pattern B11*a* is formed only on the first surface and the second conductor pattern B11*b* is formed only on the second surface. By doing so, the loop-shaped element B11 can be configured to be formed on only three of the six faces of the base body B401. Therefore, production becomes easy.

Eleventh Embodiment

Figure 30:
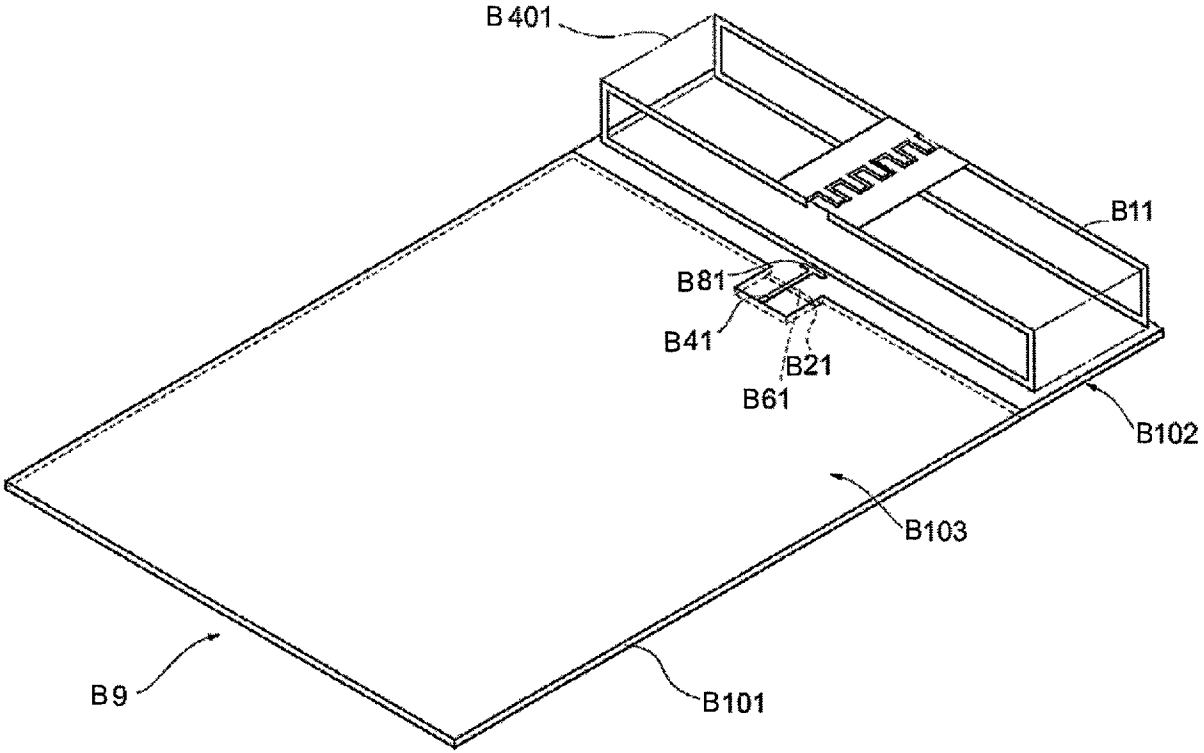
FIG. 30 illustrates a perspective view of an antenna device according to an eleventh embodiment.
Figure 31:
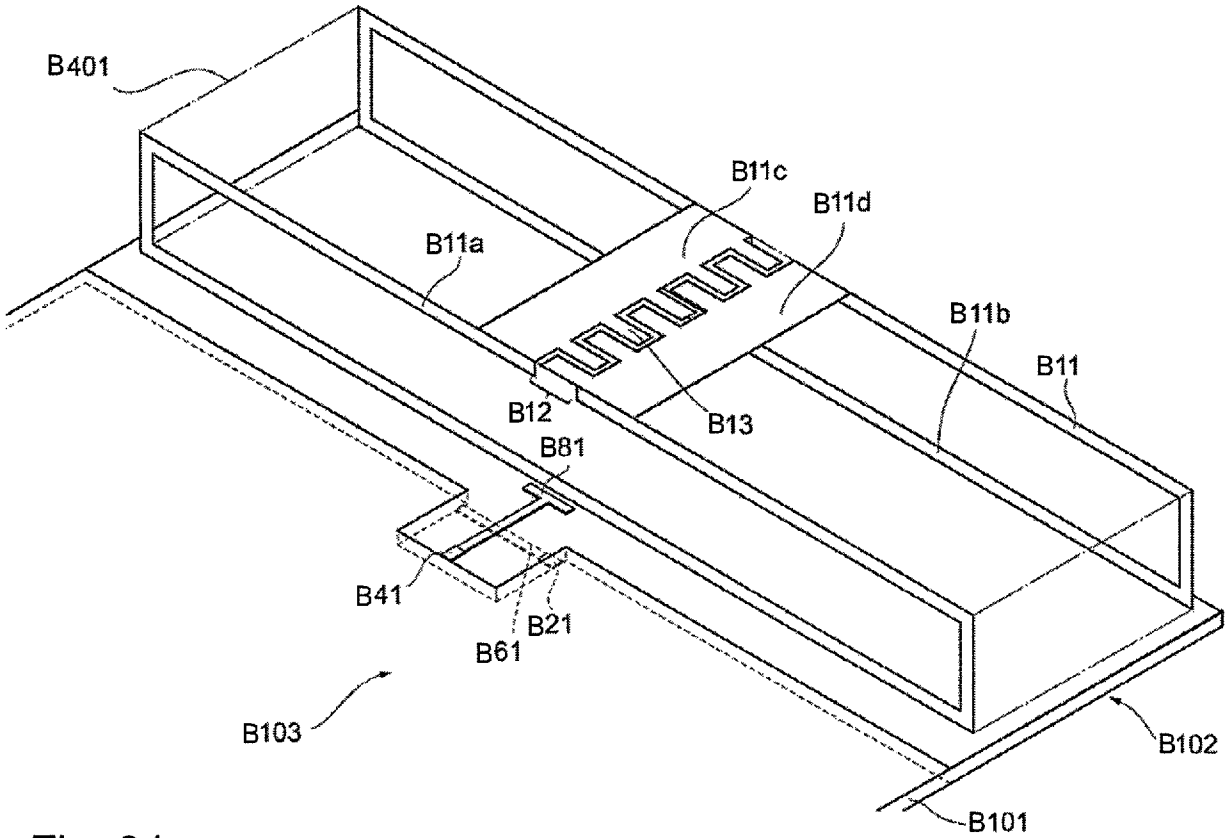
FIG. 31 illustrates details of the antenna device according to the eleventh embodiment.

FIG. 30 illustrates a perspective view of an antenna device according to an eleventh embodiment. FIG. 31 illustrates a perspective view of details of the antenna device according to the eleventh embodiment. In addition to the configuration of the antenna device B8 of the tenth embodiment, An antenna device B9 is characterized in that the opposing area B12 formed by the gap and the first and second spacings has a capacity adjustment section B13. In the present embodiment, the capacity adjustment section B13 is configured by forming a comb structure. In the comb structure, a plurality of projection portions are formed in the opposing areas, these projection portions are fitted each other.

By doing so, the coupling capacitance formed in the opposing area B12 is increased, and greater frequency adjustment becomes possible with respect to the resonance frequency. Further, by adjusting the number and size of the projection portions, fine adjustment of the resonance frequency becomes possible. By providing the capacity adjustment section B13, the loop-shaped element B11 does not satisfy plane symmetry with respect to the first plane B201 at the opposing area B12. However, when the opposing area B12 is so configured that mutually generated capacitances at the opposing area B12 are equal, the electrical symmetry is secured. Therefore, the capacity adjustment section B13 does not negatively influence the isolation characteristics.

In the present embodiment, the capacity adjustment section B13 is formed by the plurality of projection portions. However, the capacity adjustment section B13 may have a different configuration. For example, the opposing area B12 may be configured to have a wave-like shape. The capacity adjustment section B13 may also be configured by inserting a parasitic element to the opposing area B12.

Twelfth Embodiment

Figure 32:
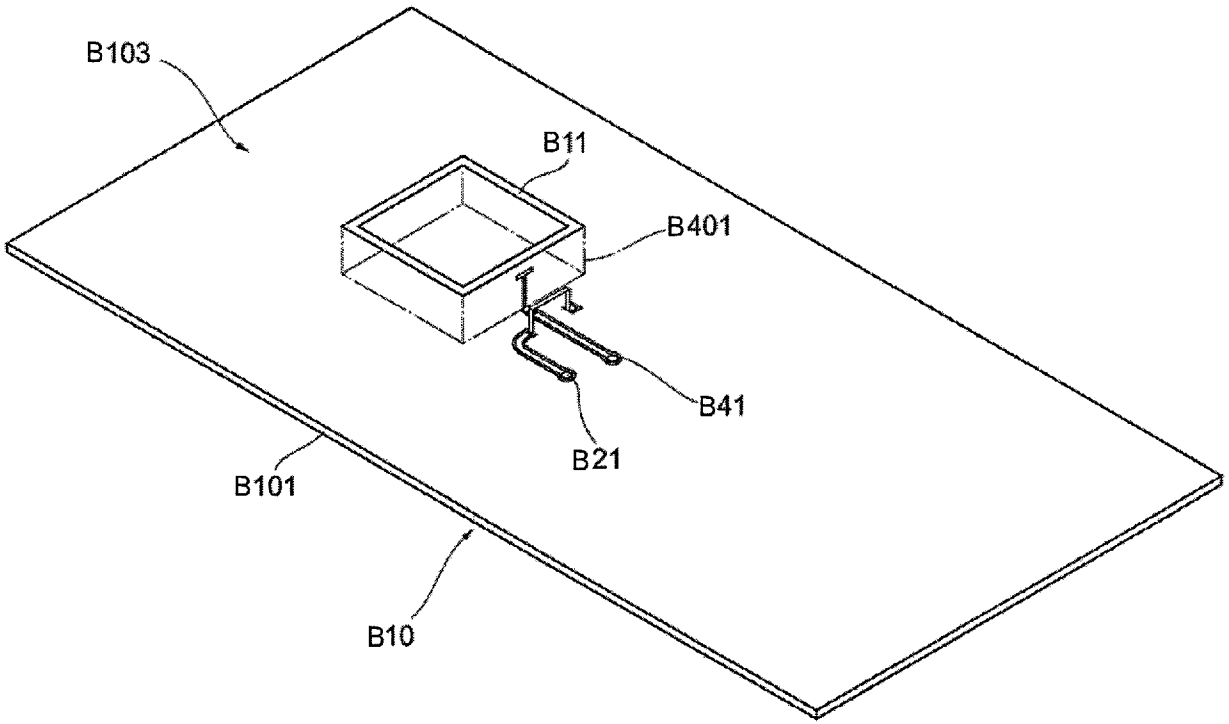
FIG. 32 illustrates a perspective view of an antenna device according to a twelfth embodiment.
Figure 33:
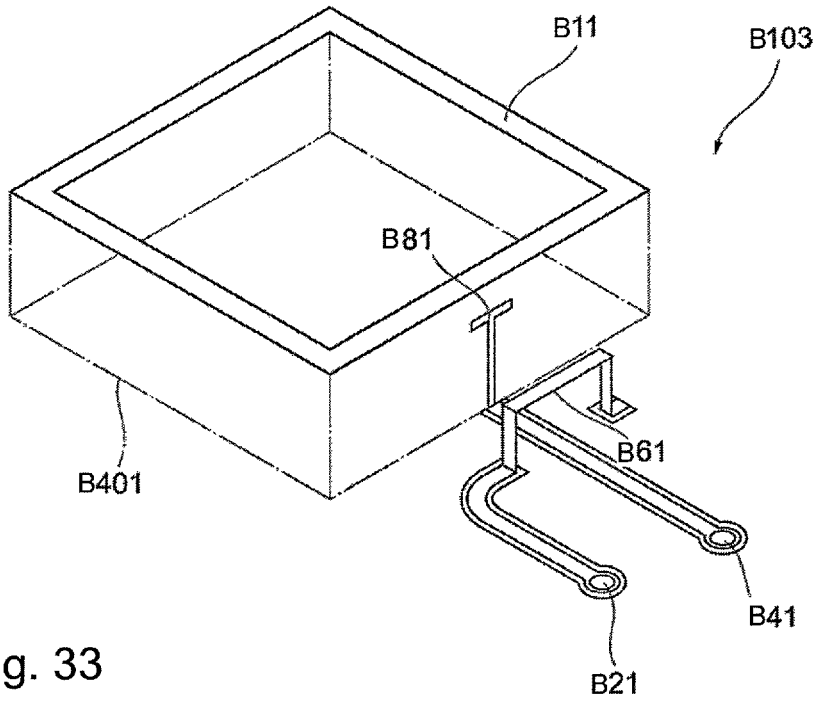
FIG. 33 illustrates details of the antenna device according to the twelfth embodiment.

FIG. 32 illustrates a perspective view of an antenna device according to a twelfth embodiment. FIG. 33 illustrates a perspective view of details of the antenna device according to the twelfth embodiment. An antenna device B10 is characterized in that, in addition to the structure of the antenna device B5 of the seventh embodiment, a portion of the second transmission wire B81 is formed from a conductor pattern formed on the surface of the base body B401. By doing so, the loop-shaped element B11 and the second transmission wire B81 can be integrally formed, which reduces variation in the spacing between the power receiving section and the transmission wire due to mounting variation and which reduces variation in electric field coupling.

In FIG. 32 and FIG. 33, the second transmission wire B81 is formed on the surface of the base body. However, it is also possible that the transmission wire formed on the surface of the base body is the first transmission wire. It is also possible that both the first and second transmission wires are formed on the surface of the base body. It is also possible that only a portion of one of the first and second transmission wires is formed on the surface of the base body.

Example B1

Figure 34:
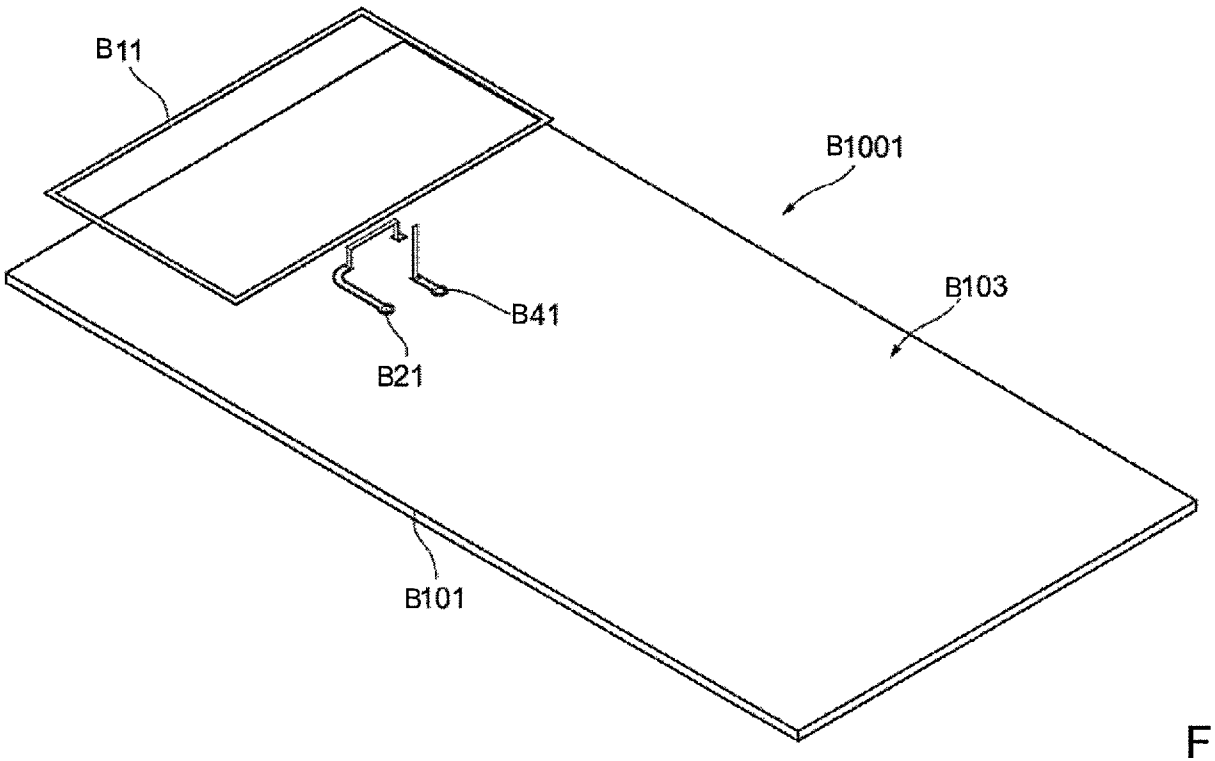
FIG. 34 illustrates an external view of an antenna device according to an example B1.
Figure 35:
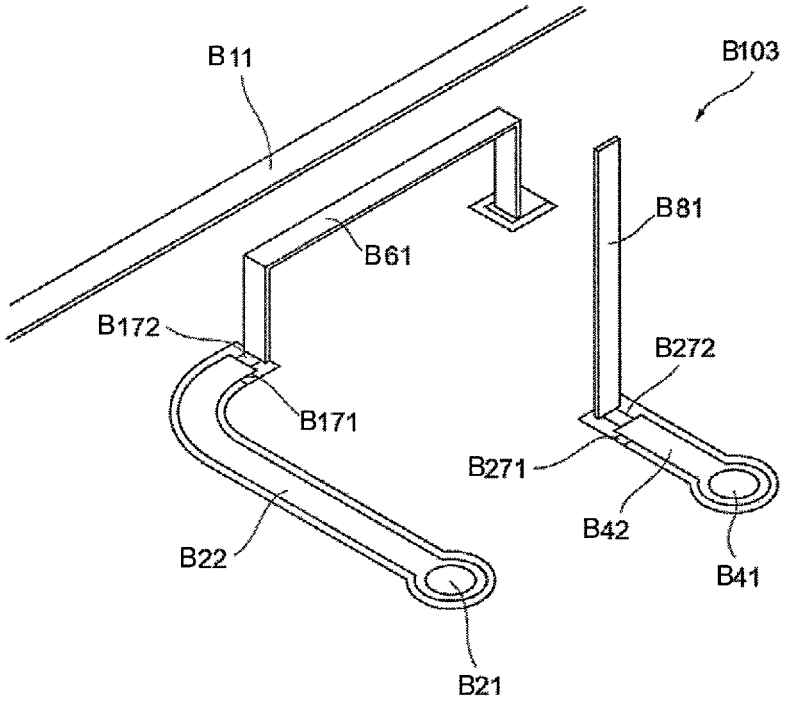
FIG. 35 illustrates details of the antenna device according to the example B1.

FIG. 34 illustrates a perspective view of an antenna device according to an example B1. FIG. 35 illustrates a perspective view of details of the antenna device according to the example B1. The example B1 corresponds to the above-described third embodiment. For simplicity, a loop-shaped element B11 (rectangle of 24×40 mm) having a line width of about 0.5 mm was formed on an evaluation substrate B101 (100 mm×50 mm) modeled after a mounted substrate of a rectangular portable telephone, the entire surface of the evaluation substrate B101 being a ground area B103. The loop-shaped element B11 was arranged at a location 6 mm above the substrate surface, the surface of the loop of the loop-shaped element B11 being parallel to the substrate surface. Short sides of the substrate B101 and long sides of the loop-shaped element B11 were arranged in a parallel manner. One long side of the loop-shaped element B11 was arranged right above a short side of the substrate B101. A central part of the other long side of the loop-shaped element B11 was arranged to be close to a first and a second transmission wires B61 and B81. For resonance frequency adjustment, the loop-shaped element B11 was formed to have a line width of 0.65 mm for the long sides and a line width of 0.5 mm for the short sides.

A first power feeder B21 was formed on the substrate B101 and linked to the vicinity of a power receiving section via a 50-ohm transmission path B22 formed on the substrate B101, where the first power feeder B21 connected to the first transmission wire B61. A serial matching element B172 and a parallel matching element B171 for securing matching were inserted into a connecting section between the 50-ohm transmission path B22 formed on the substrate B101 and the first transmission wire B61.

The first transmission wire B61 formed a substantially C-shaped path that extended from the connecting section with the serial matching element B172 as a base point for 2 mm in a height direction with respect to the substrate surface, and then extended for 6 mm in parallel to the radiation conductor of the power receiving section, and then extended for 2 mm toward the substrate surface to be grounded to the ground area B103 of the substrate B101. A central part of the C-shaped path and the power receiving section were close to each other, and the distance therebetween was 4 mm in the height direction and 1.9 mm in the longitudinal direction of the substrate.

On the other hand, a second power feeder B41 was formed on the substrate surface (or substrate B101) and linked to the vicinity of the power receiving section via a 50-ohm transmission line B42 formed on the substrate B101, where the second power feeder B41 connected to the second transmission wire B81. A serial matching element B272 and a parallel matching element B271 for securing matching were inserted into a connecting section between the 50-ohm transmission line B42 formed on the substrate B101 and the second transmission wire B81. The second transmission wire formed a path that extended from the connecting section with the serial matching element B272 as a base point to a height of 5.5 mm with respect to the substrate surface to form an open end. The open end and the power receiving section were close to each other, and the distance therebetween was 0.5 mm in the height direction and 2.6 mm in the longitudinal direction of the substrate.

Figure 36:
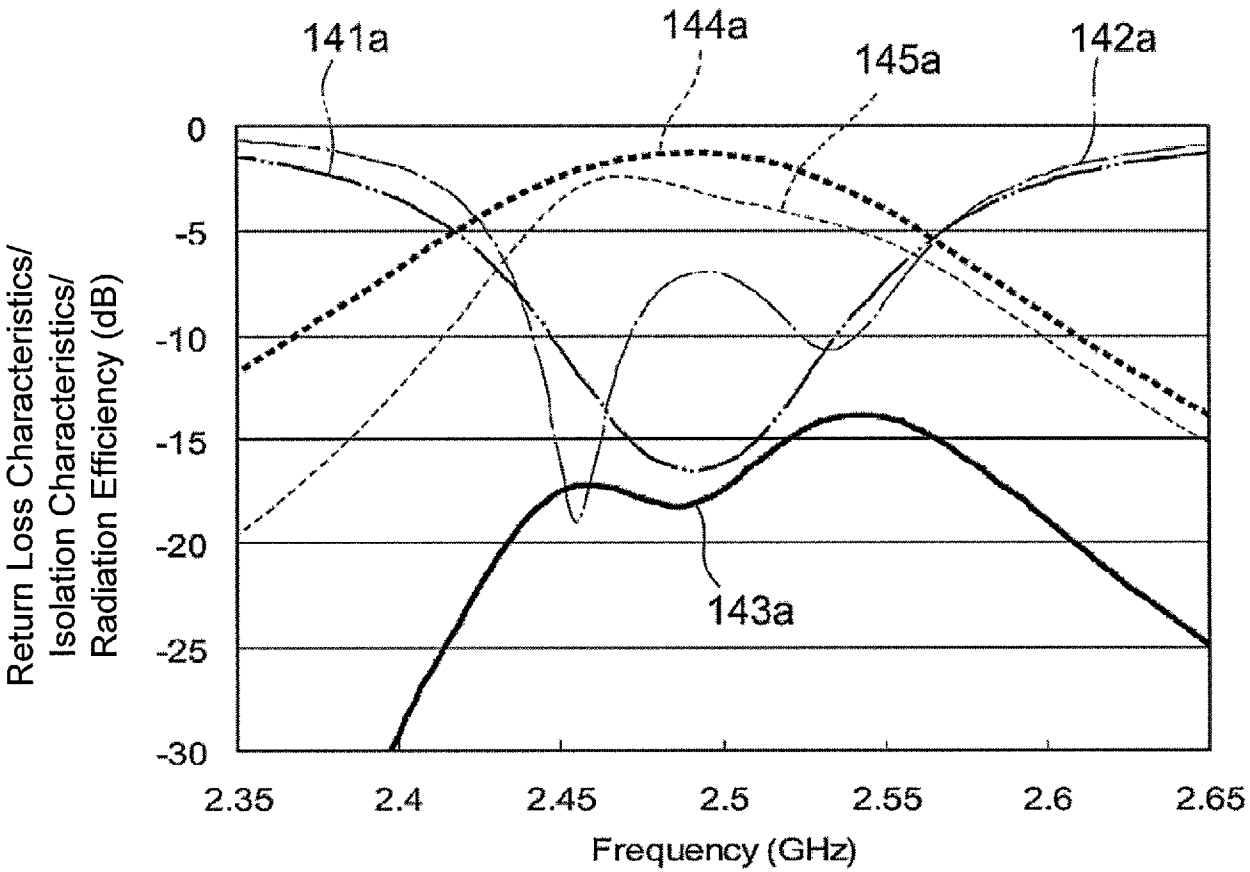
FIG. 36 illustrates electrical characteristics of the antenna device according to the example B1.

FIG. 36 illustrates electrical characteristics of the antenna device according to the example B1. FIG. 36 illustrates reflection (return loss) characteristics 141*a* viewed from the first power feeder B21, reflection (return loss) characteristics 142*a* viewed from the second power feeder B41, transmission (isolation) characteristics 143*a*, and further radiation efficiency 144*a* of radio wave power-fed from the power feeder B21 and radiation efficiency 145*a* of radio wave power-fed from the second power feeder B41.

The resonance frequencies for the cases of exciting from the first and second power feeders are each about 2.5 GHz. The two power feeders are operating with the same frequency. A bandwidth of about 5% for each of the power feeders is secured. It is clear from the isolation characteristics 143*a* that a favorable isolation of about −14 dB or less over a range from 2.35 GHz to 2.65 GHz in the neighborhood of the operating frequency are secured between the two power feeders, that is, between the first power feeder B21 and the second power feeder B41. Favorable radiation characteristics such as that the radiation efficiency 144*a* of the radio wave power-fed from the first power feeder had a maximum of −1.3 dB and that the radiation efficiency 145*a* of the radio wave power-fed from the second power feeder had a maximum of −2.4 dB were obtained.

Figure 37:
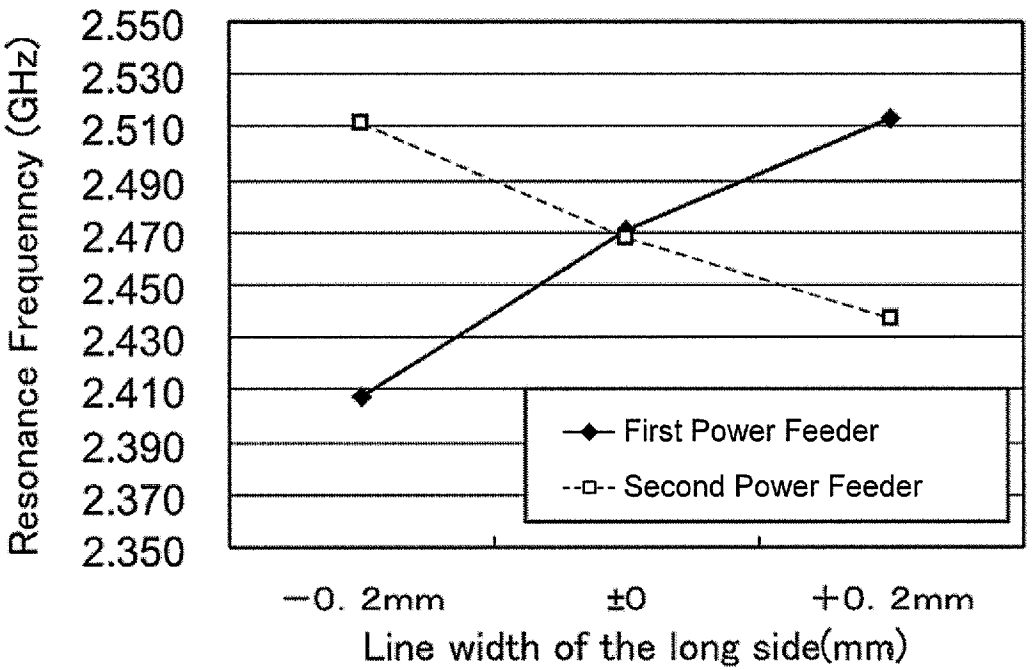
FIG. 37 illustrates relationship between line width and resonance frequency of the antenna device according to the example B1.

FIG. 37 illustrates changes in resonance frequency when the line width of the long sides of the loop-shaped element B11 of the antenna device B1 according to the example B1 was changed by ±0.2 mm. It is clear that, when the line width of the long sides is reduced by 0.2 mm, the resonance frequency of the first power feeder B21 drops by about 63 MHz, and the resonance frequency of the second power feeder B41 goes up by about 44 MHz. On the other hand, it is clear that, when the line width of the long sides is increased by 0.2 mm, the resonance frequency of the first power feeder B21 goes up by about 42 MHz, and the resonance frequency of the second power feeder B41 drops by about 30 MHz. As described above, by adjusting the line width, the resonance frequencies of the first and second power feeders B21 and B41 can be adjusted.

Example B2

Figure 38:
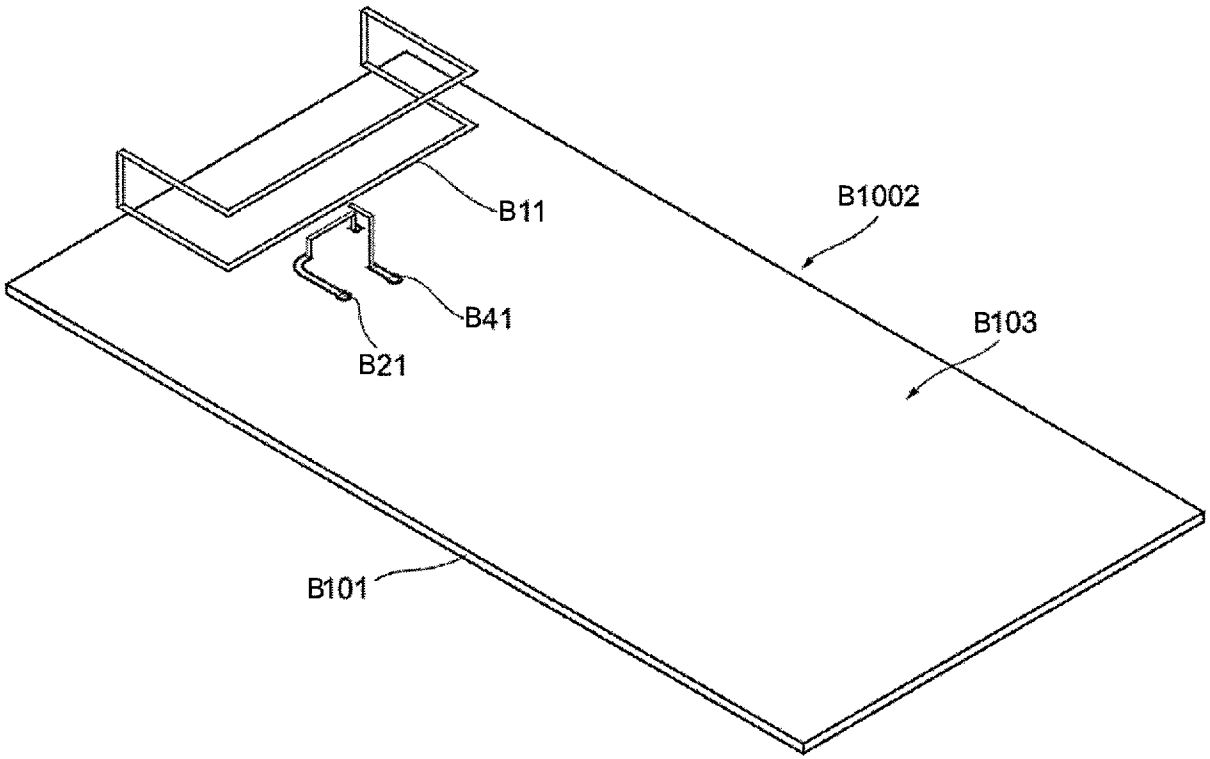
FIG. 38 illustrates an external view of an antenna device according to an example B2.
Figure 39:
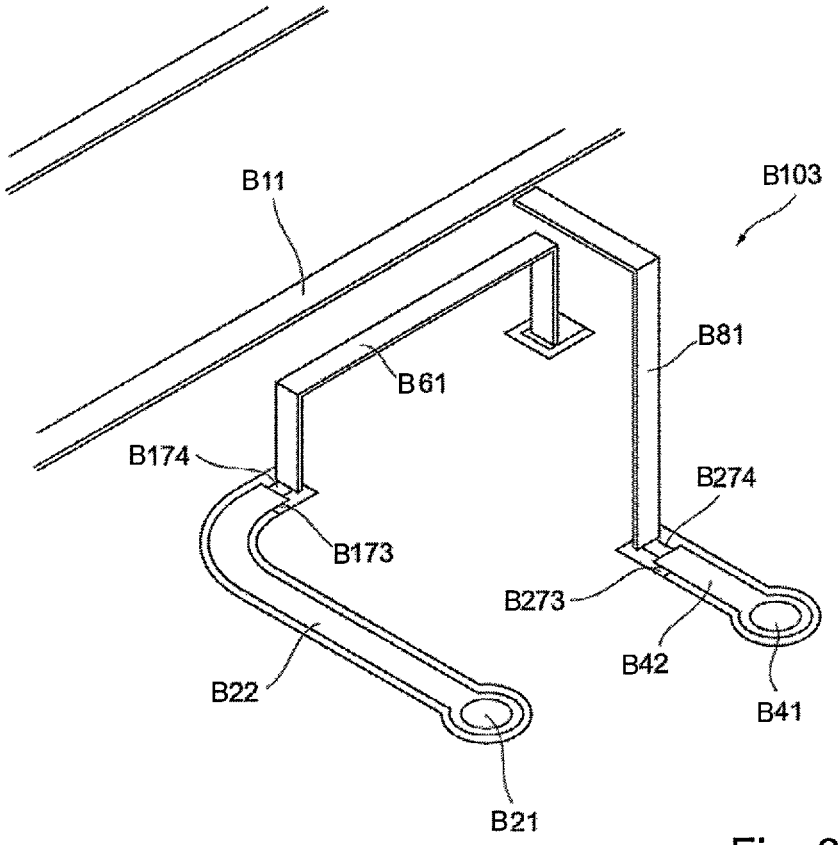
FIG. 39 illustrates details of the antenna device according to the example B2.

FIG. 38 illustrates a perspective view of an antenna device according to an example B2. FIG. 39 illustrates a perspective view of details of the antenna device according to the example B2. The example B2 corresponds to the above-described fourth embodiment. For simplicity, a loop-shaped element B11 was arranged on an evaluation substrate B101 (100 mm×50 mm) modeled after a mounted substrate of a rectangular portable telephone, the entire surface of the evaluation substrate B101 being a ground area B103. The loop-shaped element B11 had a shape formed by folding a substantially rectangular loop-shaped conductor of 31 mm×34 mm in a state in which the substrate surface was parallel to the loop surface, using a line segment connecting centers of the long sides as an axis, for 180 degrees into a C shape. The spacing between opposing folded portions was 6 mm. For frequency adjustment, portions corresponding to the long sides had a line width of 0.5 mm and portions corresponding to the short sides had a line width of 0.55 mm.

A central part of a short side of the loop-shaped element B11 was a power receiving section. The loop-shaped element B11 was arranged in such a manner that the power receiving section was located at a point that was reached by moving in a height direction for 6 mm from a point that was reached by moving from one end of a line segment connecting centers of the short sides of the substrate B101 for 18 mm along the line segment. And, the loop-shaped element B11 was arranged in such a manner that, with respect to the substrate B101, the short sides of the substrate B101 and the short sides of the loop-shaped element B11 were parallel, and that a portion corresponding to the folding axis of the loop-shaped element B11 was located more on an exterior side of the substrate than the power receiving section.

A first power feeder B21 was formed on the substrate B101 and linked to the vicinity of the power receiving section via a 50-ohm transmission path B22 formed on the substrate B101, where the first power feeder B21 connected to a first transmission wire B61. A serial matching element B174 and a parallel matching element B173 for securing matching were inserted into a connecting section between the 50-ohm transmission path B22 formed on the substrate B101 and the first transmission wire B61.

The first transmission wire B61 formed a substantially C-shaped path that extended, from the connecting section with the serial matching element B174 as a base point for 2 mm in the height direction with respect to the substrate surface and then extends for 6 mm in parallel to the radiation conductor of the power receiving section, and then extended for 2 mm toward the substrate surface to be grounded to the ground area B103. A central part of the C-shaped path was arranged to be close to the radiation conductor of the power receiving section, and the distance therebetween was 2 mm in the longitudinal direction of the substrate and 4 mm in the height direction.

On the other hand, a second power feeder B41 formed on the substrate surface and linked to the vicinity of the power receiving section via a 50-ohm transmission line B42 formed on the substrate B101, where the second power feeder B41 connected to a second transmission wire B81. A serial matching element B274 and a parallel matching element B273 for securing matching were inserted into a connecting section between the 50-ohm transmission line B42 formed on the substrate B101 and the second transmission wire B81.

The second transmission wire B81 extended from the connecting section as a base point with the serial matching element B274 to a height of 5.5 mm with respect to the substrate surface and then extended 3 mm toward the power receiving section to form an open end. The open end was arranged to be close to the radiation conductor of the power receiving section, and the distance therebetween was 0.5 mm in the height direction.

Figure 40:
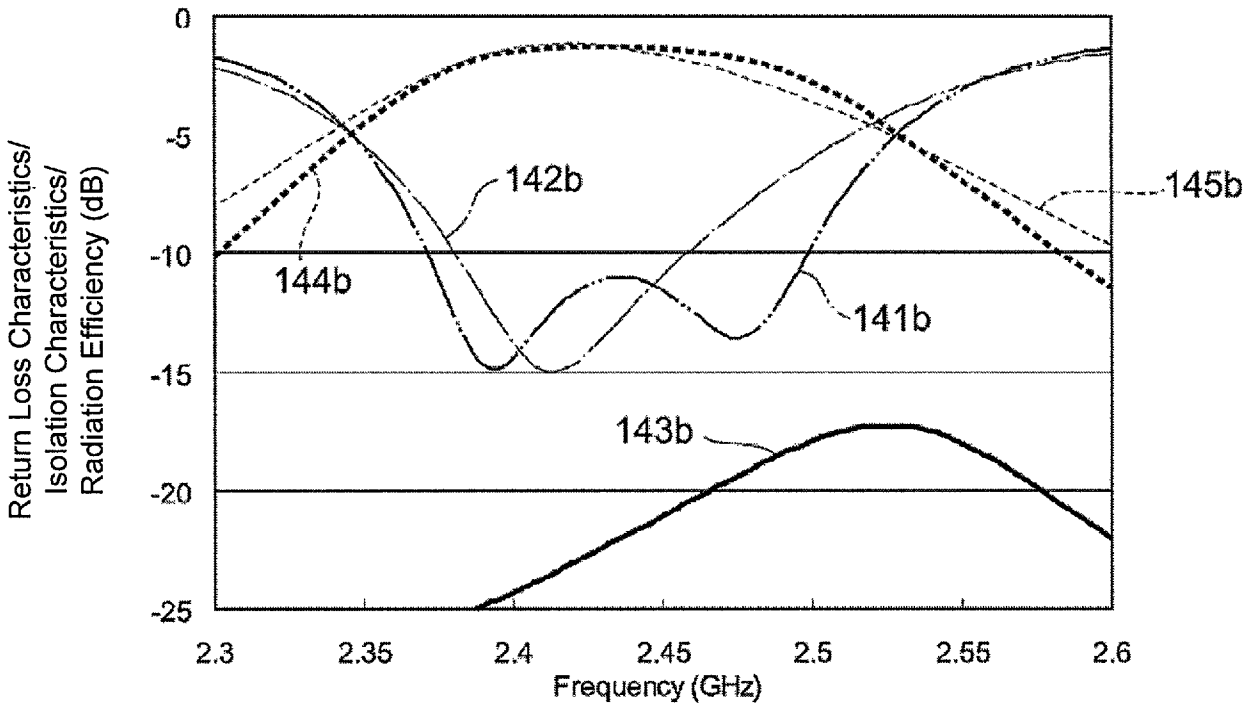
FIG. 40 illustrates electrical characteristics of the antenna device according to the example B2.

FIG. 40 illustrates electrical characteristics of the antenna device according to the example B2. FIG. 40 illustrates reflection (return loss) characteristics 141*b* viewed from the first power feeder B21, reflection (return loss) characteristics 142*b* viewed from the second power feeder B41, transmission (isolation) characteristics 143*b*, and further radiation efficiency 144*b* of radio wave power-fed from the power feeder B21 and radiation efficiency 145*b* of radio wave power-fed from the second power feeder B41. The resonance frequencies for the cases of exciting from the first and second power feeders were each about 2.43 GHz. The two power feeders operated with the same frequency. A bandwidth of about 6.8% for the first power feeder and a band width of about 6.0% for the second power feeder were secured.

It was confirmed from the characteristics 143*b* that a favorable isolation of about −17 dB or less was obtained over a range from 2.3 GHz to 2.6 GHz in the neighborhood of the operating frequency. Favorable radiation characteristics such as that the radiation efficiency 144*b* of the radio wave power-fed from the first power feeder had a peak value of −1.3 dB and that the radiation efficiency 145*b* of the radio wave power-fed from the second power feeder had a peak value of about −1.2 dB were obtained.

Example B3

Figure 41:
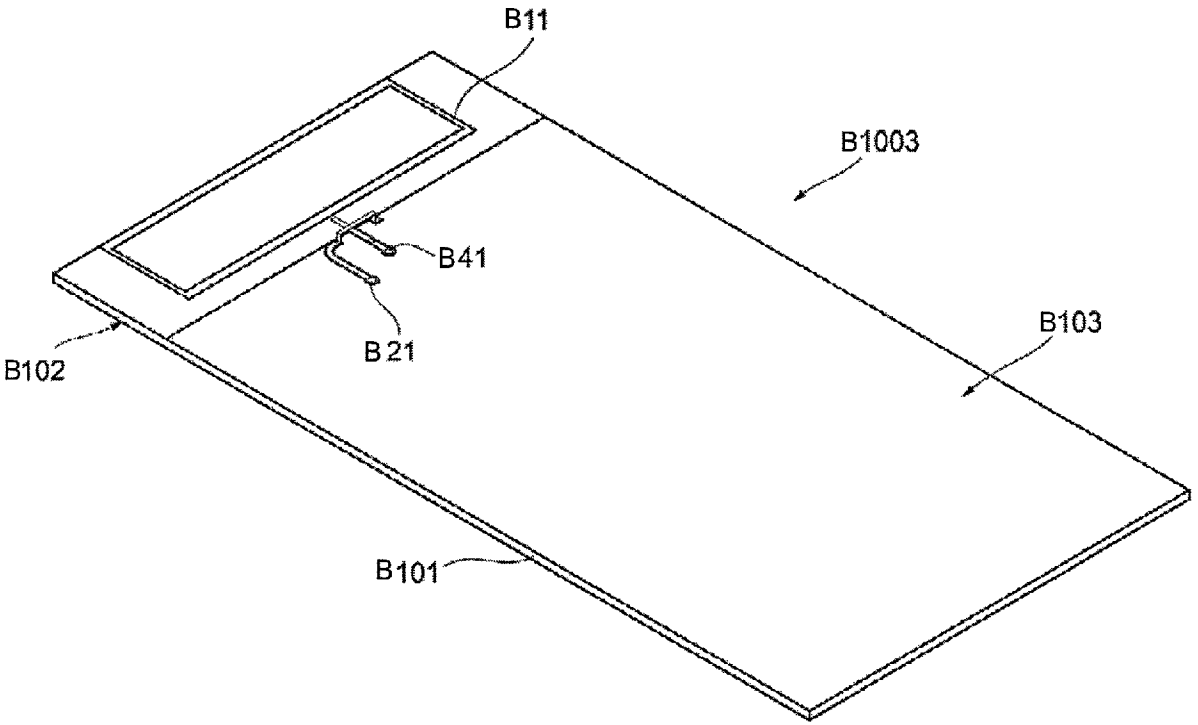
FIG. 41 illustrates an external view of an antenna device according to an example B3.
Figure 42:
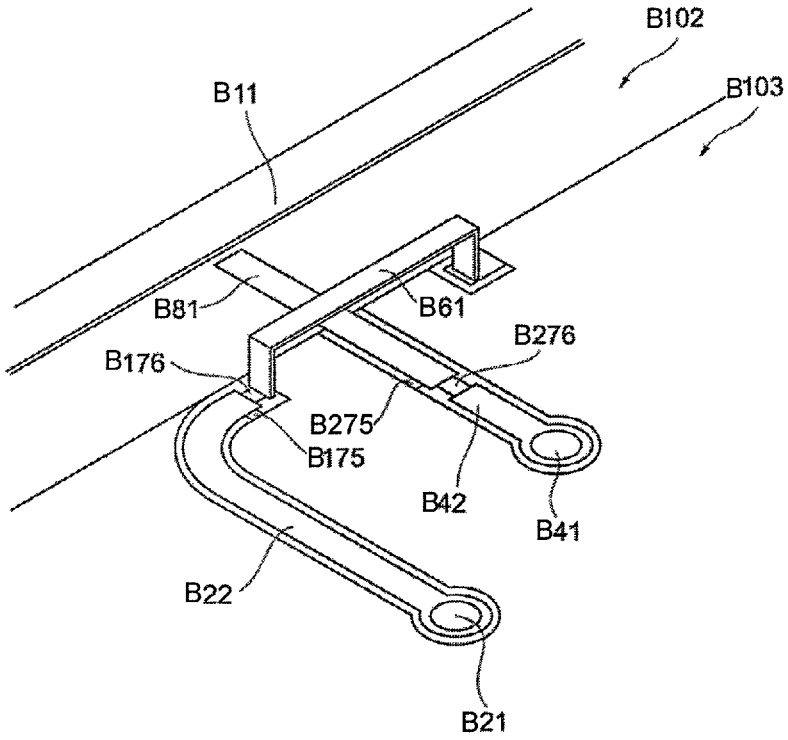
FIG. 42 illustrates details of the antenna device according to the example B3.

FIG. 41 illustrates a perspective view of an antenna device according to an example B3. FIG. 42 illustrates a perspective view of details of the antenna device according to the example B3. The example B3 corresponds to the above-described fifth embodiment. For simplicity, a portion (15×50 mm) of an evaluation substrate B101 (100 mm×50 mm) including a short side thereof was provided as a non-ground area B102 that did not have a ground conductor, the evaluation substrate B101 being modeled after a mounted substrate of a rectangular portable telephone and being formed mainly from a ground area B103. A loop-shaped element B11 having a rectangular shape (12×38 mm) was prepared by a substrate pattern on the non-ground area B102.

The loop-shaped element B11 was arranged at a central part of the non-ground area B102 in a manner that the long sides of the loop-shaped element B11 were parallel to short sides of the substrate. Of the rectangular loop-shaped element B11, a central part of a side opposing the ground area B103 was a power receiving section. A first and a second transmission wires B61 and B81 were arranged to be close to the power receiving section. For frequency adjustment, the loop-shaped element B11 was formed to have a line width of 1.2 mm for the long sides and a line width of 0.5 mm for the short sides.

A first power feeder B21 was formed on the substrate B101, was connected to the vicinity of a central part of a border line with the non-ground area B102 via a 50-ohm transmission path B22 formed on the substrate B101, and at this point was connected to the first transmission wire B61. A serial matching element B176 and a parallel matching element B175 for securing matching were inserted into a connecting section between the transmission path B22 formed on the substrate B101 and the first transmission wire B61.

The first transmission wire B61 formed a substantially C-shaped path that extended from the connecting section with the serial matching element B176 as a base point for 1 mm in the height direction with respect to the substrate surface, then extended for 5 mm parallel to the radiation conductor of the power receiving section, and then extended for 1 mm toward the substrate surface to be grounded to the ground area B103 of the substrate B101. A central part of the C-shaped path and the power receiving section were close to each other, and the distance therebetween was 1 mm in the height direction and 3 mm in the longitudinal direction of the substrate.

On the other hand, the second power feeder B41 was formed on the substrate surface, was linked to the vicinity of the central part of the border line with the non-ground area B102 via a 50-ohm transmission line B42 formed on the substrate B101, and at this position was connected to the second transmission wire B81. A serial matching element B276 and a parallel matching element B275 for securing matching were inserted into a connecting section between the 50-ohm transmission line B42 formed on the substrate B101 and the second transmission wire B81.

The second transmission wire B81 was formed by a substrate pattern, and formed a path that extended from the connecting section with the parallel matching element B275 as a base point for 4.2 mm in the longitudinal direction of the substrate to form an open end. The open end and the power receiving section were close to each other, and the distance therebetween was 0.2 mm in the longitudinal direction of the substrate.

Figure 43:
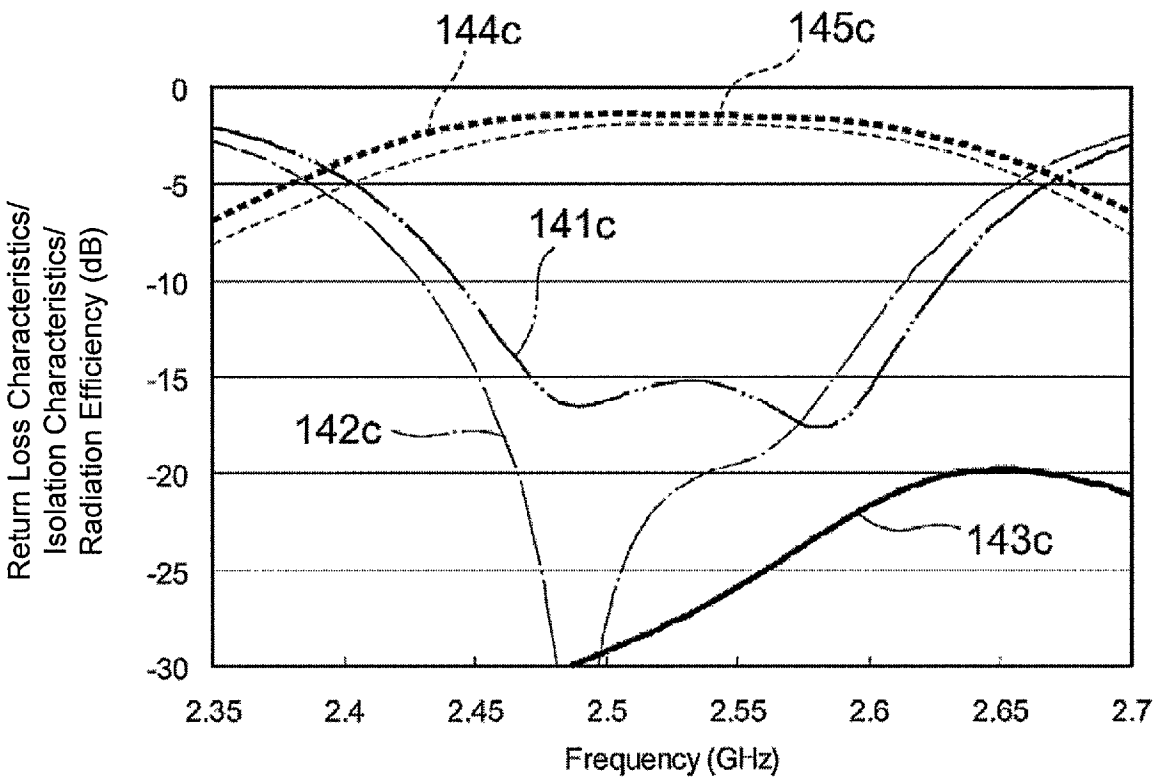
FIG. 43 illustrates electrical characteristics of the antenna device according to the example B3.

FIG. 43 illustrates electrical characteristics of the antenna device according to the example B3. FIG. 43 illustrates reflection (return loss) characteristics 141*c* viewed from the first power feeder B21, reflection (return loss) characteristics 142*c* viewed from the second power feeder B41, transmission (isolation) characteristics 143*c*, and further radiation efficiency 144*c* of radio wave power-fed from the power feeder B21 and radiation efficiency 145*c* of radio wave power-fed from the second power feeder B41. Resonance frequencies for the cases of exciting from the first and second power feeders were each about 2.53 GHz. The two power feeders operated with the same frequency. A bandwidth of about 10% for each of the power feeders was secured.

It is clear from the solid line 143*c* that favorable isolation characteristics of about −20 dB or less over a range from 2.35 GHz to 2.7 GHz in the neighborhood of the operating frequency were secured between the two power feeders, that is, between the first power feeder B21 and the second power feeder B41. Favorable radiation characteristics such as that the radiation efficiency 144*c* of the radio wave power-fed from the first power feeder had a maximum of −1.4 dB and that the radiation efficiency 145*c* of the radio wave power-fed from the second power feeder had a maximum of −1.9 dB were obtained.

Example B4

Figure 44:
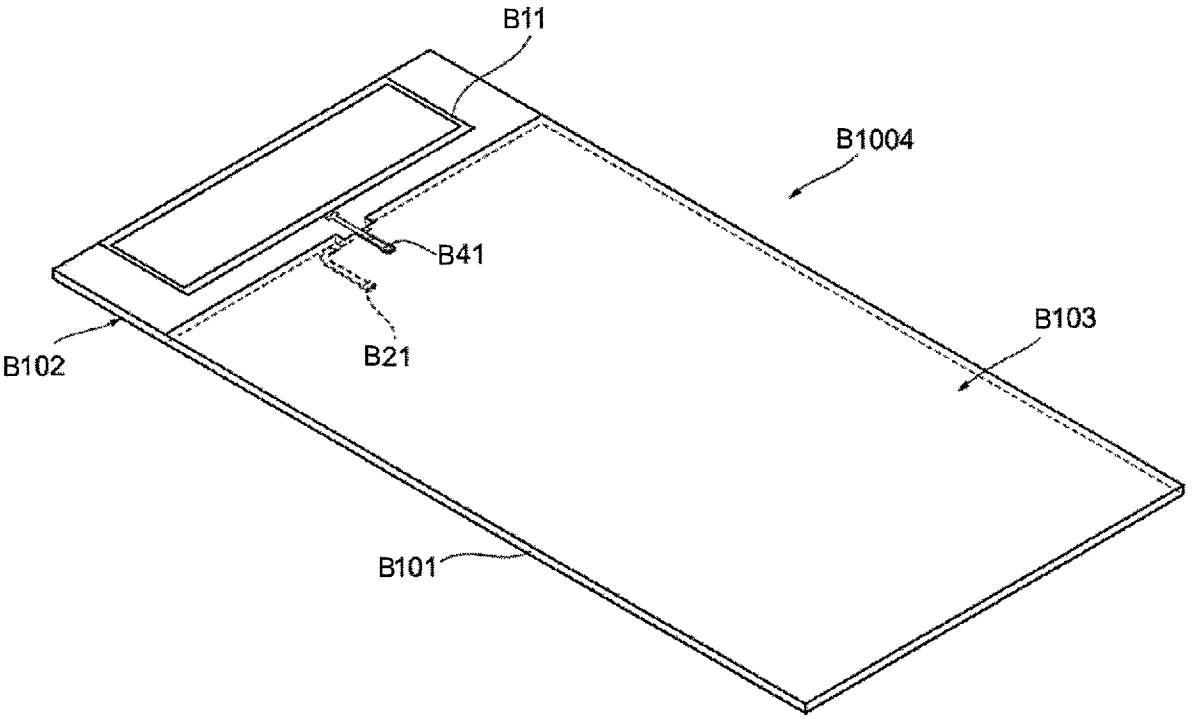
FIG. 44 illustrates an external view of an antenna device according to an example B4.
Figure 45:
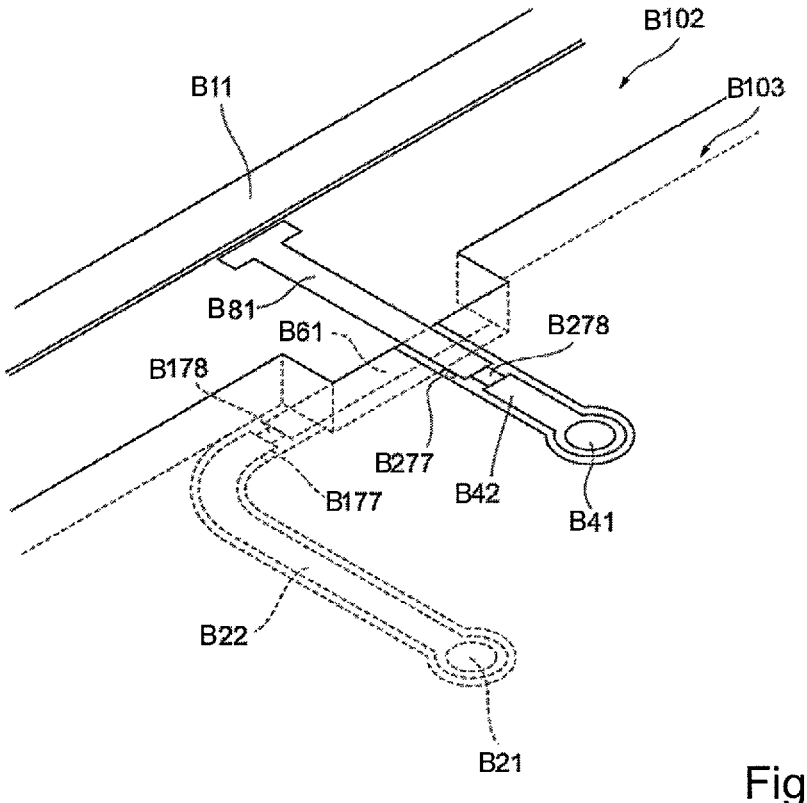
FIG. 45 illustrates details of the antenna device according to the example B4.

FIG. 44 illustrates a perspective view of an antenna device according to an example B4. FIG. 45 illustrates a perspective view of details of the antenna device according to the example B4. The example B4 corresponds to the above-described sixth embodiment. For simplicity, a portion (15×50 mm) of an evaluation substrate B101 (100 mm×50 mm) including a short side thereof was provided as a non-ground area B102, the evaluation substrate B101 being modeled after a mounted substrate of a rectangular portable telephone and being formed mainly from a ground area B103. A loop-shaped element B11 having a rectangular shape (12×38 mm) was prepared by a substrate pattern on the non-ground area B102.

The loop-shaped element B11 was arranged at a central part of the non-ground area B102 in a manner that the long sides of the loop-shaped element B11 were parallel to the short sides of the substrate. Of the rectangular loop-shaped element B11, a central part of a side opposing the ground area B103 was a power receiving section. A first and a second transmission wires B61 and B81 were arranged to be close to the power receiving section. For frequency adjustment, the loop-shaped element B11 was formed to have a line width of 1.2 mm for the long sides and a line width of 0.5 mm for the short sides.

A first power feeder B21 was formed on the substrate B101, was linked to the vicinity of a central part of a border line with the non-ground area via a 50-ohm transmission path B22 formed by a substrate pattern on a back surface of the substrate B101, and at this point was connected to the first transmission wire B61. A serial matching element B178 and a parallel matching element B177 for securing matching were inserted into a connecting section between the 50-ohm transmission path B22 formed on the substrate B101 and the first transmission wire B61.

The first transmission wire B61 was formed by the substrate pattern on the back surface of the substrate, and formed a path that extended from the connecting section with the serial matching element B178 as a base point for 5 mm parallel to the radiation conductor of the power receiving section to be grounded to the ground area B103 of the substrate B101. At a portion where the first transmission wire was formed, a portion of 4×1.3 mm of a ground conductor was cut off to form a non-ground area. A central part of the first transmission wire B61 and the power receiving section were close to each other, and the distance therebetween was 1 mm in the height direction and 3 mm in the longitudinal direction of the substrate.

On the other hand, a second power feeder B41 was formed on the substrate surface, was connected to the central part of the border line with the non-ground area via a 50-ohm transmission line B42 formed by a substrate pattern on the surface of the substrate B101, and at this position was connected to the second transmission wire B81. A serial matching element B278 and a parallel matching element B277 for securing matching were inserted into a connecting section between the 50-ohm transmission line B42 and the second transmission wire B81.

The second transmission wire was formed by a substrate pattern of a surface, formed a path that extended from the connecting section with the serial matching element B278 as a base point for 4.4 mm in the longitudinal direction of the substrate to form a T-shaped open end. The open end and the power receiving section were close to each other, and the distance therebetween was 0.1 mm in the longitudinal direction of the substrate.

Figure 46:
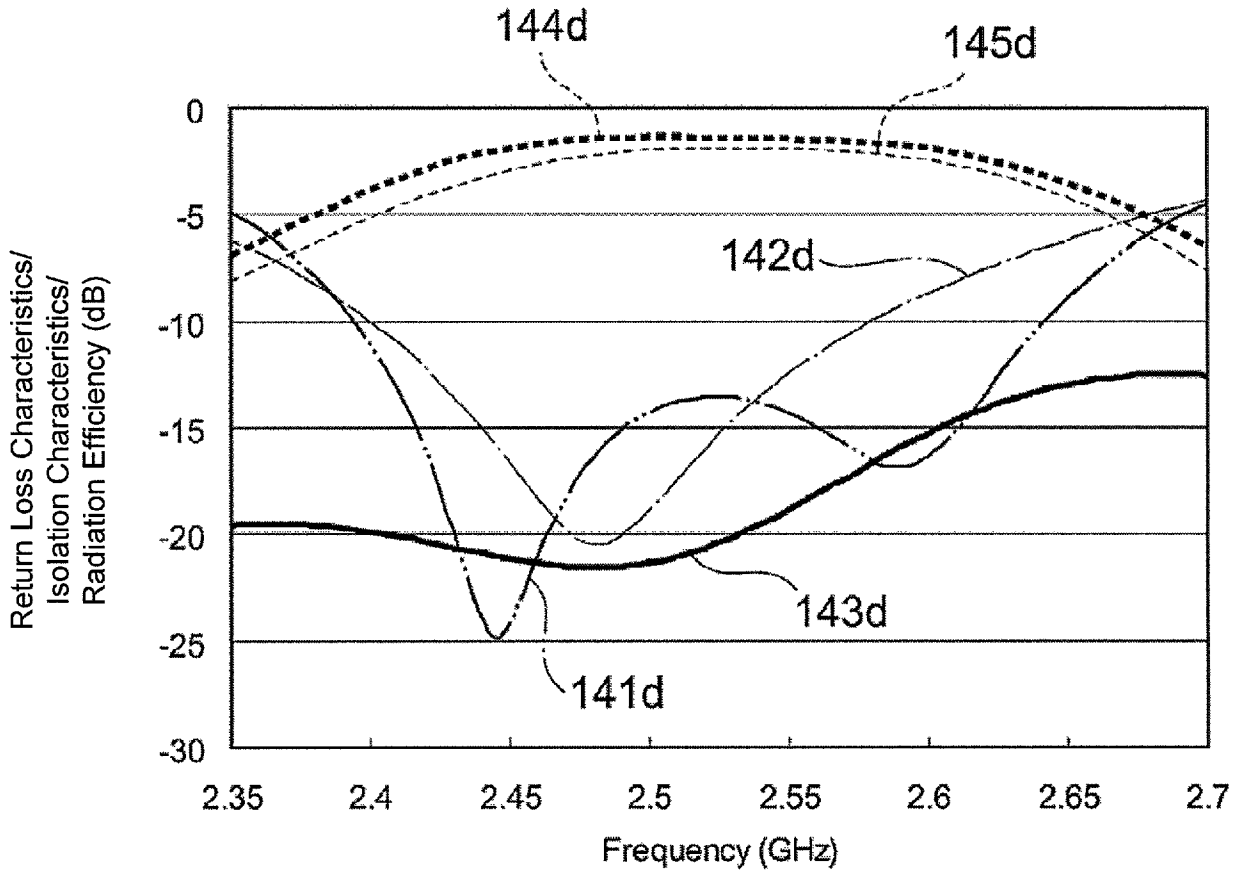
FIG. 46 illustrates electrical characteristics of the antenna device according to the example B4.

FIG. 46 illustrates electrical characteristics of the antenna device according to the example B4. FIG. 46 illustrates reflection (return loss) characteristics 141*d* viewed from the first power feeder B21, reflection (return loss) characteristics 142*d* viewed from the second power feeder B41, transmission (isolation) characteristics 143*d*, and further radiation efficiency 144*d* of radio wave power-fed from the first power feeder B21 and radiation efficiency 145*d* of radio wave power-fed from the second power feeder B41.

Resonance frequencies for the cases of exciting from the first and second power feeders were each about 2.5 GHz. The two power feeders operated with the same frequency. A bandwidth of about 12% for each of the power feeders was secured. It is clear from the isolation characteristics 143*d* that favorable isolation characteristics of about −12.5 dB or less over a range from 2.35 GHz to 2.7 GHz in the neighborhood of the operating frequency were secured between the two power feeders, that is, between the first power feeder B21 and the second power feeder B41. Favorable radiation characteristics such as that the radiation efficiency 144*d* of the radio wave power-fed from the first power feeder had a maximum of −1.4 dB and that the radiation efficiency 145*d* of the radio wave power-fed from the second power feeder had a maximum of −1.9 dB were obtained.

Example B5

Figure 47:
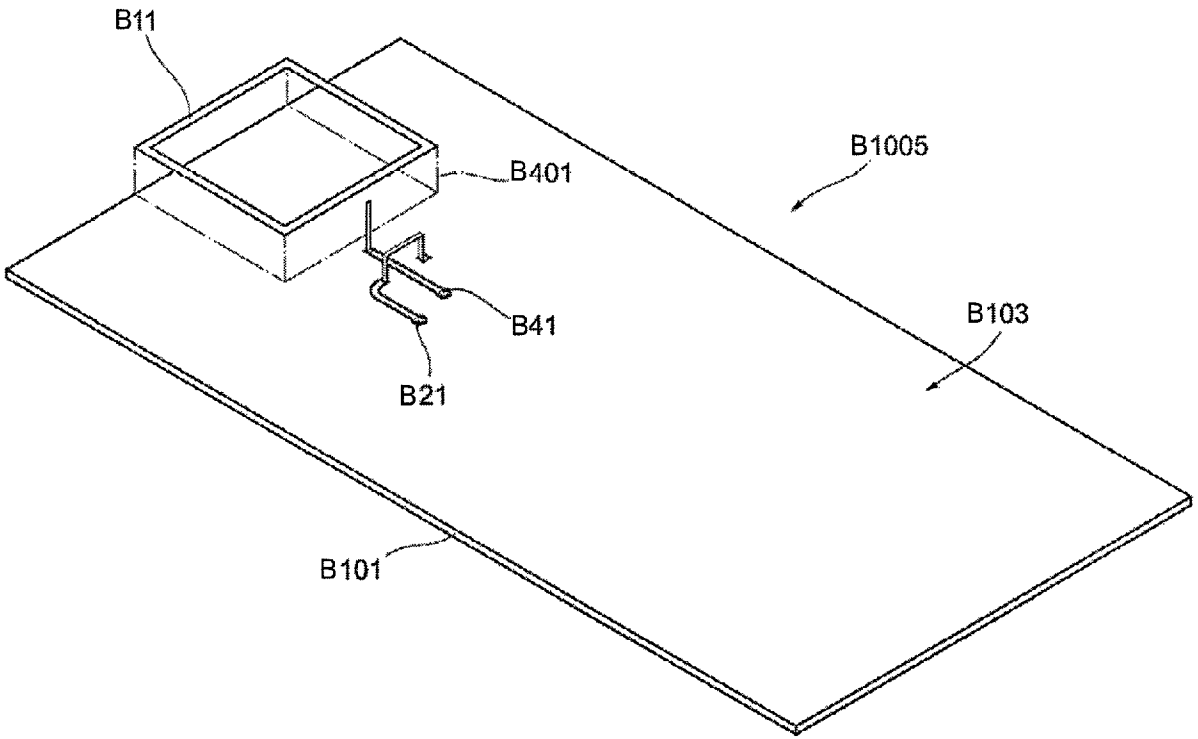
FIG. 47 illustrates an external view of an antenna device according to an example B5.
Figure 48:
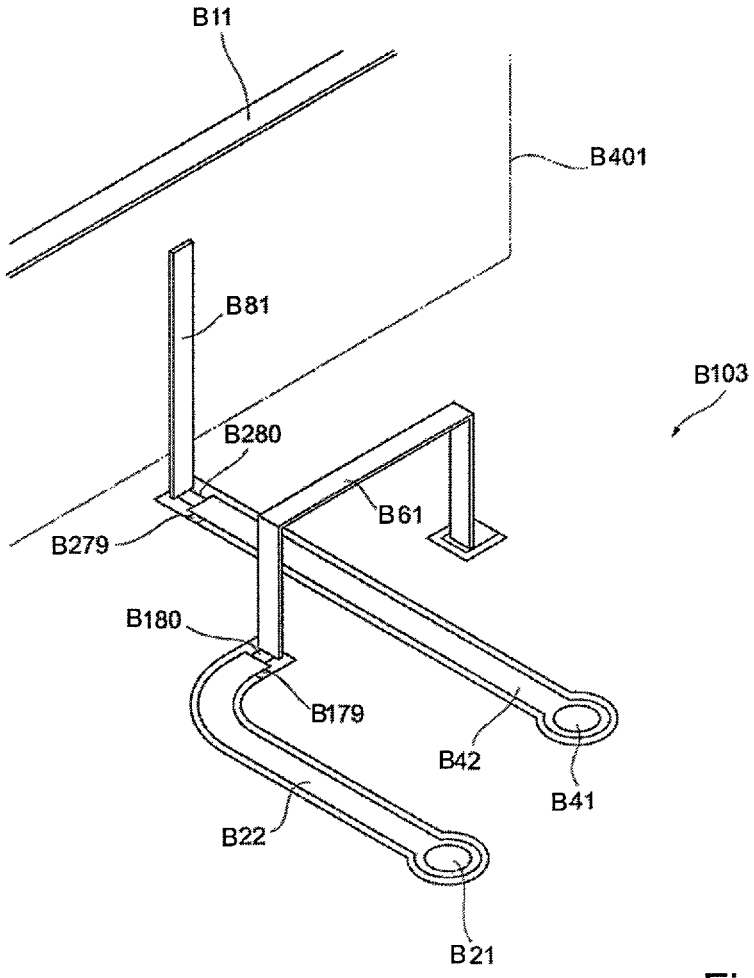
FIG. 48 illustrates details of the antenna device according to the example B5.

FIG. 47 illustrates a perspective view of an antenna device according to an example B5. FIG. 48 illustrates a perspective view of details of the antenna device according to the example B5. The example B5 corresponds to the above-described seventh embodiment. For simplicity, a base body B401 having a shape of a cuboid (19×19×6 mm) was arranged on an evaluation substrate B101 (100 mm×50 mm) modeled after a mounted substrate of a rectangular portable telephone, and the entire surface of the evaluation substrate B101 was formed from a ground area B103. Further, a rectangular (19×19 mm) loop-shaped element B11 having a line width of about 0.5 mm was prepared on an upper surface of the base body B401 along an edge line.

The base body B401 was arranged with respect to the substrate B101 at a central part of a short side of the substrate in a manner that one of the side surfaces of the base body B401 was right above the short side of the substrate B101. Of the loop-shaped element B11 formed on the upper surface of the base body B401, a central part of a side located in the interior of the substrate B101 was a power receiving section. A first and a second transmission wires B61 and B81 were arranged to be close to the power receiving section. For frequency adjustment, the loop-shaped element B11 was formed to have a line width of 0.57 mm for portions parallel to the short sides of the substrate B101 and a line width of 0.5 mm for portions parallel to the long sides of the substrate B101.

A first power feeder B21 was formed on the substrate B101, was linked to the vicinity of the power receiving section via a 50-ohm transmission path B22 formed on the substrate B101, and at this position was connected to the first transmission wire B61. A parallel matching element B179 and a serial matching element B180 for securing matching were inserted into a connecting section between the 50-ohm transmission path B22 formed on the substrate B101 and the first transmission wire B61.

The first transmission wire B61 formed a substantially C-shaped path that extended from the connecting section with the serial matching element B180 as a base point for 3 mm in a height direction with respect to the substrate surface, then extended for 5 mm parallel to the radiation conductor of the power receiving section, and then extended for 3 mm toward the substrate surface to be grounded to a ground area B103 of the substrate B101. A central part of the C-shaped path and the power receiving section were close to each other, and the distance therebetween was 3 mm in the height direction and 5.5 mm in the longitudinal direction of the substrate.

On the other hand, a second power feeder B41 was formed on the substrate B101, was linked to the vicinity of the power receiving section via a 50-ohm transmission line B42 formed on the substrate B101, and at this position was connected to the second transmission wire B81. A serial matching element B280 and a parallel matching element B279 for securing matching were inserted into a connecting section between the 50-ohm transmission line B42 formed on the substrate B101 and the second transmission wire B81.

The second transmission wire formed a path that extended from the connecting section with the serial matching element B280 to a height of 5 mm with respect to the substrate surface to form an open end. The open end and the power receiving section were close to each other, and the distance therebetween was 1 mm in the height direction and 1 mm in the longitudinal direction of the substrate.

Figure 49:
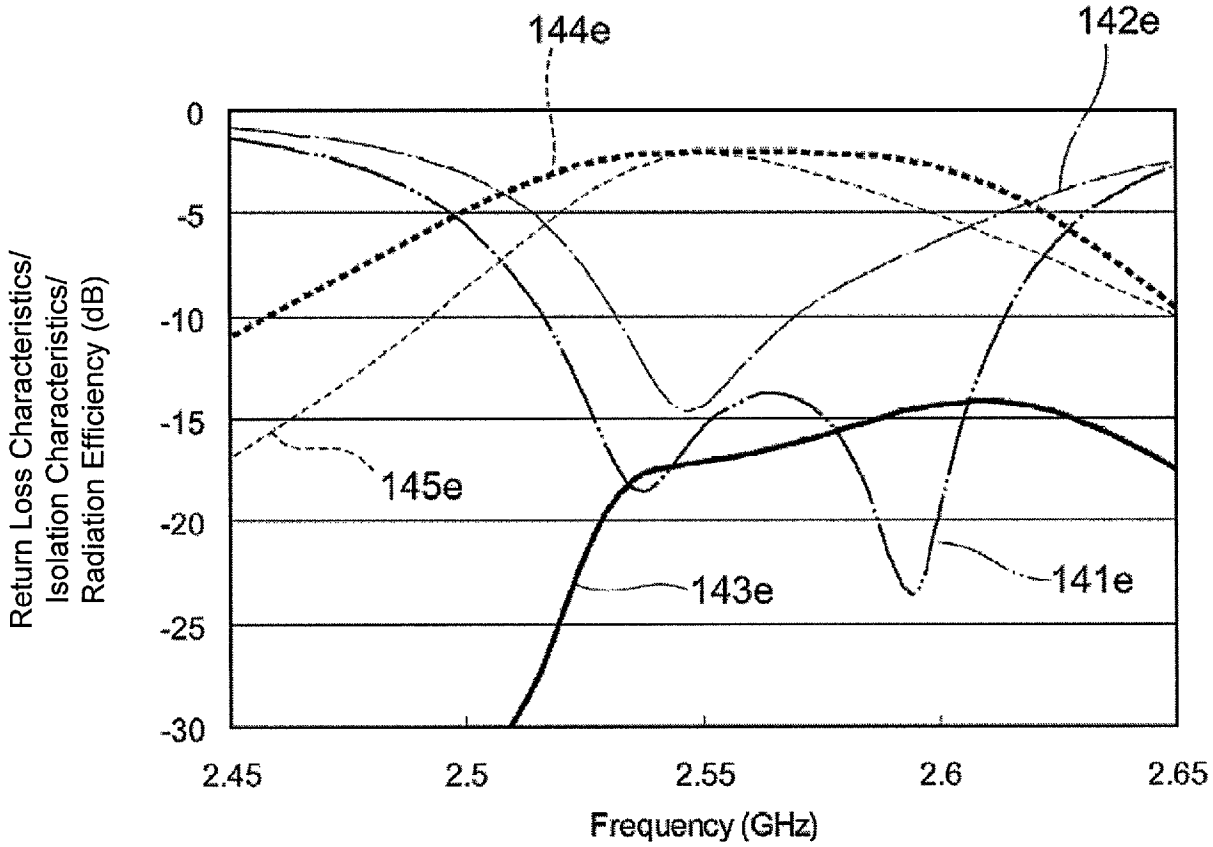
FIG. 49 illustrates electrical characteristics of the antenna device according to the example B5.

FIG. 49 illustrates electrical characteristics of the antenna device according to the example B5. FIG. 49 illustrates reflection (return loss) characteristics 141*e* viewed from the first power feeder B21, reflection (return loss) characteristics 142*e* viewed from the second power feeder B41, transmission (isolation) characteristics 143*e*, and further radiation efficiency 144*e* of radio wave power-fed from the power feeder B21 and radiation efficiency 145*e* of radio wave power-fed from the second power feeder B41.

Resonance frequencies for the cases of exciting from the first and second power feeders were each about 2.56 GHz. The two power feeders operated with the same frequency. A bandwidth of about 5% for the first power feeder B21 and a band width of about 3.5% for the second power feeder B41 were secured. It is clear from the isolation characteristics 143*e* that favorable isolation characteristics of about −14.2 dB or less over a range from 2.45 GHz to 2.65 GHz in the neighborhood of the operating frequency were secured between the two power feeders, that is, between the first power feeder B21 and the second power feeder B41. Favorable radiation characteristics such as that the radiation efficiency 144*e* of the radio wave power-fed from the first power feeder had a maximum of −2.0 dB and that the radiation efficiency 145*e* of the radio wave power-fed from the second power feeder had a maximum of −2.1 dB were obtained.

Example B6

Figure 50:
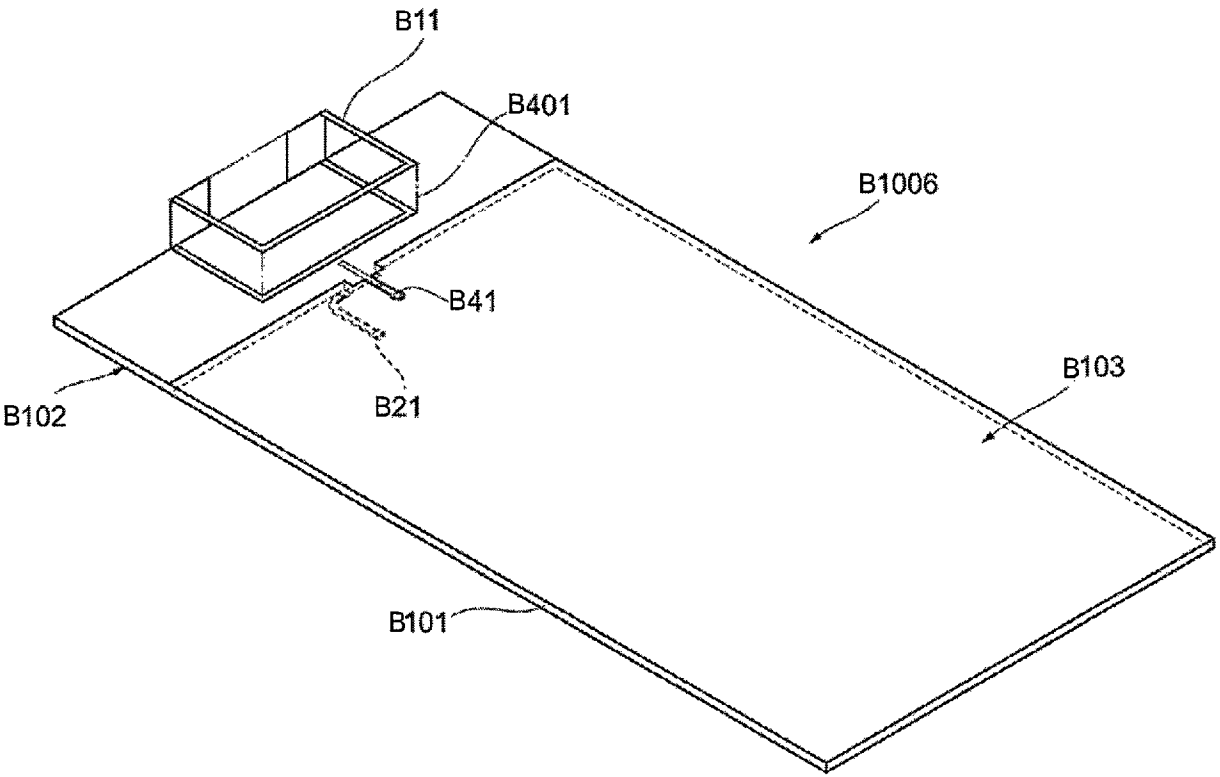
FIG. 50 illustrates an external view of an antenna device according to an example B6.
Figure 51:
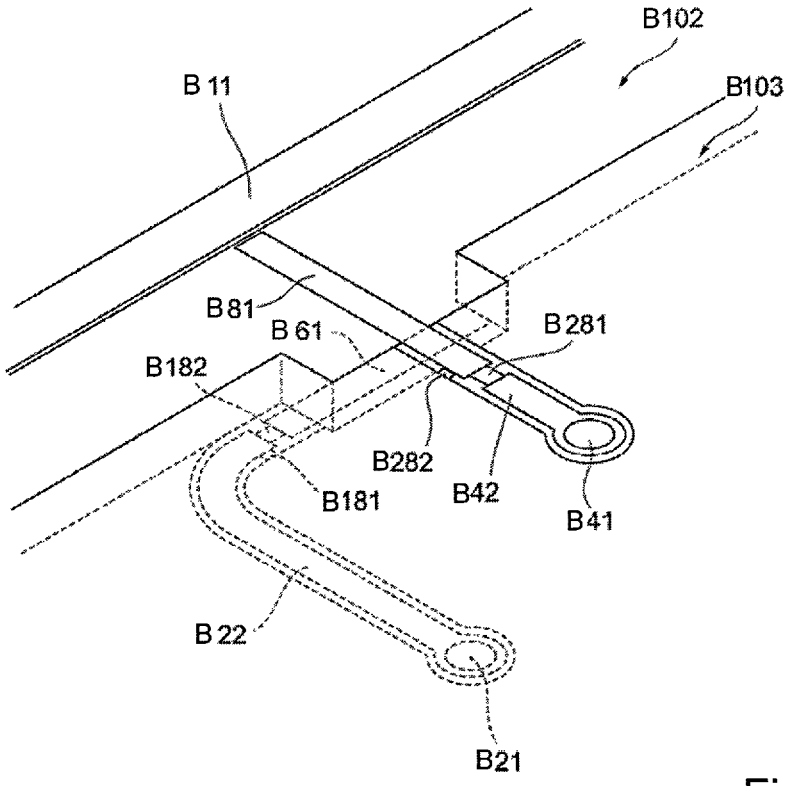
FIG. 51 illustrates details of the antenna device according to the example B6.

FIG. 50 illustrates a perspective view of an antenna device according to an example B6. FIG. 51 illustrates a perspective view of details of the antenna device according to the example B6. The example B6 corresponds to the above-described eighth embodiment. For simplicity, a non-ground area B102 was provided on an area of 15×50 mm at an end portion of an evaluation substrate B101 (100 mm×50 mm) including a short side thereof, the evaluation substrate B101 being modeled after a mounted substrate of a rectangular portable telephone and being mostly formed from a ground area B103. A base body B401 (12×20×5 mm) formed from a dielectric material was arranged on the non-ground area B102. A loop-shaped element B11 was arranged on the surface of the base body B401. The loop-shaped element B11 had a shape formed by folding a substantially rectangular loop-shaped conductor of 20×29 mm along a line segment connecting centers of the long sides as an axis by 180 degrees into a C shape. The loop-shaped element B11 was arranged along edge lines of the surface of the base body. For frequency adjustment, portions of the loop-shaped element B11 formed on a side surface of the base body had a line width of 4.9 mm and other portions had a line width of 0.5 mm.

The base body B401 was arranged at a central part of the non-ground area in such an orientation that the longitudinal direction of the base body B401 was parallel to the short sides of the substrate B101, and was arranged 3 mm away from the ground area. A radiation conductor formed on a central part of a side of the bottom surface of the base body B401, the side opposing the ground area B103, was a power receiving section. A first and a second transmission wires B61 and B81 were arranged to be close to the power receiving section.

A first power feeder B21 was formed on the ground area B103 of the substrate B101, was connected to a central part of a border line with the non-ground area B102 via a 50-ohm transmission path B22 formed by a substrate pattern on a back surface of the substrate B101, and at this position was connected to the first transmission wire B61 formed by a substrate pattern on the back surface of the substrate B101. A serial matching element B182 and a parallel matching element B181 for securing matching were inserted into a connecting section between the transmission path B22 and the first transmission wire B61. The first transmission wire B61 formed a path that extended from the connecting section with the serial matching element B182 for 4 mm parallel to the radiation conductor of the power receiving section to be grounded to the ground area B103 of the substrate B101. A central part of the path and the power receiving section were arranged to be close to each other, and the distance therebetween was about 1 mm in the height direction and 3 mm in the longitudinal direction of the substrate. A portion of 4×1.3 mm of the substrate, where the first transmission wire was formed, was cut off.

On the other hand, a second power feeder B41 was formed on the ground area B103 of the substrate B101, was connected to a central part of a border line with the non-ground area B102 via a 50-ohm transmission line B42 formed by a substrate pattern on a surface of the substrate B101, and was connected to the second transmission wire B81 formed by a substrate pattern on a surface of the substrate B101. A serial matching element B281 and a parallel matching element B282 for securing matching were inserted into a connecting section between the 50-ohm transmission line B42 formed on the substrate B101 and the second transmission wire B81.

The second transmission wire B81 was formed by a substrate pattern on the surface of the substrate B101, and forms a path that extended from the connecting section with the parallel matching element B282 as a base point for 4.7 mm in the longitudinal direction of the substrate to form an open end. The open end and the power receiving section were close to each other, and the distance therebetween was 0.1 mm in the longitudinal direction of the substrate B101.

Figure 52:
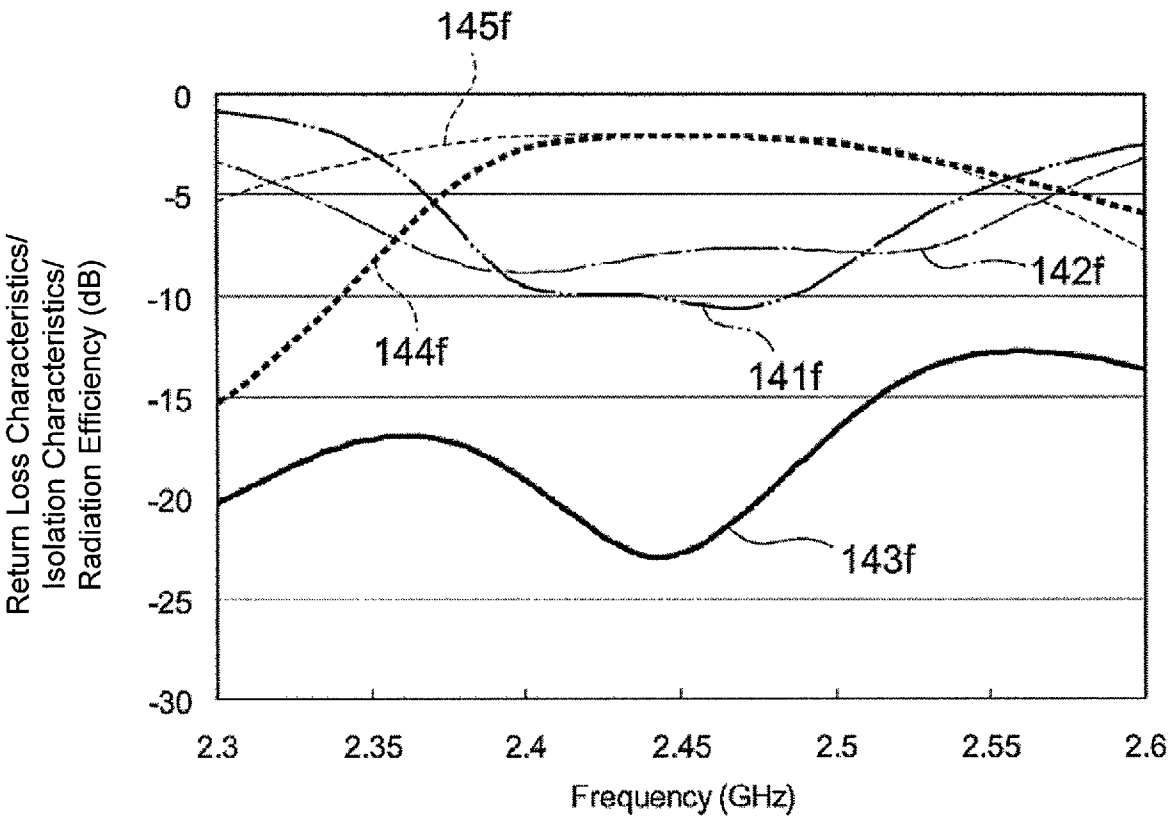
FIG. 52 illustrates electrical characteristics of the antenna device according to the example B6.

FIG. 52 illustrates electrical characteristics of the antenna device according to the example B6. FIG. 52 illustrates reflection (return loss) characteristics 141*f* viewed from the first power feeder B21, reflection (return loss) characteristics 142*f* viewed from the second power feeder B41, transmission (isolation) characteristics 143*f*, and further radiation efficiency 144*f* of radio wave power-fed from the power feeder B21 and radiation efficiency 145*f* of radio wave power-fed from the second power feeder B41.

Resonance frequencies for the cases of exciting from the first and second power feeders were each about 2.45 GHz. The two power feeders operated with the same frequency. A bandwidth of about 6% for the first power feeder and a band width of about 9% for the second power feeder were secured. It is clear from the isolation characteristics 143*f* that favorable isolation characteristics of about −12.7 dB or less over a range from 2.3 GHz to 2.6 GHz in the neighborhood of the operating frequency were secured between the two power feeders, that is, between the first power feeder B21 and the second power feeder B41. Favorable radiation characteristics such as that the radiation efficiency 144*f* of the radio wave power-fed from the first power feeder had a maximum of −2.1 dB and that the radiation efficiency 145*f* of the radio wave power-fed from the second power feeder had a maximum of −2.0 dB were obtained.

Example B7

Figure 53:
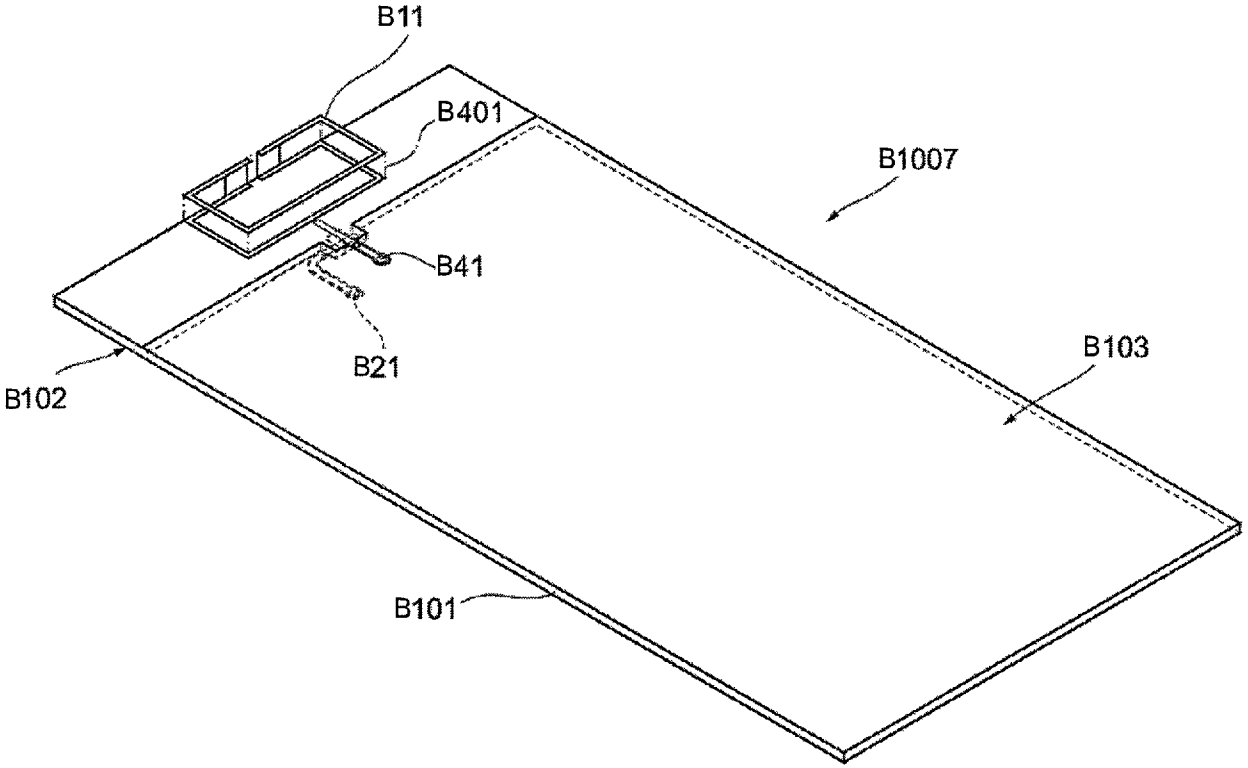
FIG. 53 illustrates an external view of an antenna device according to an example B7.
Figure 54:
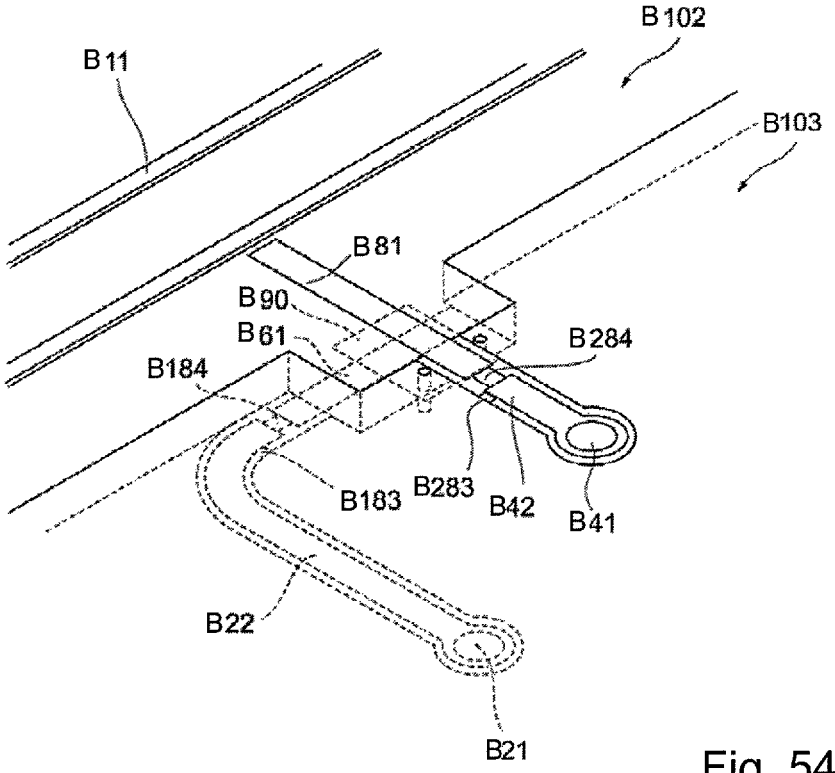
FIG. 54 illustrates details of power feeders of the antenna device according to the example B7.
Figure 55:
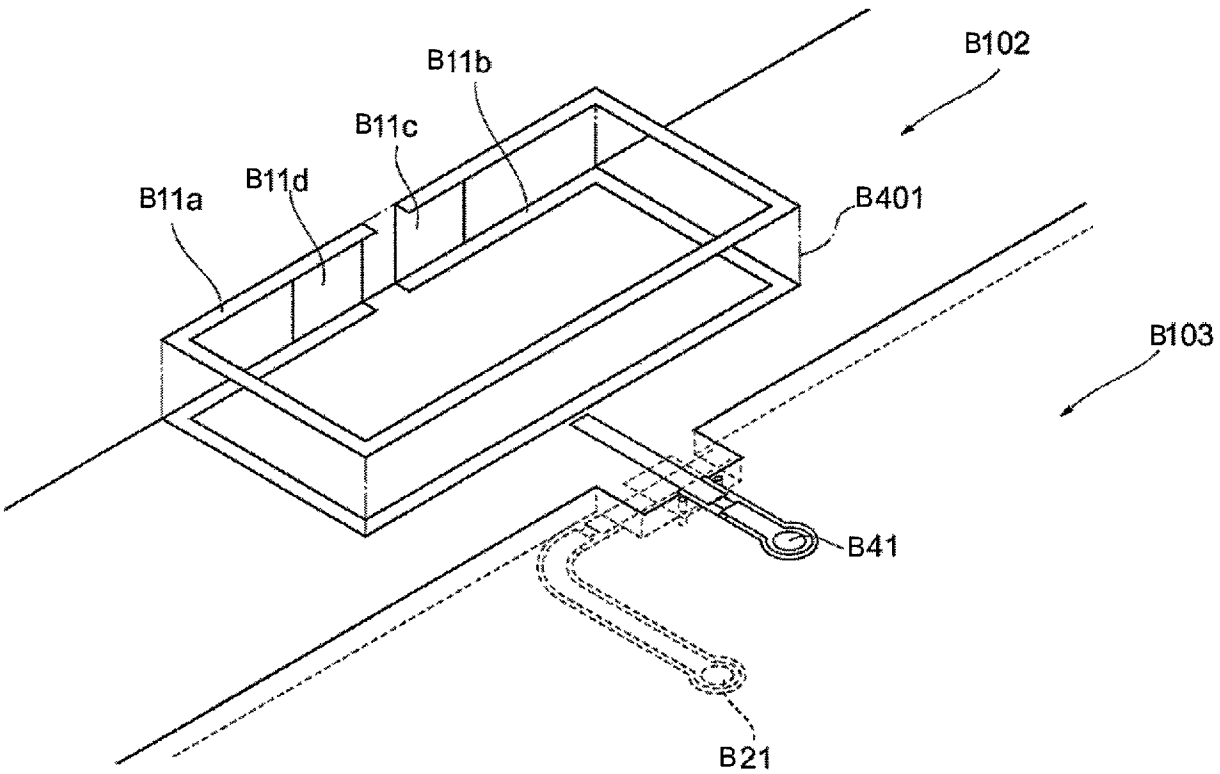
FIG. 55 illustrates of details a loop-shaped element of the antenna device according to the example B7.

FIG. 53 illustrates a perspective view of an antenna device according to an example B7. FIG. 54 illustrates a perspective view of details of power feeders of the antenna device according to the example B7. FIG. 55 illustrates a perspective view of details of a loop-shaped element of the antenna device according to the example B7. The example B7 corresponds to the above-described tenth embodiment.

For simplicity, a non-ground area B102 was provided on an area of 11×50 mm at an end portion of an evaluation substrate B101 (100 mm×50 mm) including a short side thereof, the evaluation substrate B101 being modeled after a mounted substrate of a rectangular portable telephone and being mostly formed from a ground area B103. A base body (8.2×18×2.6 mm) B401 formed from a dielectric material was arranged on the non-ground area B102.

The base body B401 was arranged at a central part of the non-ground area B102 in such a way that the longitudinal direction of the base body B401 was parallel to the short sides of the substrate B101, and was 2.8 mm away from the ground area B103. A loop-shaped element B11 was formed on the surface of the base body B401. The loop-shaped element B11 included a first conductor pattern B11*a*, a second conductor pattern B11*b*, a first connecting conductor B11*c*, and a second connecting conductor B11*d*.

The conductor pattern B11*a* was formed on an upper surface of the base body B401, having a substantial C shape formed by providing a spacing at a portion of a loop-shaped conductor pattern formed along an edge line of the upper surface. The spacing was formed at a central part of a long side located on the outer side of the substrate, and a distance of the spacing was 1.6 mm.

The conductor pattern B11*b* was formed on a bottom surface of the base body B401, having a substantial C shape formed by providing a spacing at a portion of a loop-shaped conductor pattern formed along an edge line of the bottom surface. The spacing was formed at a central part of a long side located on the outer side of the substrate, and a distance of the spacing was 1.6 mm.

The connecting conductors B11*c* and B11*d* were formed on a side surface of a long side on the outer side of the base body B401, connecting ends of the conductor patterns B11*a* and B11*b*, and thereby the loop-shaped element B11 that formed a go-around loop as a whole was formed. For frequency adjustment, the conductor patterns B11*a* and B11*b* had a line width of 0.5 mm and the connecting conductors 11*c* and 11*d* had a line width of 2.95 mm.

Of the conductor pattern B11*b* formed on the bottom surface of the base body B401, a portion opposing the spacing was a power receiving section. A first and a second transmission wires B61 and B81 were arranged to be close to the power receiving section.

A first power feeder B21 was formed on the ground area B103 of the substrate B101, was connected to a central part of a border line with the non-ground area B102 via a 50-ohm transmission path B22 formed by a substrate pattern on a back surface of the substrate B101, and at this position was connected to the first transmission wire B61 formed by a substrate pattern on the back surface of the substrate B101. A serial matching element B184 and a parallel matching element B183 for securing matching were inserted into a connecting section between the transmission path B22 and the first transmission wire B61. The first transmission wire B61 formed a path that extended from the connecting section with the serial matching element B184 as a base point for 4 mm parallel to the radiation conductor of the power receiving section to be grounded to the ground area B103 of the substrate B101. A central part of the path and the power receiving section were arranged to be close to each other, and the distance therebetween was about 1 mm in the height direction and 2.8 mm in the longitudinal direction of the substrate. A portion of 4×2 mm of the ground area, where the first transmission wire was formed, was cut off to form a non-ground area.

On the other hand, a second power feeder was formed on the ground area B103 of the substrate B101, was connected to a central part of the border line with the non-ground area B102 via a 50-ohm transmission line B42 formed by a substrate pattern on a surface of the substrate B101, and was connected to the second transmission wire B81 formed by a substrate pattern on the surface of the substrate. A serial matching element B284 and a parallel matching element B283 for securing matching were inserted into a connecting section between the 50-ohm transmission line B42 formed on the substrate B101 and the second transmission wire B81.

The second transmission wire B81 formed a path that extended from the connecting section with the serial matching element B284 as a base point for 4.7 mm in the longitudinal direction of the substrate to form an open end. The open end and the power receiving section were close to each other, and the distance therebetween was 0.1 mm in the longitudinal direction of the substrate. Further, a ground conductor plate B90 of 2.5×2 mm formed by a substrate pattern of a middle layer was arranged 0.3 mm below the second transmission wire to prevent electromagnetic coupling between the first transmission wire and the second transmission wire.

Figure 56:
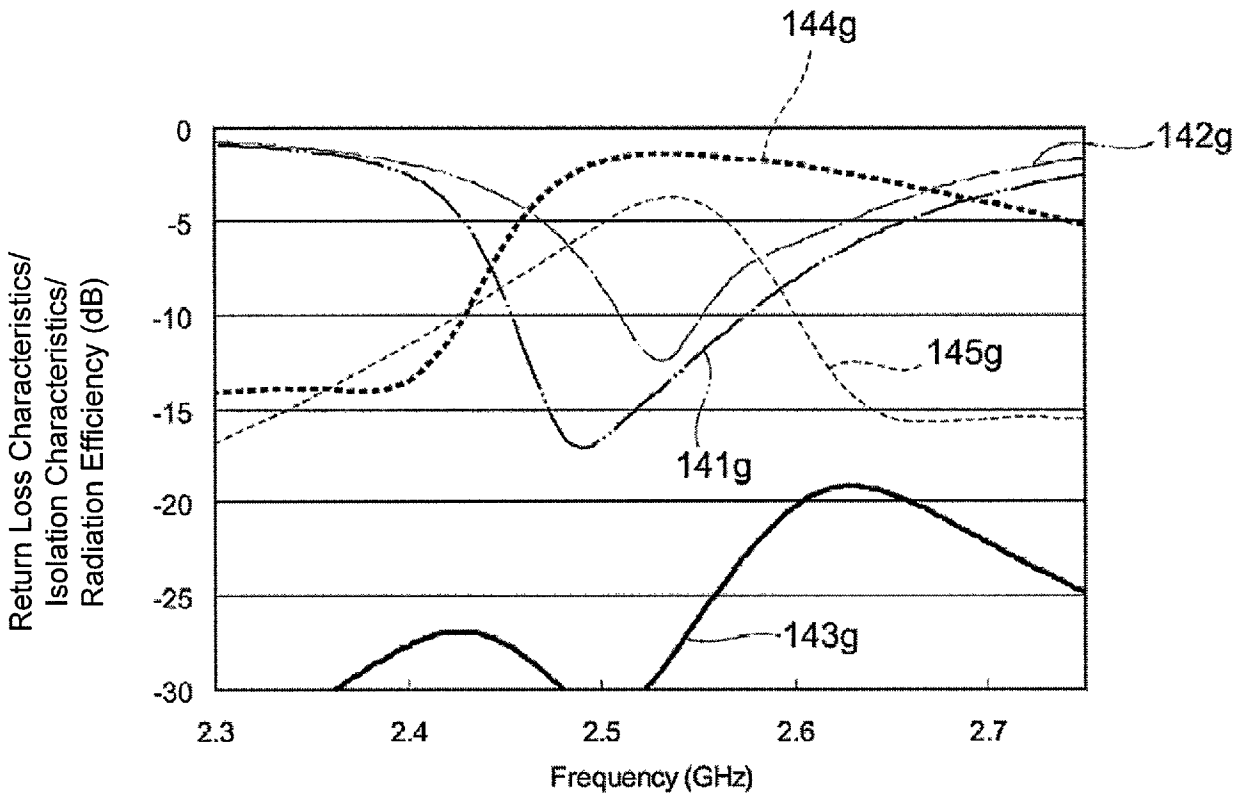
FIG. 56 illustrates electrical characteristics of the antenna device according to the example B7.

FIG. 56 illustrates electrical characteristics of the antenna device according to the example B7. FIG. 56 illustrates reflection (return loss) characteristics 141*g* viewed from the first power feeder B21, reflection (return loss) characteristics 142*g* viewed from the second power feeder B41, transmission (isolation) characteristics 143*g*, and further radiation efficiency 144*g* of radio wave power-fed from the power feeder B21 and radiation efficiency 145*g* of radio wave power-fed from the second power feeder B41.

Resonance frequencies for the cases of exciting from the first and second power feeders were each about 2.54 GHz. The two power feeders operated with the same frequency. A bandwidth of about 8% for the first power feeder and a band width of about 4.9% for the second power feeder were secured. It is clear from the isolation characteristics 143*g* that favorable isolation characteristics of about −19 dB or less over a range from 2.3 GHz to 2.7 GHz in the neighborhood of the operating frequency were secured between the two power feeders, that is, between the first power feeder B21 and the second power feeder B41. Favorable radiation characteristics such as that the radiation efficiency 144*g* of the radio wave power-fed from the first power feeder had a maximum of −1.4 dB and that the radiation efficiency 145*g* of the radio wave power-fed from the second power feeder had a maximum of −3.7 dB were obtained.

Example B8

Figure 57:
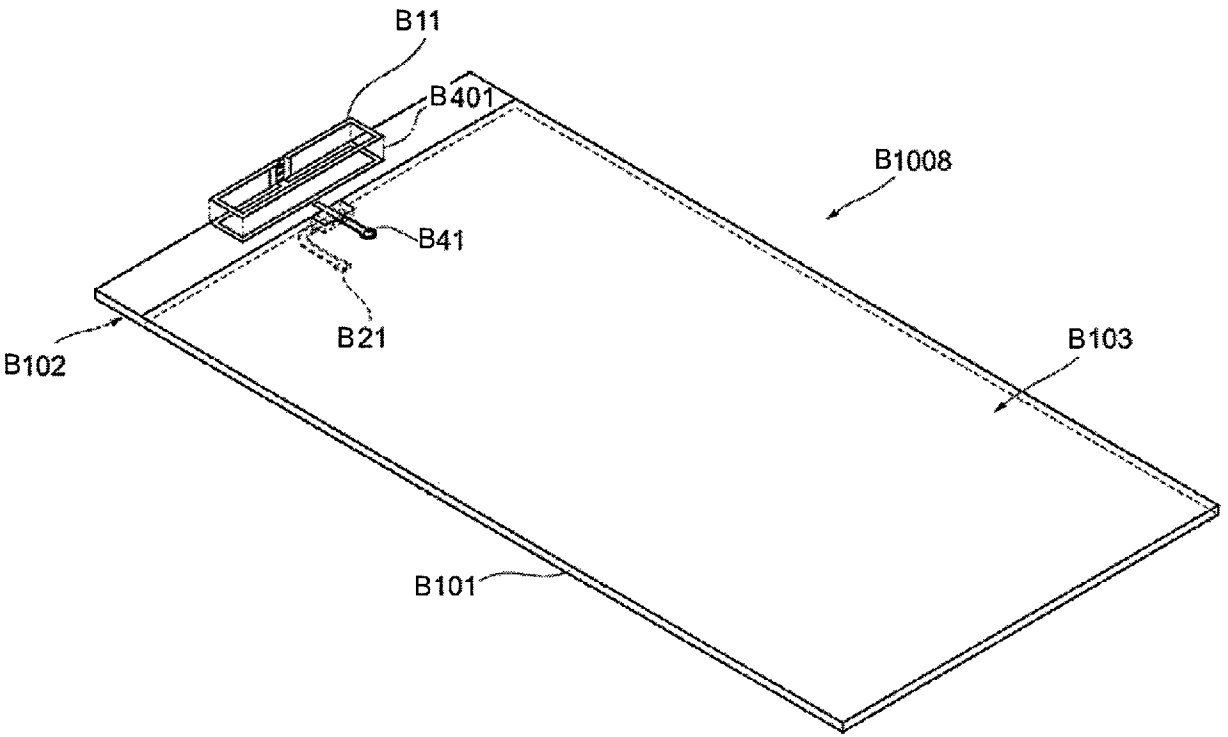
FIG. 57 illustrates an external view of an antenna device according to an example B8.
Figure 58:
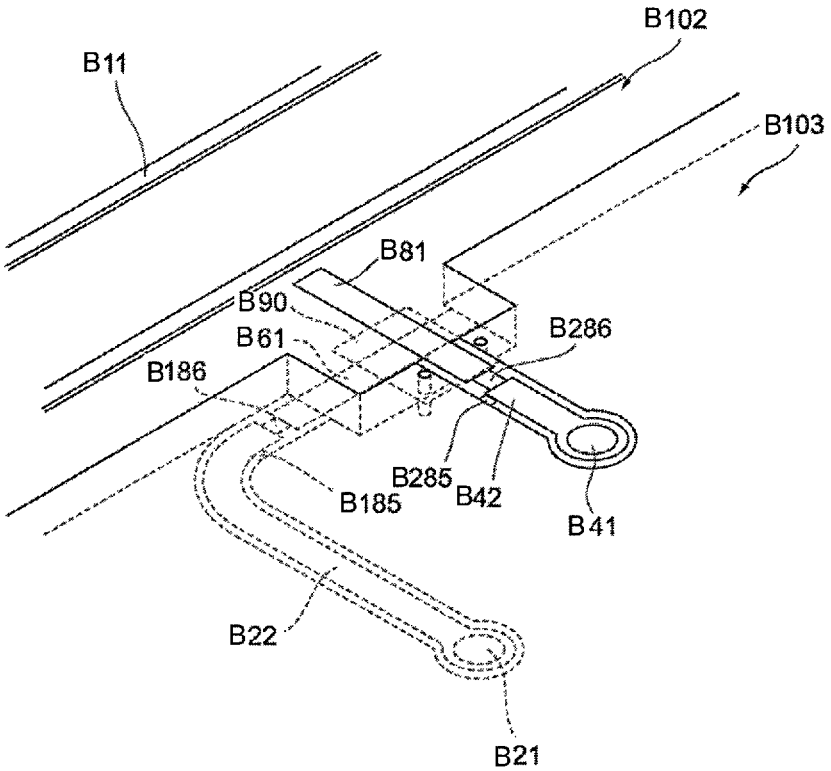
FIG. 58 illustrates details of power feeders of the antenna device according to the example B8.
Figure 59:
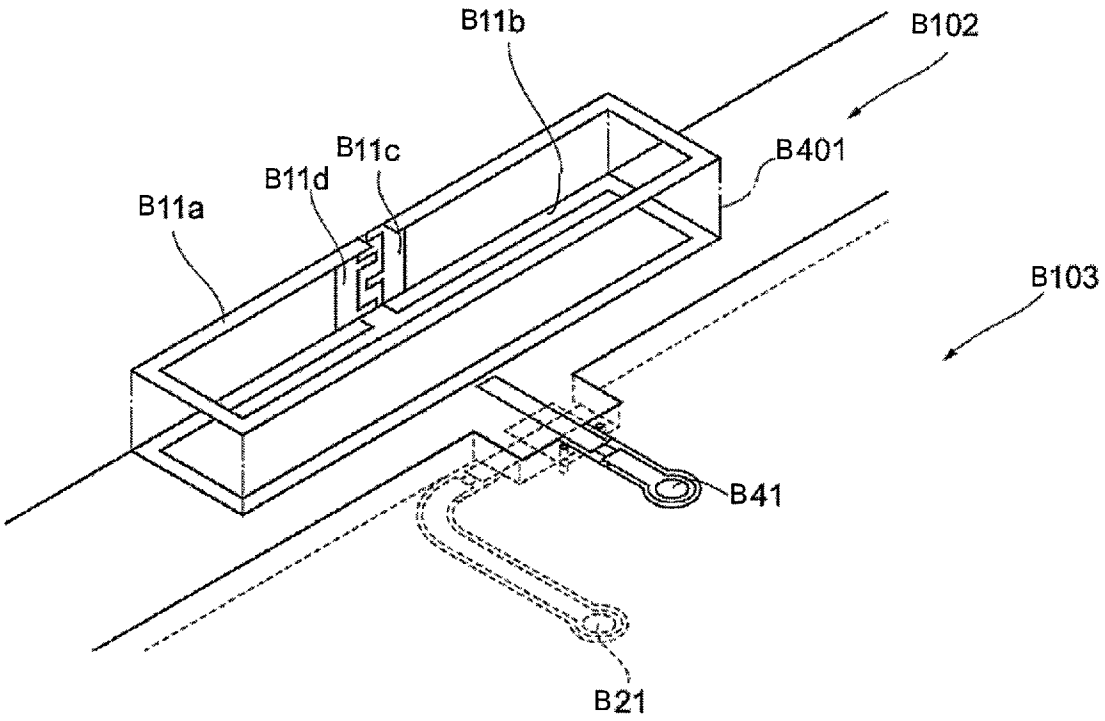
FIG. 59 illustrates details of a loop-shaped element of the antenna device according to the example B8.

FIG. 57 illustrates a perspective view of an antenna device according to an example B8. FIG. 58 illustrates a perspective view of details of power feeders of the antenna device according to the example B8. FIG. 59 illustrates a perspective view of details of a loop-shaped element of the antenna device according to the example B8. The example B8 corresponds to the above-described eleventh embodiment.

For simplicity, a non-ground area B102 was provided on an area of 6×50 mm at an end portion of an evaluation substrate B101 (100 mm×50 mm) including a short side thereof, the evaluation substrate B101 being modeled after a mounted substrate of a rectangular portable telephone and being mostly formed from a ground area B103. A base body (4.5×20×3.0 mm) B401 formed from a dielectric material was arranged on the non-ground area B102.

The base body B401 was arranged at a central part of the non-ground area B102 in such a way that the longitudinal direction of the base body B401 was parallel to the short sides of the substrate B101, and was 1.5 mm away from the ground area B103.

A loop-shaped element B11 was formed on the surface of the base body B401. The loop-shaped element B11 included a first conductor pattern B11*a*, a second conductor pattern B11*b*, a first connecting conductor B11*c*, and a second connecting conductor B11*d*.

The conductor pattern B11*a* was formed on an upper surface of the base body B401, having a substantial C shape formed by providing a spacing at a portion of a loop-shaped conductor pattern formed along an edge line of the upper surface. The spacing was formed at a central part of a long side located on the outer side of the substrate, and a width of the spacing was 1 mm.

The conductor pattern B11*b* was formed on a bottom surface of the base body B401, having a substantial C shape formed by providing a spacing at a portion of a loop-shaped conductor pattern formed along an edge line of the bottom surface. The spacing was formed at a central part of a long side located on the outer side of the substrate, and a width of the spacing was 1 mm.

The connecting conductors B11*c* and B11*d* were formed on a side surface of a long side on the outer side of the base body B401, connecting ends of the conductor pattern B11*a* and B11*b*, and thereby the loop-shaped element B11 that formed a go-around loop as a whole was formed.

For frequency adjustment, the conductor patterns B11*a* and B11*b* had a line width of 0.5 mm and the connecting conductors 11*c* and 11*d* had a line width of 1 mm. Further, a plurality of convex portions were provided on each of opposing potions of the connecting conductors 11*c* and 11*d*, and were alternately arranged with respect to each other. Each convex portion had a length of 0.7 mm and a width of 0.3 mm, and spacing between the convex portions was 0.6 mm.

Of the conductor pattern B11*b* formed on the bottom surface of the base body B401, a portion opposing the spacing was a power receiving section. A first and a second transmission wires B61 and B81 were arranged to be close to the power receiving section.

A first power feeder B21 was formed on the ground area B103 of the substrate B101, was connected to a central part of a border line with the non-ground area B102 via a 50-ohm transmission path B22 formed by a substrate pattern on a back surface of the substrate B101, and at this position was connected to the first transmission wire B61 formed by a substrate pattern on the back surface of the substrate B101. A serial matching element B186 and a parallel matching element B185 for securing matching were inserted into a connecting section between the transmission path B22 and the first transmission wire B61.

The first transmission wire B61 formed a path that extended from the connecting section with the serial matching element B186 as a base point for 4 mm parallel to the radiation conductor of the power receiving section to be grounded to the ground area B103 of the substrate B101. A central part of the path and the power receiving section were arranged to be close to each other, and the distance therebetween was 1 mm in the height direction and 1.5 mm in the longitudinal direction of the substrate. A portion of 4×1.5 mm of the ground area, where the first transmission wire was formed, was cut off to form a non-ground area.

On the other hand, a second power feeder was formed on the ground area B103 of the substrate B101, was connected to a central part of the border line with the non-ground area B102 via a 50-ohm transmission line B42 formed by a substrate pattern on a surface of the substrate B101, and at this position was connected to the second transmission wire B81 formed by a substrate pattern on the surface of the substrate. A serial matching element B286 and a parallel matching element B285 for securing matching were inserted into a connecting section between the 50-ohm transmission line B42 formed on the substrate B101 and the second transmission wire B81.

The second transmission wire B81 formed a path that extended from the connecting section with the serial matching element B286 as a base point for 2.9 mm in the longitudinal direction of the substrate to form an open end. The open end and the power receiving section were close to each other, and the distance therebetween was 0.1 mm in the longitudinal direction of the substrate. Further, a ground conductor plate B90 of 2×2 mm formed by a substrate pattern of a middle layer was arranged 0.3 mm below the second transmission wire to prevent electromagnetic coupling between the first transmission wire and the second transmission wire.

Figure 60:
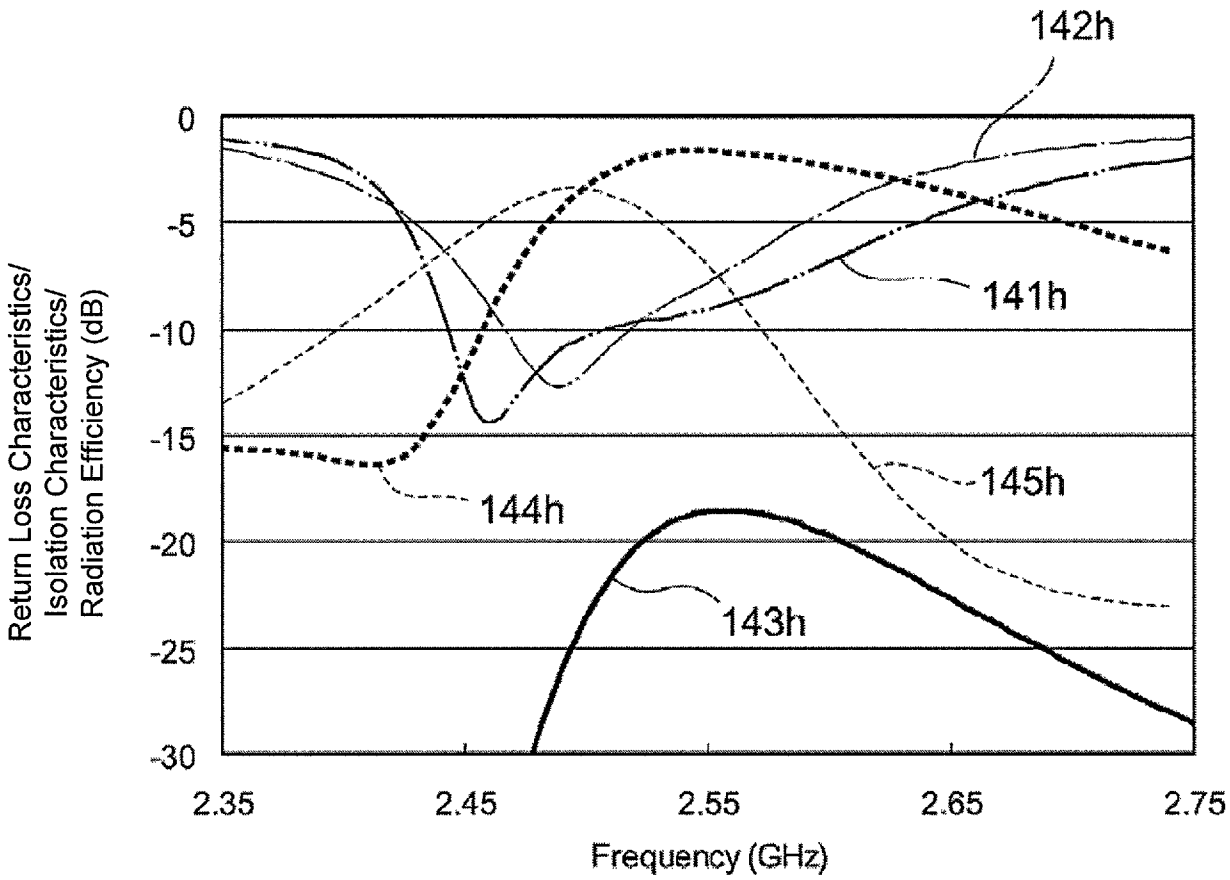
FIG. 60 illustrates electrical characteristics of the antenna device according to the example B8.

FIG. 60 illustrates electrical characteristics of the antenna device according to the example B8. FIG. 60 illustrates reflection (return loss) characteristics 141*h* viewed from the first power feeder B21, reflection (return loss) characteristics 142*h* viewed from the second power feeder B41, transmission (isolation) characteristics 143*h*, and further radiation efficiency 144*h* of radio wave power-fed from the power feeder B21 and radiation efficiency 145*h* of radio wave power-fed from the second power feeder B41.

Resonance frequencies for the cases of exciting from the first and second power feeders were each about 2.51 GHz.

The two power feeders operated with the same frequency. A bandwidth of about 7.4% for the first power feeder and a band width of about 5.4% for the second power feeder were secured. It is clear from the isolation characteristics 143*h* that favorable isolation characteristics of about −18.5 dB or less over a range from 2.35 GHz to 2.75 GHz in the neighborhood of the operating frequency were secured between the two power feeders, that is, between the first power feeder B21 and the second power feeder B41. Favorable radiation characteristics such as that the radiation efficiency 144*h* of the radio wave power-fed from the first power feeder had a maximum of −1.6 dB and that the radiation efficiency 145*h* of the radio wave power-fed from the second power feeder had a maximum of −3.4 dB were obtained.

Example B9

Figure 61:
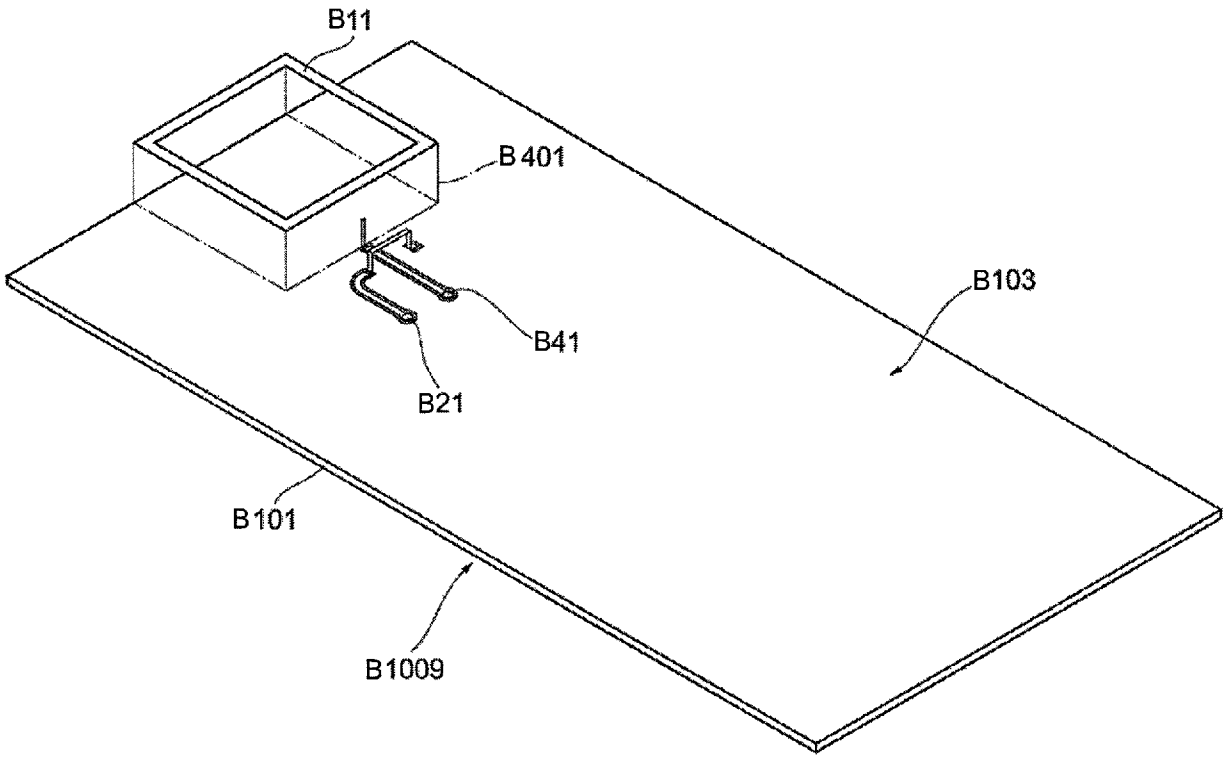
FIG. 61 illustrates an external view of an antenna device according to an example B9.
Figure 62:
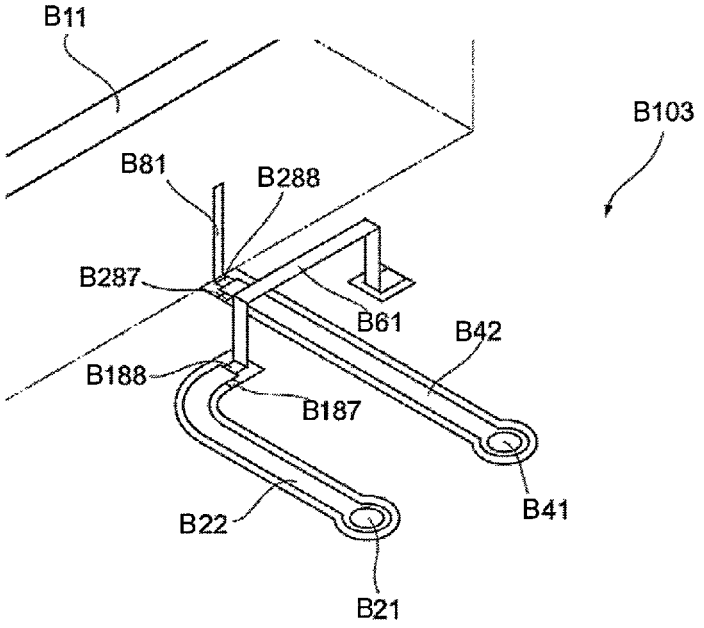
FIG. 62 illustrates details of the antenna device according to the example B9.

FIG. 61 illustrates a perspective view of an antenna device according to an example B9. FIG. 62 illustrates a perspective view of details of the antenna device according to the example B9. The example B9 corresponds to the above-described twelfth embodiment. For simplicity, a base body B401 formed from a dielectric material having a shape of a cuboid (19×19×6 mm) was arranged on an evaluation substrate B101 (100 mm×50 mm) modeled after a mounted substrate of a rectangular portable telephone, and the entire surface of the evaluation substrate B101 was formed from a ground area B103. Further, a rectangular (19×19 mm) loop-shaped element B11 having a line width of about 0.5 mm was prepared along an edge line of an upper surface of the base body B401.

The base body B401 was arranged with respect to the substrate B101 at a central part of a short side of the substrate in a manner that one of the side surfaces of the base body B401 was right above the short side of the substrate B101. Of the loop-shaped element B11 formed on the upper surface of the base body B401, a central part of the loop-shaped element located in the interior of the substrate B101 was a power receiving section. A first and a second transmission wires B61 and B81 were arranged to be close to the power receiving section. For frequency adjustment, the loop-shaped element B11 was formed to have a line width of 0.58 mm for portions parallel to the short sides of the substrate B101 and a line width of 0.5 mm for portions parallel to the long sides of the substrate B101.

A first power feeder B21 was formed on the substrate B101, was linked to the vicinity of the power receiving section via a 50-ohm transmission path B22 formed on the substrate B101, and at this position was connected to a first transmission wire B61. A parallel matching element B187 and a serial matching element B188 for securing matching were inserted into a connecting section between the transmission path B22 formed on the substrate B101 and the first transmission wire B61.

The first transmission wire B61 formed a substantially C-shaped path that extended from the connecting section with the serial matching element B188 as a base point for 2 mm in a height direction with respect to the substrate surface, extended for 5 mm parallel to the radiation conductor of the power receiving section, and then extended for 2 mm toward the substrate surface to be grounded to a ground area B103 of the substrate B101. A central part of the C-shaped path and the power receiving section were close to each other, and the distance therebetween was 4 mm in the height direction and 3 mm in the longitudinal direction of the substrate.

On the other hand, a second power feeder B41 was formed on the substrate surface, was linked to the vicinity of the power receiving section via a 50-ohm transmission line B42 formed on the substrate B101, and at this position was connected to a second transmission wire B81. A serial matching element B288 and a parallel matching element B287 for securing matching were inserted into a connecting section between the 50-ohm transmission line B42 formed on the substrate B101 and the second transmission wire B81.

The second transmission wire formed a path that was formed on a side surface of the base body B401 and that extended from the connecting section with the serial matching element B288 as a base point for 2.5 mm in the height direction to form an open end. The open end and the power receiving section were close to each other, and the distance therebetween was 3.5 mm in the height direction.

Figure 63:
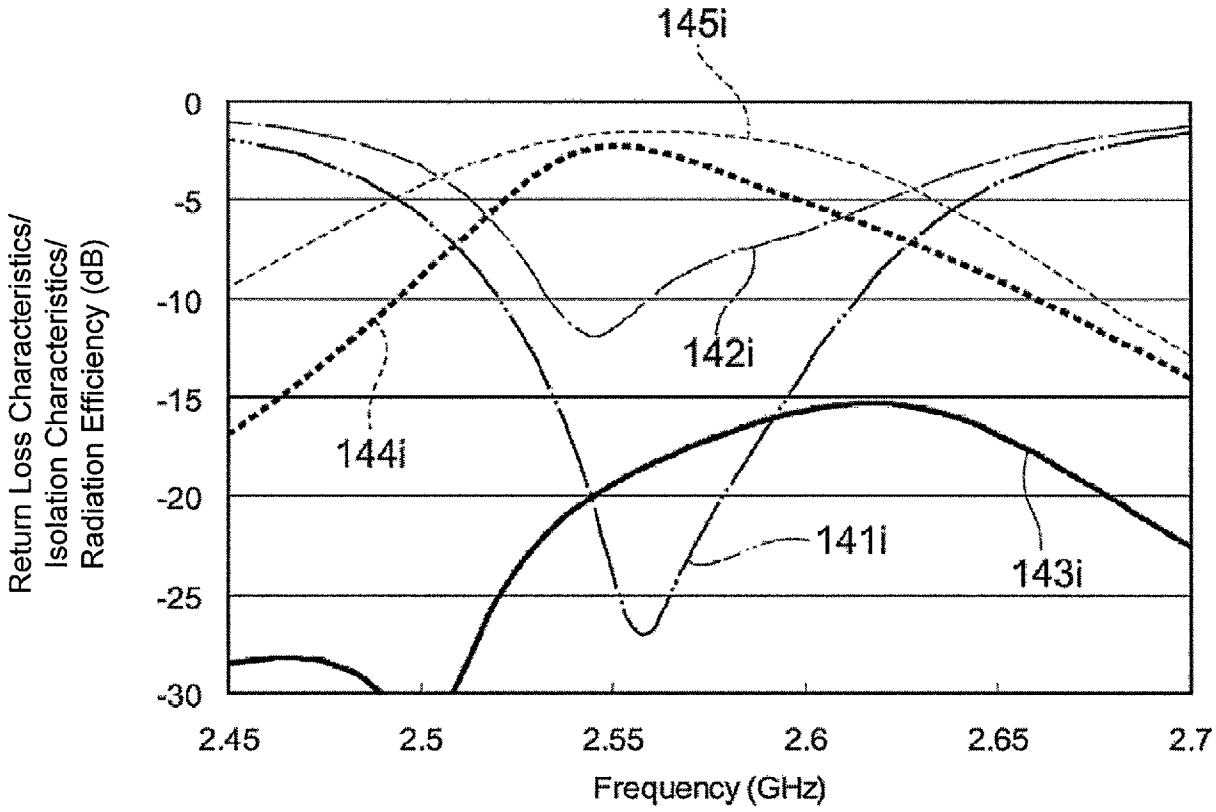
FIG. 63 illustrates electrical characteristics of the antenna device according to the example B9.

FIG. 63 illustrates electrical characteristics of the antenna device according to the example B9. FIG. 63 illustrates reflection (return loss) characteristics 141*i* viewed from the first power feeder B21, reflection (return loss) characteristics 142*i* viewed from the second power feeder B41, transmission (isolation) characteristics 143*i*, and further radiation efficiency 144*i* of radio wave power-fed from the power feeder B21 and radiation efficiency 145*i* of radio wave power-fed from the second power feeder B41. Resonance frequencies for the cases of exciting from the first and second power feeders were each about 2.56 GHz. The two power feeders operated with the same frequency. A bandwidth of about 5.2% for the first power feeder and a band width of about 3.5% for the second power feeder were secured. It is clear from the isolation characteristics 143*i* that favorable isolation characteristics of about −15 dB or less over a range from 2.45 GHz to 2.7 GHz in the neighborhood of the operating frequency were secured between the two power feeders, that is, between the first power feeder B21 and the second power feeder B41.

Radiation characteristics such as that the radiation efficiency 144*i* of the radio wave power-fed from the first power feeder had a maximum of −1.5 dB and that the radiation efficiency 145*i* of the radio wave power-fed from the second power feeder had a maximum of −2.3 dB were obtained.

What is claimed is:

1. An antenna device comprising:

a loop-shaped element radiating a radio wave of at least wavelength λ and having an electrical length of m×λ;

a first power feeder exciting the loop-shaped element via voltage or current coupling by using a first electrical signal for radiating the radio wave; and a second power feeder exciting the loop-shaped element via a coupling method that is the same type as the first power feeder by using a second electrical signal for radiating a radio wave of wavelength λ/(2×p−1) at a portion that becomes a node of a standing wave that is formed with the first power feeder as an anti-node and that is based on the first electrical signal, here, "m" and "p" are natural numbers, wherein power feeders of the first power feeder and the second power feeder that perform the voltage coupling have capacitive coupling electrodes arranged opposing the loop-shaped element and are power-fed from central parts of the capacitive coupling electrodes.

2. An antenna device comprising:

a loop-shaped element radiating a radio wave of at least wavelength λ and having an electrical length of m×λ;

a first power feeder exciting the loop-shaped element via voltage or current coupling by using a first electrical signal for radiating the radio wave; and a second power feeder exciting the loop-shaped element via a coupling method that is a different type from the first power feeder by using a second electrical signal for radiating a radio wave of wavelength λ/q at a portion that becomes an anti-node of a standing wave that is formed with the first power feeder as an anti-node and that is based on the first electrical signal, here, "m" and "q" are natural numbers.

3. The antenna device according to claim 2, wherein electrodes constituting the first power feeder and the second power feeder are provided on opposite sides of each other sandwiching the loop-shaped element.

4. The antenna device according to claim 2, wherein either one of the first power feeder and the second power feeder that performs the voltage coupling has a capacitive coupling electrode arranged opposing the loop-shaped element and is power-fed from a central part of the capacitive coupling electrode.

5. An antenna device comprising:

a substrate having a ground area;

a first power feeder and a second power feeder arranged on the substrate;

a loop-shaped element; and a first transmission wire and a second transmission wire, wherein the loop-shaped element has, a power receiving section arranged close to the first transmission wire and the second transmission wire, characteristic impedance adjustment sections, and a shape including the power receiving section that is plane-symmetrical with respect to a first plane that is perpendicular to the loop-shaped element at the power receiving section, the first transmission wire extends from the first power feeder, passes through the vicinity of the power receiving section, and has an front end grounded to the ground area, and the second transmission wire extends from the second power feeder, and has a front end that becomes an open end at the vicinity of the power receiving section.

6. The antenna device according to claim 5, wherein the loop-shaped element has a folded shape.

7. The antenna device according to claim 5, wherein a portion of a conductor of at least one of the first transmission line, the second transmission line, and the loop-shaped element is formed by a conductor pattern on the substrate.

8. The antenna device according to claim 7, wherein the substrate has an electrode structure of at least two layers, at least a portion of the first transmission wire is formed on one of the two layers of the substrate, and at least a portion of the second transmission wire is formed on the other layer of the substrate, which is different from the layer on which the portion of the first transmission wire is formed.

9. The antenna device according to claim 5, wherein a base body that is formed from a dielectric material or a magnetic material and that has a substantially rectangular cuboid shape is provided on the substrate, and the loop-shaped element is formed on a surface of the base body.

10. The antenna device according to claim 9, wherein the substrate has a non-ground area that is provided along at least one side of the substrate, and the base body is arranged in the non-ground area of the substrate.

11. The antenna device according to claim 10, wherein the base body is arranged parallel to a border line between the ground area and the non-ground area, and comprises:

a first surface containing a side parallel to the border line;

a second surface opposing the first surface; and a third surface containing a side parallel to the border line and connecting the first surface and the second surface, the first surface and the third surface are connected at a first side, the second surface and the third surface are connected at a second side, the loop-shaped element comprises:

a substantially C-shaped first conductor pattern formed along an edge line of the first surface and having a first spacing at substantially a center of the first side; and a substantially C-shaped second conductor pattern formed along an edge line of the second surface and having a second spacing substantially at a center of the second side, ends of the first conductor pattern and ends of the second conductor pattern are connected by a first connecting conductor and a second connecting conductor that are formed on the third surface, and a gap is provided between the first connecting conductor and the second connecting conductor.

12. The antenna device according to claim 11, wherein the first conductor pattern is formed only on the first surface, and the second conductor pattern is formed only on the second surface.

13. The antenna device according to claim 11, wherein a capacity adjustment section is provided in an opposing area of the loop-shaped element, the opposing area being formed from the gap, the first spacing and the second spacing.

14. The antenna device according to claim 9, wherein at least a portion of one of the first transmission wire and the second transmission wire is formed on a surface of the base body.

15. The antenna device according to claim 9, wherein a portion of the first transmission wire and a portion of the second transmission wire are formed on a surface of the base body.

* * * * *